United States Patent [19]

Fujita et al.

[11] Patent Number: 4,963,474

[45] Date of Patent: Oct. 16, 1990

[54] METHOD FOR PROCESSING SILVER HALIDE COLOR PHOTOGRAPHIC MATERIAL

[75] Inventors: Yoshihiro Fujita; Shinji Ueda; Takatoshi Ishikawa; Akira Abe, all of Kanagawa, Japan

[73] Assignee: Fuji Photo Film Co., Ltd., Kanagawa, Japan

[21] Appl. No.: 309,588

[22] Filed: Feb. 13, 1989

[30] Foreign Application Priority Data

Feb. 13, 1988 [JP] Japan ..... 63-31119
Feb. 22, 1988 [JP] Japan ..... 63-39003

[51] Int. Cl.[5] ..... G03C 7/42

[52] U.S. Cl. ..... 430/393; 430/429; 430/455; 430/491

[58] Field of Search ..... 430/393, 429, 455, 491

[56] References Cited

U.S. PATENT DOCUMENTS 4,444,873 4/1984 Ishikawa et al. ..... 430/455
4,804,617 2/1989 Nishikawa et al. ..... 430/393

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A method of processing a silver halide color photographic material in which the material is, after color-developed, processed in a bath having bleaching ability and then in a bath having fixing ability, wherein a bleaching agent in the bath having bleaching ability is at least one iron(III) complex of an aminopolycarboxylic acid of the following formula (I) and the bath having fixing ability contains at least one organic phosphonic acid:

(I)

wherein n represents 3, 4 or 5, and is preferable 3. Especially, the bleaching agent in the bath having bleaching ability comprises at least one iron(III) complex of a compound selected from the following group (A) and a (1,3-diaminopropanetetraacetato)iron(III) complex in a molar proportion of the former to the latter of being 3 or less, and ammonium ion accounts for 90 mol % or more of the sum of the alkali metal ions and ammonium ion in the bath having fixing ability; Group (A): A-1: Ethylenediaminetetraacetic Acid A-2: Diethylenetriaminepentaacetic Acid A-3: 1,2-Cyclohexanediaminetetraacetic Acid A-4: 1,2-Propylenediaminetetraacetic Acid. According to the method, rapid desilvering is effected, the stability of the fixing agent is improved, bleaching fog is inhibited, the fixing speed is elevated, and the storage stability of the images formed in the material processed is improved.

20 Claims, No Drawings

METHOD FOR PROCESSING SILVER HALIDE COLOR PHOTOGRAPHIC MATERIAL

FIELD OF THE INVENTION

The present invention relates to a method for processing an exposed silver halide color photographic material for development, bleaching and fixing and, in particular, to an improved processing method where the bleaching action is accelerated to shorten the processing time and a bath having extremely improved fixing ability is obtained and, additionally, the image storability of the processed material is improved.

BACKGROUND OF THE INVENTION

In general, the procedure of processing color photographic materials basically comprises a color development step and a desilvering step. Precisely, an exposed silver halide color photographic material is first introduced into a color development step, where the silver halide is reduced by a color developing agent to give silver while the oxidized color developing agent reacts with a color coupler to give a colored image. After this step, the color photographic material is then introduced into a desilvering step, where the silver formed in the previous step is oxidized by the action of an oxidizing agent (which is generally called a "bleaching agent") and then dissolved and removed by the action of a silver ion complexing agent (which is generally called a "fixing gent"). Accordingly, the photographic material processed by these steps has a finished color image only. Commercial development processing has, in addition to the aforesaid basic two steps of color development and desilvering, auxiliary steps for the purpose of stabilizing the photographic and physical properties of the images formed and of improving the storability of the images formed. For example, there are mentioned a film hardening bath to prevent excess softening of the light-sensitive layer of the material being processed, a stopping bath to effectively stop development, an image stabilizing bath to stabilize the image formed in the processed material and a desilvering bath to remove the backing layer from the support, as the auxiliary steps.

The aforesaid desilvering step, as one of the two basic steps, includes a two-step system where bleaching and fixing are separately carried out in a different bleaching bath and fixing bath and a one-step system where bleaching and fixing are simultaneously carried out in a bleach-fixing bath containing both a bleaching agent and a fixing agent. The latter is a simplified step having an object of accelerating the processing procedure and of economizing the energy required.

Recently, for processing color photographic materials, a bleaching method essentially using a ferric complex salt (for example, ferric aminopolycarboxylate complexes, especially (ethylenediaminetetraacetato)iron(III) complexes) has been principally employed for the purpose of simplification and acceleration of photographic processing and of prevention of environmental pollution during photographic processing.

However, since ferric complex salts have a relatively small oxidizing power and are insufficient in bleaching capacity, a bleaching agent having such ferric complex salt would generally be effective for bleaching or bleach-fixing low sensitive silver halide color photographic materials, for example, essentially comprising a silver chlorobromide emulsion, so as to attain the desired objects, but it would be unsuitable for processing color-sensitized high sensitive silver halide color photographic materials, for example, essentially comprising a silver chlorobromide or silver iodobromide emulsion, especially for processing picture taking color reversal photographic materials or picture taking color negative photographic materials containing high silver content emulsions. This is because, in the latter case, the bleaching capacity of the agent would be insufficient and could cause desilvering failure, or a long time would disadvantageously be required for completing the bleaching.

In general, sensitizing dyes are incorporated into color photographic materials for the purpose of color sensitization thereof. In particular, when high silver content or high aspect ratio tabular grains are used with the object of imparting a high sensitivity to color photographic materials, the sensitizing dye adsorbed on the surfaces of the silver halide grains would probably interfere with the bleaching of the silver formed by development of the silver halide.

As bleaching agents other than ferric complex salts, persulfates are known. In general, a persulfate is combined with a chloride to form a bleaching solution. However, a bleaching solution containing such a persulfate is also defective in that the bleaching capacity of the solution is far lower than that of a bleaching solution containing a ferric complex salt so that an extremely long time is required for completing the bleaching procedure.

In general, a bleaching agent relates to the bleaching capacity thereof in that a bleaching agent which is free from environmental pollution in use or which does not corrode apparatus and instruments in use has a poor bleaching capacity. Accordingly, a bleaching solution or bleach-fixing solution containing a bleaching agent with a poor bleaching capacity, especially ferric complex salts or persulfates, is desired to have an improved and increased bleaching capacity.

To this end, *Research Disclosure,* Item No. 24023 (April, 1984) and JP-A-Nos. 60-230653 and 62-222252 mention a processing method using two or more kinds of various ferric aminopolycarboxylate complex salts (the term "JP-A" as used herein refers to a "published unexamined Japanese patent application"). In accordance with this method, however, fixing of a satisfactory level could not be attained.

On the other hand, (1,3-diaminopropanetetraacetato)iron(III) complexes have an excellent bleaching power as a bleaching agent. However, these have the defect that they often cause bleaching fog.

For accelerating the desilvering step, not only is acceleration of the bleaching speed but also acceleration of the fixing speed is indispensable, so that it is also desired to simplify and accelerate the fixing step.

On the other hand, U.S. Pat. No. 3,615,508 and JP-A-No. 50-140128 mention that incorporation of ammonium ions into a bleach-fixing solution as cations is effective for improving the desilvering capacity of the solution. However, these patent publications are silent on the means of improving the fixing speed or of stabilizing the image formed after processing.

In photographic processing, shortening the desilvering step would often be accompanied by the color developing agent remaining in the color photographic material processed. The remaining color developing agent would often have the serious problem of causing undesired coloring (stain) in the photographic material after storage. Accordingly, a technique of overcoming the aforesaid problem is also indispensable. In particular, generation of stain is especially remarkable when a high coloring magenta coupler is used in the photographic material.

In order to overcome the aforesaid problems, conventional antifading technique or stain preventing techniques may be considered to be applied to the aforesaid photographic materials. Specifically, there are antifading techniques using hydroquinone derivatives described in U.S. Pat. Nos. 2,360,290, 2,418,613, 2,675,314 and 2,701,197, British Pat. No. 1,363,921 and JP-A-No. 58-24141, gallic acid derivatives described in U.S. Pat. Nos. 3,457,079 and 3,069,262, p-alkoxyphenols described in U.S. Pat. No. 2,735,765 and JP-B-No. 49-20977 (the term "JP-B" as used herein refers to an "examined Japanese patent publication"), p-hydroxyphenol derivatives described in U.S. Pat. Nos. 3,432,300 and 3,575,050 and JP-A-Nos. 52-35633 and 52-147434, or bisphenols described in U.S. Pat. No. 3,700,455, as well as stain inhibiting techniques described in JP-A-Nos. 49-11330, 50-57223 and 56-85747 and JP-B-No. 56-8346. Despite such techniques, however, sufficient effects could not be attained.

In a method of continuously processing a silver halide color photographic material, when the material is processed in a bath having bleaching ability and then in a bath having fixing ability, the bleaching agent would be carried over into the bath having a fixing ability.

Thiosulfates which are generally used as a fixing agent are easily oxidized and deteriorated, and for the purpose of preventing such oxidation and deterioration, sulfites are used together with thiosulfates as a general method.

However, when an (aminopolycarboxylato)iron(III) complex which corresponds to formula (I) mentioned below is used as a bleaching agent and is carried over into the bath having fixing ability in continuous processing, this extremely accelerates deterioration of sulfites and thiosulfates. As a result, it has been found that the fixing speed is thereby lowered, precipitates or floating substances are formed, and/or the photographic material processed is undesirably stained. Accordingly, an effective means of overcoming such problems is needed.

SUMMARY OF THE INVENTION

Accordingly, one object of the present invention is to provide a method of processing a silver halide color photographic material in which rapid desilvering is carried out and the stability of the fixing agent used is extremely improved.

Another object of the present invention is to provide a method of processing a silver halide color photographic material in which bleaching fog (that is, stain immediately after processing) is inhibited and rapid bleaching is carried out.

Still another object of the present invention is to provide a method of processing a silver halide color photographic material in which the fixing speed is increased and the storage stability of the image formed in the photographic material processed is improved (for example, formation of stain in the processed photographic material after stored is prevented).

The objects of the present invention have been attained by a method of processing a silver halide color photographic material in which the material is, after being color developed, processed in a bath having bleaching ability and then in a bath having fixing ability, wherein a bleaching agent in the bath having bleaching ability is at least one iron(III) complex of an aminopolycarboxylic acid of the following general formula (I) and that the bath having fixing ability contains at least one organic phosphonic acid:

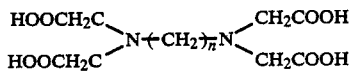

(I)

wherein n represents 3, 4 or 5.

DETAILED DESCRIPTION OF THE INVENTION

Preferred embodiments for carrying out the invention will be explained in detail hereunder.

The (aminopolycarboxylato)iron(III) complexes are represented by formula (I) include those where the ratio of the aminopolycarboxylic acid moiety to the iron(III) moiety is ½, 1/1 or 2/1. In particular, complexes where the ratio is 1/1 are especially preferred. The complexes may be in the form of alkali metal salts such as sodium salts or potassium salts or in the form of ammonium salts. Especially, complexes of formula (I) where n is 3 and/or in the form of ammonium salts are preferred because of the high bleaching speed, and particularly, complexes of ammonium salts where n is 3 are most preferred. The amount of the (aminopolycarboxylato)iron(III) complex to be added is from 0.05 mol to 1 mol, preferably from 0.1 mol to 0.5 mol, per liter of bleaching solution.

In accordance with one preferred embodiment of the present invention, the processing solution having a bleaching ability contains at least one iron(III) complex of a compound selected from compounds of the following Group (A) and a (1,3-diaminopropanetetraacetato)iron(III) complex with the preferred molar proportion of the former to the latter of being 3 or less. Preferably, ammonium ion accounts for 90 mol % or more of the sum of the alkali metal ions and ammonium ion in the processing solution having a fixing ability.

Group (A):

A-1: Ethylenediaminetetraacetic Acid
A-2: Diethylenetriaminepentaacetic Acid
A-3: 1,2-Cyclohexanediaminetetraacetic Acid
A-4: 1,2-Propylenediaminetetraacetic Acid In accordance with the present invention, it has been found that the combined use of a (1,3-diaminopropanetetraacetato)iron(III) complex and an iron(III) complex of a compound selected from Group (A) is effective for preventing bleaching fog or the formation of magenta stain (in the photographic material processed) without lowering the bleaching power of the bleaching solution. Especially, it has further been found that when ammonium ion accounts for 90 mol % or more of the sum of the alkali metal ions and ammonium ion in the solution having a fixing ability, the fixing speed is noticeably accelerated, the amount of the developing agent remaining in the photographic material processed is small and good image stability may be attained. The present invention has been accomplished on the basis of such technical findings. More preferably, ammonium ion accounts for 95 to 100 mol %.

The "solution having a fixing ability" as referred to herein includes a fixing solution and a bleach-fixing solution. When two or more processing baths having fixing ability (which may be baths of either the same kind or different kinds) are used in accordance with the method of the present invention, at least one bath among them may well satisfy the said condition of ammonium ion accounting for 90 mol % or more of the sum of the alkali metal ions and ammonium ion in the solution. Preferably, the latter bath may satisfy the condition of ammonium ion accounting for 90 mol % of the sum of the alkali metal ions and ammonium ion in the solution.

The bath having a bleaching ability for use in the present invention can contain various bleaching accelerators.

As such bleaching accelerator there can be used, for example, mercapto group- or disulfido group-containing compounds described in U.S. Pat. No. 3,893,858, West German Pat. No. 1,290,812, British Pat. No. 1,138,842, JP-A-No. 53-95630 and *Research Disclosure*, Item No. 17129 (July, 1978), thiazoline derivatives described in JP-A-No. 50-140129, thiourea derivatives described in U.S. Pat. No. 3,706,561, iodides described in JP-A-No. 58-16235, polyethylene oxides described in West German Pat. No. 2,748,430 and polyamine compounds described in JP-B-No. 45-8836. Especially, mercapto compounds described in British Pat. No. 1,138,842 are preferred.

In particular, bleaching accelerators represented by the following general formulae (IA) through (VIA) are preferably used in accordance with the method of the present invention, as having an excellent bleaching ability with less bleaching fog.

$$R^{1A}—S—M^{1A} \qquad \text{(IA)}$$

wherein $M^{1A}$ represents a hydrogen atom, an alkali metal atom or an ammonium group; and $R^{1A}$ represents an alkyl group, an alkylene group, an aryl group, or a heterocyclic group.

The alkyl group preferably has from 1 to 5 carbon atoms, most preferably from 1 to 3. The alkylene group preferably has from 2 to 5 carbon atoms. The aryl group includes a phenyl group and a naphthyl group, and it is preferably a phenyl group. The heterocyclic group is preferably a nitrogen-containing 6-membered group such as pyridine or triazine, or a nitrogen-containing 5-membered group such as azole, pyrazole, triazole or thiadiazole. Most preferably, the hetero ring-forming atomic group contains two or more nitrogen atoms. $R^{1A}$ may further be substituted by substituent(s). As the substituents, there may be mentioned an alkyl group, an alkylene group, an alkoxy group, an aryl group, a carboxyl group, a sulfo group, an amino group, an alkylamino group, a dialkylamino group, a hydroxyl group, a carbamoyl group, a sulfamoyl group and a sulfonamido group.

Among the compounds of formula (IA), those of the following formulae (IA-1) through (IA-4) are preferred.

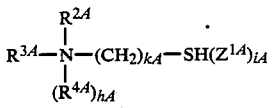

(IA-1)

wherein $R^{2A}$, $R^{3A}$ and $R^{4A}$ may be the same or different and each represents a hydrogen atom, a substituted or unsubstituted lower alkyl group (preferably having from 1 to 5 carbon atoms, especially preferably, methyl, ethyl or propyl) or an acyl group (preferably having from 1 to 3 carbon atoms, for example, acetyl or propionyl); kA represents an integer of from 1 to 3; $Z^{1A}$ represents an amino (e.g., chloride ion, bromide ion, nitrate ion, sulfate ion, p-toluenesulfonato, oxalato); hA represents 0 or 1; iA represents 0 or 1; and $R^{2A}$ and $R^{3A}$ may be bonded to form a ring.

$R^{2A}$, $R^{3A}$ and $R^{4A}$ each is preferably a hydrogen atom or a substituted or unsubstituted lower alkyl group.

As substituents for $R^{2A}$, $R^{3A}$ and $R^{4A}$, a hydroxyl group, a carboxyl group, a sulfo group, and an amino group are preferred.

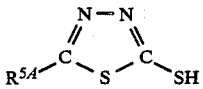

(IA-2)

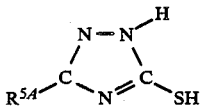

(IA-3)

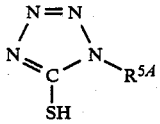

(IA-4)

In these formulae, $R^{5A}$ represents a hydrogen atom, a halogen atom (e.g., chlorine, bromine), an amino group, a substituted or unsubstituted lower alkyl group (preferably having from 1 to 5 carbon atoms, especially preferably methyl, ethyl or propyl), an alkylamino group (e.g., methylamino, ethylamino, dimethylamino, diethylamino) or a substituted or unsubstituted alkylthio group.

As substituents for $R^{5A}$, there are a hydroxyl group, a carboxyl group, a sulfo group, an amino group and an alkylamino group.

$$R^{1A}—S—S—R^{6A} \qquad \text{(IIA)}$$

wherein $R^{1A}$ has the same meaning as that in formula (IA); $R^{6A}$ has the same meaning as $R^{1A}$; and $R^{1A}$ may be the same or different from $R^{6A}$.

Among the compounds of formula (IIA), those of the following formula (IIA-1) are preferred.

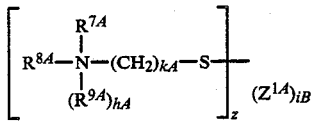

(IIA-1)

wherein $R^{7A}$, $R^{8A}$ and $R^{9A}$ have the same meaning as $R^{2A}$, $R^{3A}$ and $R^{4A}$, respectively; hA, kA and $Z^{1A}$ have the same meaning as in formula (IA-1); and iB represents 0, 1 or 2.

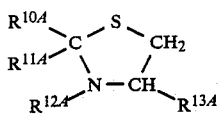

(IIIA)

In formula (IIIA), $R^{10A}$ and $R^{11A}$ may be the same or different and each represents a hydrogen atom, an optionally substituted alkyl group (preferably a lower alkyl group, for example, methyl, ethyl or propyl), an optionally substituted phenyl group or an optionally substituted heterocyclic group (more concretely, containing at least one hetero atoms from a nitrogen atom, an oxygen atom and/or a sulfur atom, for example, a pyridine ring, a thiophene ring, a thiazolidine ring, a benzoxazole ring, a benzotriazole ring, a thiazole ring, or an imidazole ring). $R^{12A}$ represents a hydrogen atom or an optionally substituted lower alkyl group (preferably having from 1 to 5 carbon atoms, for example, methyl or ethyl).

As substituents for $R^{10A}$ to $R^{12A}$, there may be mentioned a hydroxyl group, a carboxyl group, a sulfo group, an amino group and a lower alkyl group.

$R^{13A}$ represents a hydrogen atom, an alkyl group or a carboxyl group.

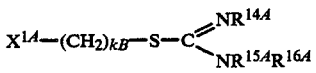

(IVA)

In formula (IVA), $R^{14A}$, $R^{15A}$ and $R^{16A}$ may be the same or different and each represents a hydrogen atom or a lower alkyl group (preferably having from 1 to 3 carbon atoms, for example, methyl or ethyl). kB represents an integer of from 1 to 5.

$X^{1A}$ represents an optionally substituted amino group, a sulfo group, a hydroxyl group, a carboxyl group or a hydrogen atom. As substituents for the amino group, there may be mentioned a substituted or unsubstituted alkyl group (e.g., methyl, ethyl, hydroxyalkyl, alkoxyalkyl, carboxyalkyl), and two alkyl groups may be combined to form a ring.

$R^{14A}$, $R^{15A}$ and $R^{16A}$ may be bonded to each other to form a ring. As $R^{14A}$ to $R^{16A}$, a hydrogen atom, a methyl group or an ethyl group is preferred; and as $X^{1A}$, an amino group or a dialkylamino group is preferred.

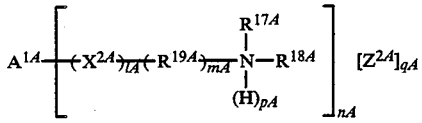

(VA)

In formula (VA), $A^{1A}$ represents an nA-valent aliphatic linking group, an aromatic linking group or a heterocyclic linking group; provided that when nA is 1, $A^{1A}$ represents an aliphatic group, aromatic group, or heterocyclic group.

As the aliphatic linking group for $A^{1A}$, an alkylene group having from 3 to 12 carbon atoms (e.g., trimethylene, hexamethylene, cyclohexylene) may be mentioned.

As the aromatic linking group, an arylene group having from 6 to 18 carbon atoms (e.g., phenylene, naphthylene) may be mentioned.

As the heterocyclic linking group, a heterocyclic group having one or more hetero atoms (e.g., oxygen, sulfur, nitrogen) may be mentioned, which includes, for example. thiophene, furan, triazine, pyridine and piperidine.

Generally, $A^{1A}$ in formula (VA) contains one aliphatic linking group, aromatic linking group or heterocyclic linking group, but two or more of them may be combined, as the case may be. In such a combined system, the linking groups may directly be bonded to each other, or alternatively, they may indirectly be bonded to each other via a divalent linking group (for example, —O—, —S—,

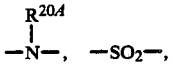

or —CO—, or a composite linking group made of the said linking groups; where $R^{20A}$ represents a lower alkyl group) therebetween.

The aliphatic linking group, aromatic linking group, and heterocyclic linking group may optionally have substituent(s).

As substituents for the groups, there may be mentioned an alkoxy group, a halogen atom, an alkyl group, a hydroxyl group, a carboxyl group, a sulfo group, a sulfonamido group and a sulfamoyl group.

$X^{2A}$ represents —O—, —S— or

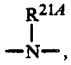

in which $R^{21A}$ represents a lower alkyl group (e.g., methyl, ethyl). $R^{17A}$ and $R^{18A}$ each represents a substituted or unsubstituted lower alkyl group (e.g., methyl, ethyl, propyl, isopropyl, pentyl). As substituents for the group, a hydroxyl group, a lower alkoxy group (e.g., methoxy, methoxyethoxy, hydroxyethoxy) and an amino group (e.g., unsubstituted amino, dimethylamino, N-hydroxyethyl-N-methylamino) are preferred. When the lower alkyl group has two or more substituents, the substituents may be the same or different.

$R^{19A}$ represents a lower alkylene group having from 1 to 5 carbon atoms (e.g., methylene, ethylene, trimethylene, methylmethylene). $Z^{2A}$ represents an anion, such as a halide ion (chloride, bromide), a nitrate ion, a sulfate ion, a p-toluenesulfonate ion, or an oxalate ion.

$R^{17A}$ and $R^{18A}$ may be bonded to each other via carbon atom(s) or hetero atom(s) (e.g., oxygen, nitrogen, sulfur) to form a 5-membered or 6-membered hetero ring (e.g., pyrrolidine, piperidine, morpholine, triazine, imidazolidine).

$R^{17A}$ (or $R^{18A}$) and $A^{1A}$ may be bonded to each other via carbon atom(s) or hetero atom(s) (e.g., oxygen, nitrogen, sulfur) to form a 5-membered or 6-membered hetero ring (e.g., hydroxyquinoline, hydroxylindole, isoindoline).

$R^{17A}$ (or and $R^{19A}$ may also be bonded to each other via carbon atom(s) or hetero atom(s) (e.g., oxygen, nitrogen, sulfur) to form a 5-membered or 6-membered hetero ring (e.g., piperidine, pyrrolidine, morpholine).

lA represents 0 or 1; mA represents 0 or 1; nA represents 1, 2 or 3; pA represents 0 or 1; and qA represents 0, 1, 2 or 3.

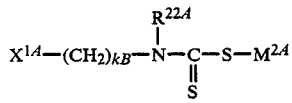

(VIA)

In formula (VIA), $X^{1A}$ and kB have the same meanings as those in formula (IVA), respectively.

$M^{2A}$ represents a hydrogen atom, an alkali metal atom, an ammonium group or

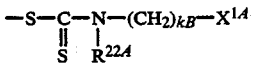
$R^{22A}$ represents a hydrogen atom or a lower alkyl group (which has from 1 to 5 carbon atoms and which may optionally be substituted).
Specific examples of the compounds of formulae (IA) to (VIA) are mentioned below.
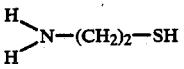
(IA)-(1)
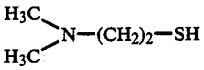
(IA)-(2)
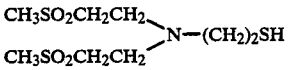
(IA)-(3)
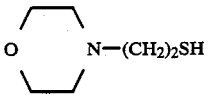
(IA)-(4)
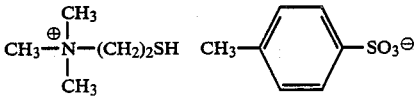
(IA)-(5)
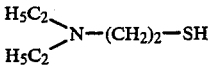
(IA)-(6)
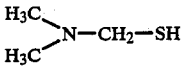
(IA)-(7)
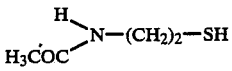
(IA)-(8)
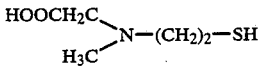
(IA)-(9)
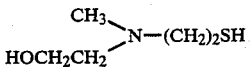
(IA)-(10)
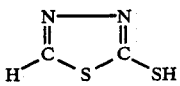
(IA)-(11)
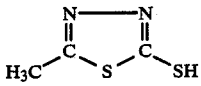
(IA)-(12)
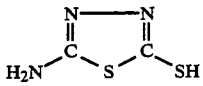
(IA)-(13)
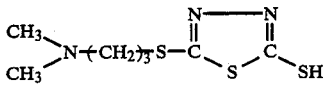
(IA)-(14)
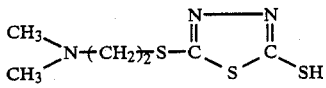
(IA)-(15)
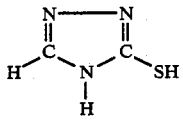
(IA)-(16)

-continued
(IA)-(17)
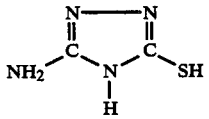
(IA)-(18)
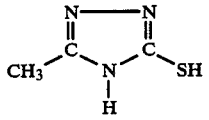
(IA)-(19)
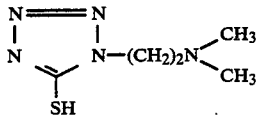
(IA)-(20)
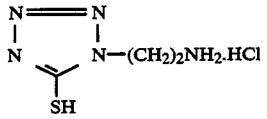
(IIA)-(1)
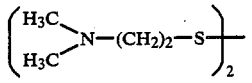
(IIA)-(2)
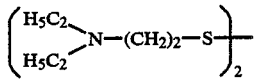
(IIA)-(3)
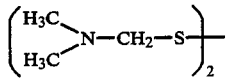
(IIA)-(4)
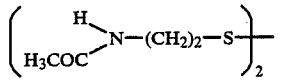
(IIA)-(5)
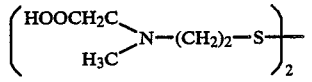
(IIA)-(6)
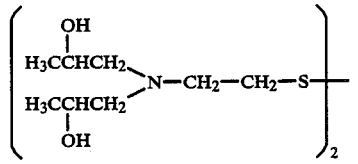
(IIA)-(7)
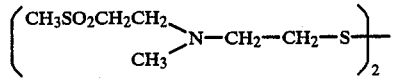
(IIA)-(8)
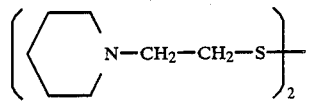
(IIA)-(9)
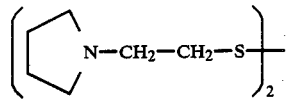

-continued
(IIA)-(10)
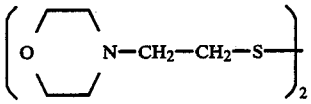
(IIA)-(11)
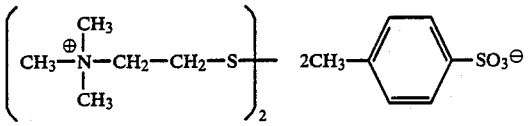
(IIA)-(12)
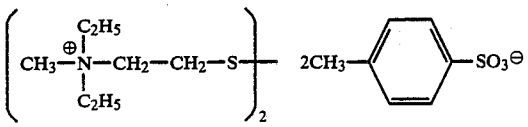
(IIIA)-(1)
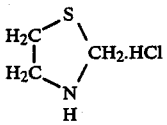
(IIIA)-(2)
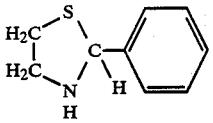
(IIIA)-(3)
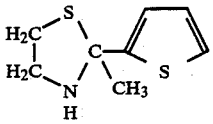
(IIIA)-(4)
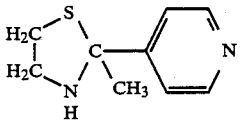
(IIIA)-(5)
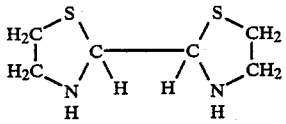
(IIIA)-(6)
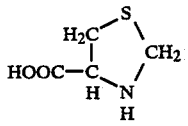
(IVA)-(1)
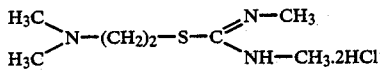
(IVA)-(2)
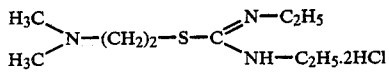
(IVA)-(3)
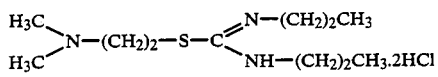
(IVA)-(4)
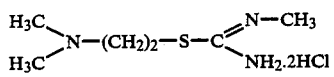

-continued
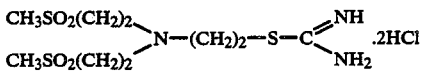
(IVA)-(5)
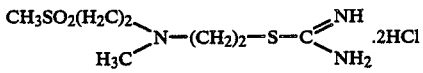
(IVA)-(6)
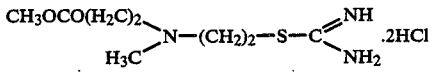
(IVA)-(7)
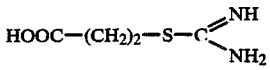
(IVA)-(8)
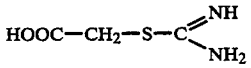
(IVA)-(9)
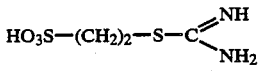
(IVA)-(10)
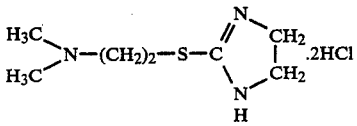
(IVA)-(11)
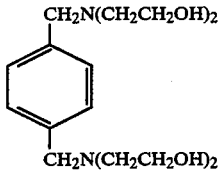
(VA)-(1)
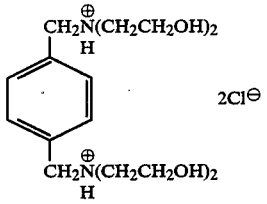
(VA)-(2)
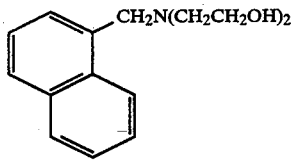
(VA)-(3)
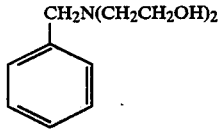
(VA)-(4)
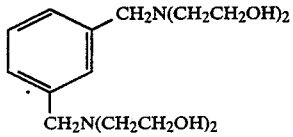
(VA)-(5)
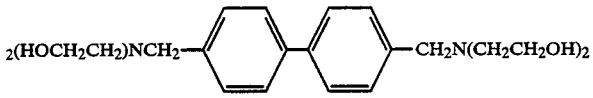
(VA)-(6)

-continued
(VA)-(7)
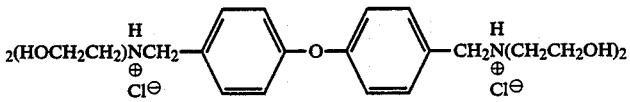
(VA)-(8)
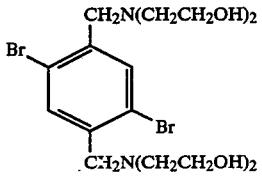
(VA)-(9)
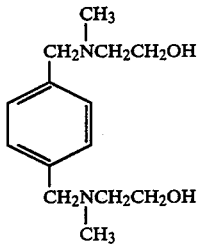
(VA)-(10)
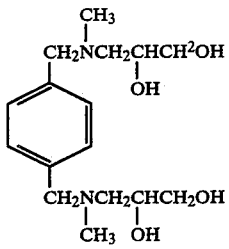
(VA)-(11)
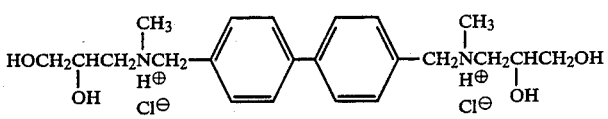
(VA)-(12)
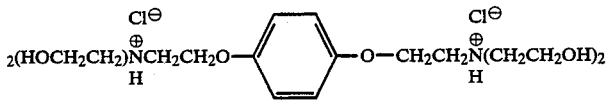
(VA)-(13)
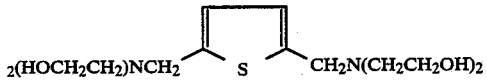
(VA)-(14)
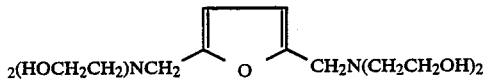
(VA)-(15)
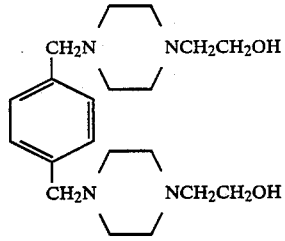

-continued
(VA)-(16)
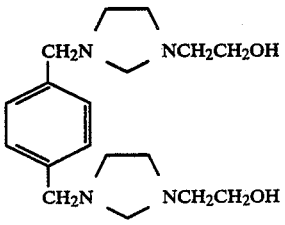
(VA)-(17)
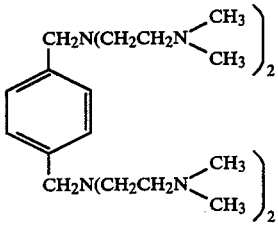
(VA)-(18)
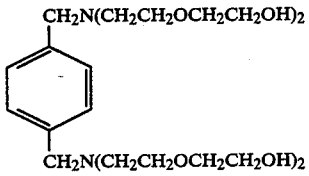
(VA)-(19)
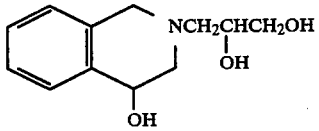
(VA)-(20)
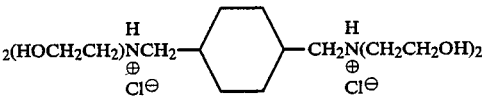
(VA)-(21)
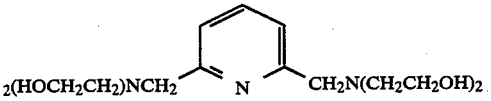
(VA)-(22)
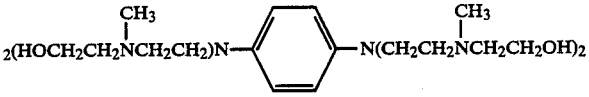
(VA)-(23)
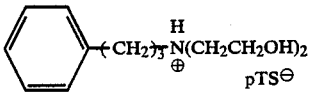
(VA)-(24)
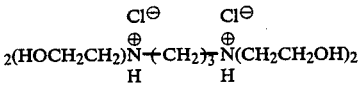
(VA)-(25)
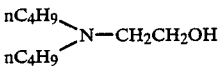
(VA)-(26)
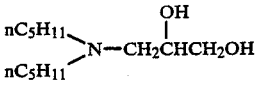

-continued

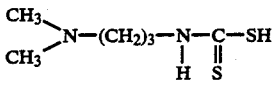

(VIA)-(1)

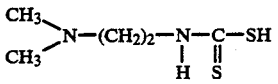

(VIA)-(2)

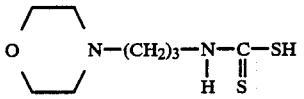

(VIA)-(3)

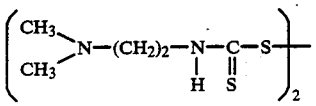

(VIA)-(4)

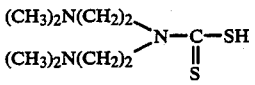

(VIA)-(5)

Of the above-mentioned bleaching accelerators, preferred are compounds (IA)-(2), (IA)-(5), (IA)-(13), (IA)-(14), (IA)-(15), (IA)-(16), (IA)-(19), (IIA)-(1), (IIA)-(11), (VA)-(1), (VIA)-(1) and (VIA)-(2). The amount of the bleaching accelerator added is from 0.01 g to 20 g, preferably from 0.1 g to 10 g, per liter of the solution having a bleaching ability.

The bleaching bath for use in the method of the present invention can contain, in addition to the bleaching agent and the aforesaid compounds, a rehalogenating agent, for example, bromides such as potassium bromide, sodium bromide or ammonium bromide or chlorides such as potassium chloride, sodium chloride or ammonium chloride. The concentration of the rehalogenating agent is from 0.1 mol to 5 mols, preferably from 0.5 mol to 3 mols, per liter of the bleaching solution. Also, the bath can additionally contain known additives which can be used in conventional bleaching solutions, for example, one or more inorganic acids, organic acids or salts thereof having a pH buffering capacity, such as nitrates (sodium nitrate, ammonium nitrate), boric acid, borax, sodium metaborate, acetic acid, sodium acetate, sodium carbonate, potassium carbonate, phosphorus acid, phosphoric acid, sodium phosphate, citric acid, sodium citrate or tartaric acid.

The bath having a bleaching ability, which is used in the method of the present invention, preferably has a pH of from 6 to 2, more preferably 5.0 to 3, and most preferably from 4.5 to 3.5. In the preferred pH range, the bleaching fog is small and the desilvering capacity is excellent.

The amount of the replenisher to be applied to the bath having a bleaching ability in accordance with the present invention is from 50 ml to 2,000 ml, preferably from 100 ml to 1,000 ml, per $m^2$ of the photographic material being processed.

The stirring system as mentioned in JP-A-No. 62-183640 is preferably applied to the bath having a bleaching ability for the purpose of preventing bleaching fog and elevating the desilvering speed.

In accordance with the method of the present invention, the photographic material is processed in the bath having a fixing ability immediately after being processed in the bath having a bleaching ability. The bath having a fixing ability is generally known as a fixing solution or a bleach-fixing solution.

The bath having a fixing ability for use in the method of the present invention contains an organic phosphonic acid.

Any organic phosphonic acid can be used in the method of the present invention, which may be selected, for example, from alkylphosphonic acids, phosphonocarboxylic acids and aminopolyphospnonic acids. In particular, alkylphosphonic acids, in which an alkyl group has from 1 to 10, preferably from 2 to 6 carbon atoms, and aminopolyphosphonic acids such as aminodi-, tri- and tetraphosphonic acids, are preferred. Preferred examples of the organic phosponic acids for use in the present invention are mentioned below by way of general formulae:

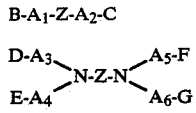

$$B\text{-}A_1\text{-}Z\text{-}A_2\text{-}C \quad \text{(II)}$$

$$\begin{matrix} D\text{-}A_3 \\ E\text{-}A_4 \end{matrix} \!\!> N\text{-}Z\text{-}N < \!\!\begin{matrix} A_5\text{-}F \\ A_6\text{-}G \end{matrix} \quad \text{(III)}$$

In formulae (II) and (III), $A_1$ to $A_6$ each represents a substituted or unsubstituted alkylene group; Z represents an alkylene group, a cyclohexane group, a phenylene group,

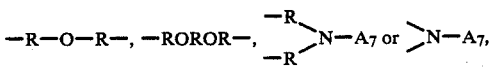

$$-R-O-R-,\ -ROROR-,\ \begin{matrix} -R \\ -R \end{matrix} \!\!> N-A_7 \text{ or } > N-A_7,$$

where R represents an alkylene group; and $A_7$ represents a hydrogen atom, a hydrocarbon group, a lower aliphatic carboxylic acid group or a lower alcohol residue; B, C, D, E, F and G each represents —OH, —COOM, or $-PO(OM)_2$ where M represents a hydrogen atom, an alkali metal atom or an ammonium group, and at least one of B, C, D, E, F and G is $-PO(OM)_2$.

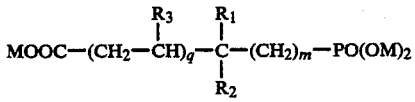

(IV)

wherein $R_1$ represents —COOM or —$PO(OM)_2$; $R_2$ represents a hydrogen atom, an alkyl group having from 1 to 4 carbon atoms, —$(CH_2)_{n'}$—COOM or a phenyl group; $R_3$ represents a hydrogen atom or —COOM; M represents a hydrogen atom, an alkali metal or an ammonium group; m represents 0 or 1; n' represents an integer of from 1 to 4; q represents 0 or 1; provided that when m is 0, $R_1$ is —$PO(OM)_2$.

$$R_4N[CH_2PO(OM)_2]_2 \quad (V)$$

wherein $R_4$ represents a lower alkyl group, an aryl group, an aralkyl group or a nitrogen-containing 6-membered heterocyclic group, which may be substituted by one or more substituents selected from —OH, —$OR_5$, where $R_5$ is an alkyl group having from 1 to 4 carbon atoms, —$PO(OM)_2$, —$CH_2PO(OM)_2$, —$N[CH_2PO(OM)_2]_2$, —COOM and —$N(CH_2COOM)_2$; M represents a hydrogen atom, an alkali metal or an ammonium group.

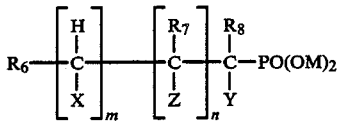

(VI)

wherein $R_6$ and $R_7$ each represents a hydrogen atom, a lower alkyl group, —COOH or —$NJ_2$, where J is —H, —OH, a lower alkyl group or —$C_2H_4OH$; $R_8$ represents a hydrogen atom, a lower alkyl group, —OH or —$NL_2$, where L is —H, —OH, —$CH_3$, —$C_2H_5$, —$C_2H_4OH$ or —$PO(OM)_2$; X, Y and Z each represents —OH, —COOM, —$PO(OM)_2$ or —H; M represents a hydrogen atom, an alkali metal or an ammonium group; n represents 0 or an integer of 1 or more; m represents 0 or 1.

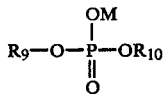

(VII)

wherein $R_9$ and $R_{10}$ each represents a hydrogen atom, an alkali metal, an ammonium group or a substituted or unsubstituted alkyl, alkenyl or cyclic alkyl group having from 1 to 12 carbon atoms, and M represents a hydrogen atom, an alkali metal and an ammonium group.

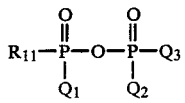

(VIII)

wherein $R_{11}$ represents an alkyl group having from 1 to 12 carbon atoms, an alkoxy group having from 1 to 12 carbon atoms, a monoalkylamino group having from 1 to 12 carbon atoms, a dialkylamino group having from 2 to 12 carbon atoms, an amino group, an aryloxy group having from 1 to 24 carbon atoms, an arylamino group having from 6 to 24 carbon atoms or an amyloxy group; $Q_1$ to $Q_3$ each represents —OH, an alkoxy, aralkyloxy or aryloxy group each having from 1 to 24 carbon atoms, —OM, where M is a hydrogen atom, an alkali metal, or an ammonium ion, an amino group, a morpholino group, a cyclic amino group, an alkylamino group, a dialkylamino group, an arylamino group or an alkyloxy group.

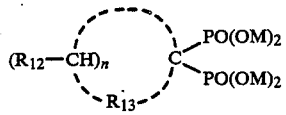

(IX)

wherein $R_{12}$ and $R_{13}$ each represents a hydrogen atom, a lower alkyl group or an imino group, which may optionally be substituted by a lower alkyl group and/or —$CH_2CH_2COONa$; M represents a hydrogen atom, an alkali metal or an ammonium group; n represents an integer of from 2 to 16.

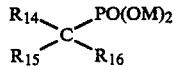

(X)

wherein $R_{14}$ to $R_{16}$ each is a hydrogen atom or an alkyl group, which may have substituent(s) selected from —OH, —$OC_{n''}H_{2n''+1}$, where n'' is 1 to 4, —$PO(OM)_2$ —$CH_2PO(OM)_2$, —$N(R)_2$, where R is an alkyl group, and —$N[CH_2PO(OM)_2]_2$; M represents a hydrogen atom, an alkali metal or an ammonium group.

Among the compounds, those represented by formulae (III) and (VI) are preferred.

Specific examples of compounds of the aforesaid formulae (II) to (X) are mentioned below, which, however, are not intended to restrict the scope of the present invention.

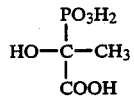

(1)

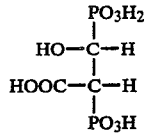

(2)

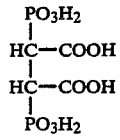

(3)

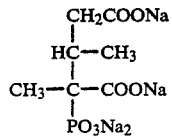

(4)

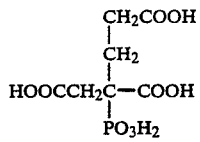

(5)

-continued
(6)
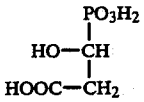
(7)
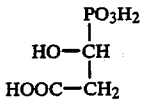
(8)
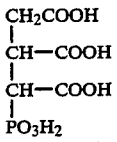
(9)
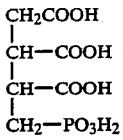
(10)
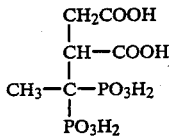
(11)
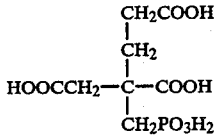
(12)
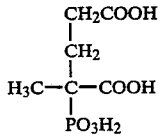
(13)
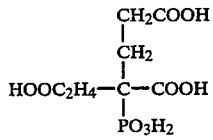
(14)
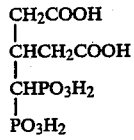
(15)
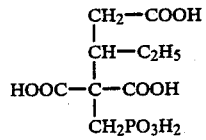
(16)
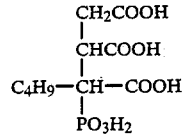
(17)
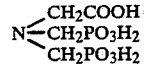
-continued
(18)
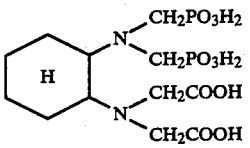
(19)
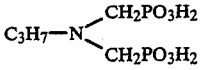
(20)
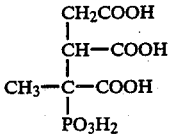
(21)
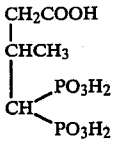
(22)
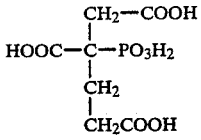
(23)
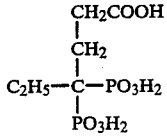
(24)
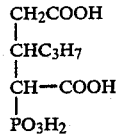
(25)
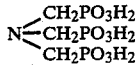
(26)
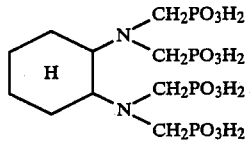
(27)
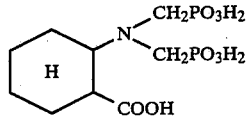
(28)
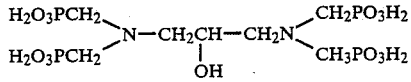
(29)
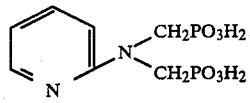

-continued
(30)
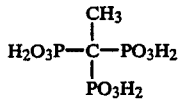
(31)
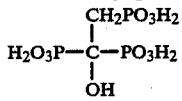
(32)
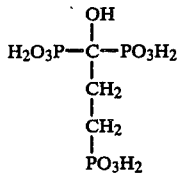
(33)
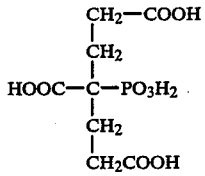
(34)
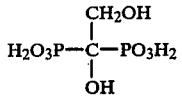
(35)
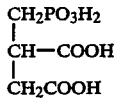
(36)
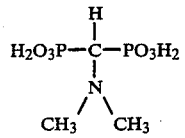
(37)
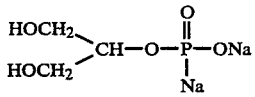
(38)
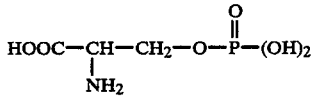
(39)
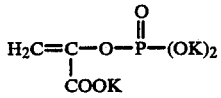
(40)
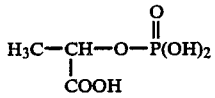
(41)
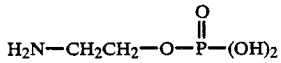
(42)
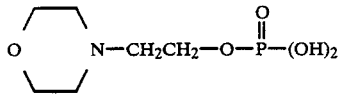
(43)
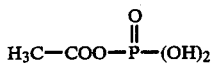
-continued
(44)
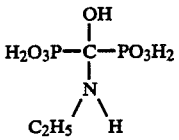
(45)
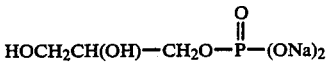
(46)
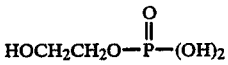
(47)
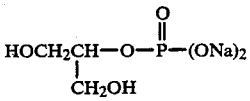
(48)
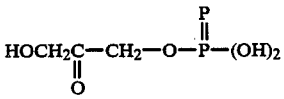
(49)
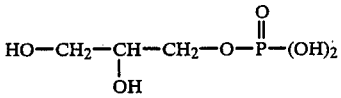
(50)
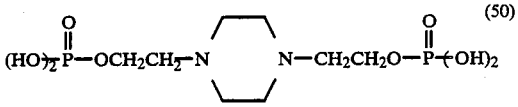
(51)
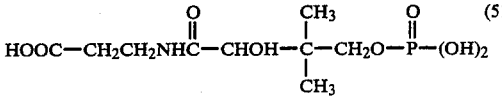
(52)
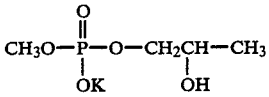
(53)
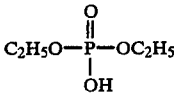
(54)
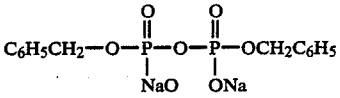
(55)
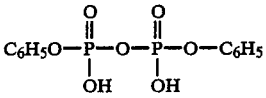
(56)
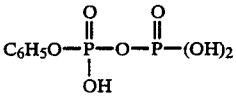
(57)
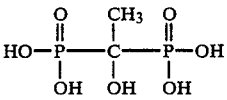
(58)
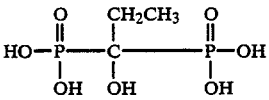

-continued (59)

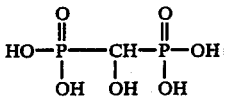

(60)

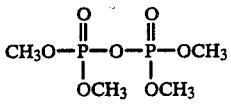

(61)

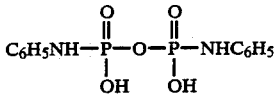

(62)

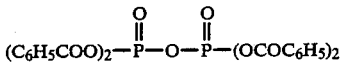

(63)

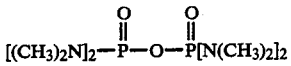

(64)

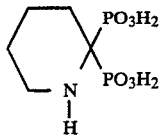

(65)

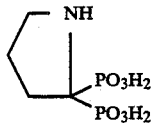

(66)

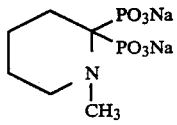

(67)

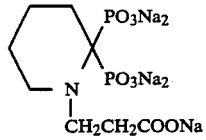

(68)

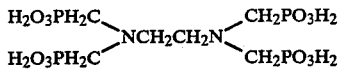

The amount of the organic phosphonic acid type chelating agent to be added is preferably from 0.005 to 0.5 mol, more preferably from 0.05 to 0.10 mol, per liter of the solution having a fixing ability.

These compounds are available from commercial products.

It may be presumed that when the organic phosphonic acid chelating agent is present in the bath having a fixing ability, this would act to remove iron(III) ion from the (aminopolycarboxylato)iron(III) complex carried over from the previous bath as a bleaching agent, to thereby form an organic (phosphonato)iron(III) complex by itself, whereby the oxidizing power of the remaining iron(III) ion would noticeably be lowered, so that the oxidative decomposition of sulfite ions and thiosulfate ions could be prevented.

Accordingly, as the most preferred embodiment of the present invention, the organic phosphonic acid is directly added to the bath having a fixing ability. If the organic phosphonic acid is added to the previous bath having bleaching ability and is carried over into the bath having fixing ability therefrom, the oxidizing power of the bleaching solution would noticeably be lowered, which is not preferred.

The bath having fixing ability, which is used in the method of the present invention, generally contains a thiosulfate as a fixing agent. For instance, there may be mentioned sodium thiosulfate, ammonium thiosulfate and potassium thiosulfate, and the use of ammonium thiosulfate is most preferred because of its excellent fixing ability. Preferably, the amount of the fixing agent added is from 50 g to 500 g, more preferably from 100 g to 300 g, per liter of the fixing bath.

In addition, thiocyanates, thioureas or thioethers may also be added to the fixing bath, if desired.

The solution having fixing ability may also contain, as a preservative, sulfites such as sodium sulfite, potassium sulfite or ammonium sulfite, as well as sulfinic acids, hydroxylamine, hydrazine or aldehyde compound-bisulfite adducts such as acetaldehyde-sodium bisulfite adduct, if desired. A total amount of sulfite ion and bisulfite ion is preferably from 0.01 to 0.4 mol, more preferably from 0.05 to 0.3 mol, and most preferably from 0.5 to 0.25 mol, per liter of the bath having fixing ability. Moreover, it may further contain various kinds of brightening atents, defoaming agents or surfactants as well as organic solvents such as polyvinyl pyrrolidone or methanol.

When the bath having fixing ability is a bleach-fixing solution, the above mentioned various kinds of (aminopolycarboxylato)iron(III) complexes are preferably used as the bleaching agent for the solution. Most preferably, there are mentioned the following complexes.

(1,3-Propylenediaminetetraacetato)iron(III) complex
(Ethylenediaminetetraacetato)iron(III) complex
(Cyclohexanediaminetetraacetato)iron(III) complex
(Diethylenetriaminepentaacetato)iron(III) complex The amount of the bleaching agent added to such bath is preferably from 0.1 to 0.5 mol/liter. The bleaching agent in the bleach-fixing solution may result from the introduction of the overflow from the previous bath having a bleaching ability.

The bath having a fixing ability for use in the present invention preferably has a pH of from 4.0 to 9.0, more preferably from 5.0 to 8.0. The amount of the replenisher to the bath is from 300 ml to 3,000 ml, preferably from 300 ml to 1,000 ml, per $m^2$ of the photographic material being processed.

The total processing time in the bath having a bleaching ability and the bath having fixing ability, in accordance with the method of the present invention is from 1 minute to 4 minutes, preferably from 1 minute and 20 seconds to 3 minutes. Preferably, the processing time is from 20 to 40 seconds for the bath having beaching ability, and from 50 seconds to 1 minute and 20 seconds for the bath having fixing ability. The processing temperature in the baths is from 25° C. to 50° C., preferably from 35° C. to 40° C.

In accordance with the method of the present invention, when the bleaching, bleach-fixing or fixing step is directly followed by a rinsing step or stabilizing step, a part or all of the overflow from the latter (rinsing or stabilizing) step is preferred to be introduced into the processing solution for the bleaching, bleach-fixing or fixing step.

The color developer for use in the present invention contains a known aromatic primary amine color developing agent. Preferred examples of the developing agent are p-phenylenediamine derivatives. Specific examples thereof are mentioned below, which, however, are not limitative.

(D- 1): N,N-Diethyl-p-phenylenediamine
(D- 2): 2-Amino-5-diethylaminotoluene
(D- 3): 2-Amino-5-(N-ethyl-N-laurylamino)toluene
(D- 4): 4-[N-Ethyl-N-(β-hydroxyethyl)amino]aniline
(D- 5): 2-Methyl-4-[N-ethyl-N-(β-hydroxyethyl-)amino]aniline
(D- 6): 4-Amino-3-methyl-N-ethyl-N-[β-(methanesulfonamido)ethyl]aniline
(D- 7): N-(2-Amino-5-diethylaminophenylethyl)methanesulfonamide
(D- 8): N,N-Dimethyl-p-phenylenediamine
(D- 9): 4-Amino-3-methyl-N-ethyl-N-methoxyethylaniline
(D-10): 4-Amino-3-methyl-N-ethyl-N-β-ethoxyethylaniline
(D-11): 4-Amino-3-methyl-N-ethyl-N-β-butoxyethylaniline Of these p-phenylenediamine derivatives, especially preferred is (D-5).

The p-phenylenediamine derivatives may also be in the form of salts such as sulfates, hydrochlorides, sulfites or p-toluenesulfonates. The amount of the aromatic primary amine developing agent to be contained in the color developer is preferably from about 0.1 g to about 20 g, more preferably from about 0.5 g to about 10 g or so, per liter of the developer.

The color developer for use in the present invention can further contain, if desired, sulfites, such as sodium sulfite, potassium sulfite, sodium bisulfite, potassium bisulfite, sodium metasulfite or potassium metasulfite, as well as carbonyl-sulfite adducts, as a preservative. However, it is preferred that color developer does not substantially contain sulfite ion for the purpose of having an improved coloring capacity. The wording "does not substantially contain" as referred to herein means that the content of the sulfite ion in the color developer is 0.5 g/liter or less, preferably 0.2 g/liter or less, as of sodium sulfite. More preferably, the color developer contains no sulfite ion.

As compounds of directly preserving the aforesaid color developing agent, various hydroxylamines, hydroxamic acids described in JP-A-No. 63-43138, hydrazines or hydrazides described in JP-A-No. 63-146041, phenols described in JP-A-Nos. 63-44657 and 63-58443, α-hydroxyketones or α-aminoketones described in JP-A-No. 63-44656 and/or various saccharides described in JP-A-No. 63-36244 are preferably added to the color developer. It is also preferred to add monoamines described in JP-A-Nos. 63-4235, 63-24254, 63-21647, 63-146040, 63-27841, and 63-25654, diamines described in JP-A-Nos. 63-30845, 63-146040 and 63-43139, polyamines described in JP-A-Nos. 63-21647 and 63-26655, polyamines described in JP-A-No. 63-44655, nitroxy radicals described in JP-A-No. 63-53551, alcohols described in JP-A-Nos. 63-43140 and 63-53549, oximes described in JP-A-No. 63-56654, and tertiary amines described in European Pat. No. 248450A, together with the aforesaid compounds, if desired.

As other preservatives, various metals described in JP-A-Nos. 57-44148 and 57-53749, salicylic acids described in JP-A-No. 59-180588, alkanolamines described in JP-A-No. 54-3532, polyethyleneimines described in JP-A-No. 56-94349 and aromatic polyhydroxy compounds described in U.S. Pat. No. 3,746,544 may also be added to the color developer, if desired. In particularly, addition of aromatic polyhydroxy compounds is preferred.

The color developer for use in the present invention preferably has a pH value of from 9 to 12, more preferably from 9 to 11.0, and it may additionally contain any other compounds which are known as components for conventional color developers.

In order to maintain the pH value, the color developer preferably contains various kinds of buffers.

The buffers which are usable include, for example, sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, these compounds are not limitative.

The amount of the buffer added to the color developer is preferably 0.1 mol/liter or more, especially preferably from 0.1 mol/liter to 0.4 mol/liter.

In addition, the color developer for use in the present invention may further contain various kinds of chelating agents as an agent for inhibiting precipitation of calcium or magnesium or for the purpose of improving the stability of the color developer.

As the chelating agent for the purpose, organic acid compounds are preferred and, for example, aminopolycarboxylic acids, organic phosphonic acids and phosphonocarboxylic acids are mentioned. Specific examples of organic acid compounds for use as a chelating agent are mentioned below, which, however, are not limitative.

Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. These chelating agents may be used in combination of two or more kinds of them, if desired.

The amount of the chelating agent added to the color developer should be such that would be sufficient for sequestering the metal ions in the color developer. For example, it may be from 0.1 g to 10 g or so per liter of color developer.

The color developer may optionally contain any desired development accelerator(s). However, it is preferred that the color developer for use in the method of the present invention does not substantially contain benyzl alcohol in view of the prevention of environmental pollution, ease of preparation of the developer solution and the prevention of fog. The wording "does not substantially contain benzyl alcohol" as referred to herein means that the content of benzyl alcohol in the developer is 2 ml/liter or less, or preferably the developer contains no benzyl alcohol.

As examples of the development accelerators which may optionally be used in the present invention, there may be mentioned thioether compounds described in JP-B-Nos. 37-16088, 37-5987, 38-7826, 44-12380 and 45-9019 and U.S. Pat. No. 3,813,247, p-phenylenediamine compounds described in JP-A-Nos. 52-49829 and 50-15554, quaternary ammonium salts described in JP-A-No. 50-137726, JP-B-No. 44-30074 and JP-A-Nos. 56-156826 and 52-43429, amine compounds described in U.S. Pat. Nos. 2,494,903, 3,128,182, 4,230,796 and 3,253,919, JP-B-No. 41-11431 and U.S. Pat. Nos. 2,482,546, 2,596,926 and 3,582,346, polyalkylene oxides described in JP-B-Nos. 37-6088 and 42-25201, U.S. Pat. No. 3,128,183, JP-B-Nos. 41-11431 and 42-23883 and U.S. Pat. No. 3,532,501, as well as other 1-phenyl-3-pyrazolidones and imidazoles.

In accordance with the present invention, any optional antifoggant can be added to the color developer, if desired. As the antifoggant can be used alkali metal halides such as sodium chloride, potassium chloride or potassium iodide, as well as organic anti-foggants. As specific examples of organic antifoggant which may be used in the present invention, there may be mentioned nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer for use in the present invention may contain a brightening agent. As the brightening agents there are preferred 4,4,-diamino-2,2'-disulfostilbene compounds. The amount of the brightening agent to be added is up to 5 g/liter, preferably from 0.1 g/liter to 4 g/liter.

In addition, various kinds of surfactants can also be added to the color developer, if desired, including alkylsulfonic acids, arylphosphonic acids, aliphatic carboxylic acids and aromatic carboxylic acids.

The processing temperature of the color developer of the present invention is from 20° to 50° C., preferably from 30° to 45° C. The processing time is from 20 seconds to 5 minutes, preferably from 30 seconds to 3 minutes. The amount of the replenisher is preferably small and is, for example, from 100 to 1,500 ml, preferably from 100 to 800 ml, more preferably from 100 to 400 ml, per $m^2$ of the color photographic material being processed.

The color developer bath system for use in the method of the present invention may comprise two or more baths, in which a color developer replenisher may be introduced into the first bath or into the last bath so as to shorten the development time or to reduce the amount of the replenisher.

The method of the present invention may also be applied to color reversal processing. As the black-and-white developer to be used for such reversal processing, a black-and-white first developer which is generally used in conventional reversal processing of color photographic materials, or a black-and-white developer which is generally used for development of black-and-white (monochromatic) materials may be mentioned. Various kinds of additives which are well known to be added to conventional black-and-white developers may also be added to the black-and-white developer to be used in the said color reversal processing.

As typical additives for the black-and-white developer, there may be mentioned, for example, a developing agent such as 1-phenyl-3-pyrazolidone, Metol or hydroquinone, a preservative such as a sulfite, an alkali accelerator such as sodium hydroxide, sodium carbonate or potassium carbonate, an inorganic or organic inhibitor such as potassium bromide, 2-methylbenzimidazole or methylbenzothiazole, a water softener such as polyphosphoric acid salts, as well as a development inhibitor comprising a slight amount of iodides or mercapto compounds.

The method of the present invention comprises the aforesaid processing steps of color development, bleaching and fixing (or bleach-fixing). In accordance with the method of the present invention, additional processing steps such as a rinsing step and/or a stabilization step are generally carried out after the fixing step or the bleach-fixing step. However, a simplified method may also be employed in the present invention, where the photographic material is, after being fixed or bleach-fixed, directly stabilized substantially without being rinsed in water.

The rinsing water to be used in the rinsing step may optionally contain known additives. For instance, it may contain a water softener such as inorganic phosphoric acids, aminopolycarboxylic acids or organic phosphoric acids, a bactericide or fungicide for the purpose of preventing propagation of various bacteria or algae (for example, isothiazolone, organic chlorine-containing bactericides, benzotriazole), as well as a surfactant for the purpose of preventing an undue drying load or drying mark. In addition, the compounds described in L. E. West, *Photo. Sci. and Eng.*, "Water Quality Criteria", Vol. 9, No. 6, pages 344 to 359 (1965) can also be added to the rinsing water.

As the stabilizing solution for the stabilization step, a processing solution capable of stabilizing color images formed is used. For instance, a solution having a buffering capacity to provide a pH of from 3 to 6, as well as a solution containing an aldehyde compound (e.g., formalin) may be used. The stabilizing solution may contain, if desired, ammonium compounds, metal compounds such as Bi or Al compounds, brightening agents, chelating agents (e.g., 1-hydroxyethylidene-1,1-diphosphonic acid), bactericides, fungicides, film hardening agents and surfactants.

The rinsing step or the stabilization step is preferably conducted by a multistage countercurrent system for the purpose of improving the image storability of the material processed. The number of the stages in the step is preferably from 2 to 4. The amount of the replenisher to the step is from 1 to 50 times, preferably from 2 to 30 times, more preferably from 2 to 15 times, the amount of the carryover solution from the previous bath per the unit area of the material being processed.

As water for the rinsing step or stabilization step, it is preferred to use city water, water deionized by treatment with an ion exchange resin to lower the Ca concentration and Mg concentration therein to 5 mg/liter or less, or water sterilized by treatment with a halogen or ultraviolet ray-sterilizing lamp.

The overflown solution from the rinsing step and/or the stabilization step is preferably returned back to the previous fixing bath or bleach-fixing bath, if desired, for the purpose of reducing the amount of the drainage from the process.

When the processing method of the present invention is carried out by way of a continuous processing procedure using an automatic development apparatus, the processing solution will often be concentrated during the procedure because of evaporation. Such evaporation and concentration is especially noticeable when the amount of the photographic material processed is small and the area of the processing solution exposed to the air is large. In order to compensate for such concentration of the processing solution, an appropriate amount of water or a compensating solution is preferably replenished to the processing solution.

The method of the present invention may be applied to various color photographic materials. Typically, it may be applied to color negative films for general use or for movies, color reversal films for slides or televisions, color papers, color positive films, color reversal papers and direct positive color photographic materials.

In particular, the method of the present invention can especially preferably be applied to silver-rich color negative films or color reversal films. For instance, the effect of the present invention is especially remarkable when the invention is applied to photographic materials having silver in an amount of from 3 g to 15 g, preferably from 4 g to 10 g, per $m^2$ of the material.

The silver halide contained in the photographic emulsion layer of the photographic material to be processed by the method of the present invention is preferably silver iodobromide, silver iodochloride or silver iodochlorobromide containing silver iodide in an amount of about 30 mol % or less. Especially preferably, it is silver iodobromide containing silver iodide in an amount of from about 1 mol % to about 25 mol %.

The silver halide grains in the photographic emulsion may have a regular crystal form such as cubic, octahedral or tetradecahedral crystal form, or an irregular crystal form such as a spherical or tabular crystal form, or a crystal form with crystal defects such as a twin plane, or a composite form of these crystal forms.

Regarding the grain size of the silver halide grains, the grains may be fine, having a grain size of about 0.2 μm or less, or they may be large sized, having a grain size of up to about 10 μm as the project area diameter. The grains may be polydispersed or monodispersed.

The silver halide photographic emulsions for use in the present invention can be prepared, for example, by the methods described in *Research Disclosure,* Item No. 17643 (December, 1978), pages 22 to 23, "I. Emulsion Preparation and Types", ibid., Item No. 18716 (November, 1979), page 648, P. Glafkides, *Chimie et Physique Photographique* (published by Paul Montel, 1967), G. F. Duffin, *Photographic Emulsion Chemistry* (published by Focal Press, 1966), or V. L. Zelikman et al., *Making and Coating Photographic Emulsion* (published by Focal Press, 1964).

Monodispersed emulsions described in U.S. Pat. Nos. 3,574,628 and 3,655,394 and British Pat. No. 1,413,748 are also preferred for use in the present invention.

Tabular grains having an aspect ratio of about 5 or more may also be used in the present invention. Such tabular grains may easily be prepared by the methods described in Gutoff, *Photographic Science and Engineering,* Vol. 14, pages 248 to 257 (1970), U.S. Pat. Nos. 4,434,226, 4,414,310, 4,433,048 and 4,439,520 and British Pat. No. 2,112,157.

The silver halide grains for use in the present invention may differ in halogen composition or crystal phase structure between the inside and the surface layer thereof, or may have a multiphase structure. As other crystal structures of the silver halide grains for the present invention, silver halides of different compositions may be combined by an epitaxial junction(s), or silver halides may be combined with compounds other than silver halides, such as silver rhodanide or lead oxide. A mixture of grains of various crystal forms may also be used in the invention.

The silver halide emulsions for use in the invention are generally physically ripened, chemically ripened and spectrally sensitized. Additives used for such ripening or sensitizing step are described in *Research Disclosure,* Item Nos. 17643 and 18716, and the relevant parts are mentioned in the following Table.

Other known photographic additives which can be used in the present invention are also described in said two *Research Disclosures,* and the relevant parts are also mentioned in the same Table.

| Additives | RD 17643 | RD 18716 |
|---|---|---|
| 1. Chemical Sensitizer | Page 23 | Page 648, right column |
| 2. Sensitivity Enhancer | — | " |
| 3. Spectral Sensitizer, Supersensitizer | Pages 23–24 | Page 648, right column to page 649, right column |
| 4. Brightening Agent | Page 24 | — |
| 5. Antifoggant, Stabilizer | Pages 24–25 | Page 649, right column |
| 6. Light Absorber, Filter Dye, Ultraviolet Absorber | Pages 25–26 | Page 649, right column to page 650, left column |
| 7. Stain Inhibitor | Page 25, right column | Page 650, left to right columns |
| 8. Color Image Stabilizer | Page 25 | — |
| 9. Hardening Agent | Page 26 | Page 651, left column |
| 10. Binder | Page 26 | " |
| 11. Plasticizer, Lubricant | Page 27 | Page 650, right column |
| 12. Coating Aid, Surfactant | Pages 26–27 | " |
| 13. Antistatic Agent | Page 27 | " |

Various color couplers can be used in the present invention, and specific examples of usable couplers are described in the patent publications as referred to in the aforesaid *Research Disclosure,* Item No. 17643, VII-C to G.

As yellow couplers, for example, the compounds described in U.S. Pat. Nos. 3,933,501, 4,022,620, 4,326,024 and 4,401,752, JP-B No. 58-10739 and British Pat. Nos. 1,425,020 and 1,476,760 are preferred.

As magenta couplers, 5-pyrazolone and pyrazoloazole compounds are preferred. Especially, the compounds described in U.S. Pat. Nos. 4,310,619 and 4,351,897, European Pat. No. 73636, U.S. Pat. Nos. 3,061,432 and 3,725,067, *Research Disclosure,* Item No. 24220 (June, 1984), JP-A-No. 60-33552, *Research Disclosure,* Item No. 24230 (June, 1984), JP-A-No. 60-43659 and U.S. Pat. Nos. 4,500,630 and 4,540,654 are preferred.

Specifically, the silver halide color photographic materials to be processed by the method of the present invention are preferred to contain magenta couplers as represented by the following general formula (M-1) for the purpose of preventing formation of stains in the processed and stored photographic materials and for the purpose of preventing bleaching fog during processing of the materials.

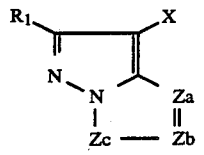

(M-1)

wherein $R_1$ represents a hydrogen atom or a substituent; X represents a hydrogen atom or a group capable of being released by coupling reaction with the oxidation product of an aromatic primary amine developing agent; Za, Zb and Zc each represents a substituted methine group, =N— or —NH—, and one of Za-Zb bond and Zb-Zc bond is a double bond and the other is a single bond; when Zb-Zc bond is a carbon-carbon double bond, this may be a part of an aromatic ring; $R_1$ or X may form a dimer or a higher polymer; and when Za, Zb or Zc represents a substituted methine group, the substituted methine group may form a dimer or a higher polymer.

Of the pyrazoloazole magenta couplers of formula (M-1), preferred are compounds of the following formulae (M-2), (M-3), (M-4), (M-5) and (M-6).

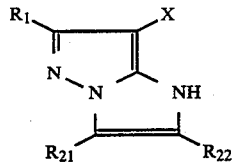

(M-2)

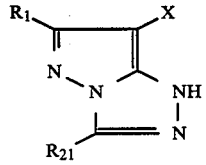

(M-3)

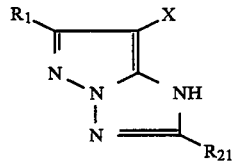

(M-4)

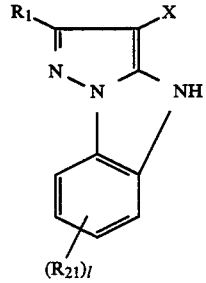

(M-5)

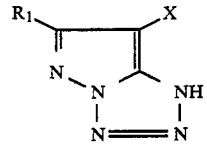

(M-6)

In formulae (M-2) to (M-6), $R_1$ and X have the same meanings as defined in formula (M-1); $R_{21}$ and $R_{22}$ have the same meaning as R1 defined in formula (M-1); and l represents an integer of from 1 to 4.

The pyrazoloazole magenta couplers which correspond to formulae (M-2) to (M-6) will be explained in detail hereunder.

$R_1$, $R_{21}$ and $R_{22}$ each may be a hydrogen atom, a halogen atom (e.g., fluorine, chlorine), an alkyl group (e.g., methyl, ethyl, isopropyl, 1-butyl, t-butyl, 1-octyl), an aryl group (e.g., phenyl, p-tolyl, 4-nitrophenyl, 4-ethoxyphenyl, 2-(2-octyloxy-5-t-octylbenzenesulfonamido)phenyl, 3-dodecanesulfonamidophenyl, 1-naphthyl), a heterocyclic group (e.g., 4-pyridyl, 2-furyl), a hydroxyl group, an alkoxy group (e.g., methoxy, ethoxy, 1-butoxy, 2-phenoxyethoxy, 2-(2,4-di-t-amylphenoxy)ethoxy), an aryloxy group (e.g., phenoxy, 2-methoxyphenoxy, 4-methoxyphenoxy, 4-nitrophenoxy, 3-butanesulfonamidophenoxy, 2,5-di-t-amylphenoxy, 2-naphthoxy), a heterocyclic oxy group (e.g., 2-furyloxy), an acyloxy group (e.g., acetoxy, pivaloyloxy, benzoyloxy, dodecanoyloxy), an alkoxycarbonyloxy group (e.g., ethoxycarbonyloxy, t-butoxycarbonyloxy, 2-ethyl-1-hexyloxycarbonyloxy), an aryloxycarbonyloxy group (e.g., phenoxycarbonyloxy), a carbamoyloxy group (e.g., N,N-dimethylcarbamoyloxy, N-butylcarbamoyloxy), a sulfamoyloxy group (e.g., N,N-diethylsulfamoyloxy, N-propylsulfamoyloxy), a sulfonyloxy group (e.g., methanesulfonyloxy, benzenesulfonyloxy), a carboxyl group, an acyl group (e.g., acetyl, pivaloyl, benzoyl), an alkoxycarbonyl group (e.g., ethoxycarbonyl), an aryloxycarbonyl group (e.g., phenoxycarbonyl), a carbamoyl group (e.g., N,N-dibutylcarbamoyl, N-ethyl-N-octylcarbamoyl, N-propylcarbamoyl), an amino group (e.g., amino, N-methylamino, N,N-dioctylamino), an anilino group (e.g., N-methylanilino), a heterocyclicamino group (e.g., 4-pyridylamino), an amido group (e.g., acetamido, benzamido), a urethane group (e.g., N-hexylurethane, N,N-dibutylurethane), a ureido group (e.g., N,N-dimethylureido, N-phenylureido), a sulfonamido group (e.g., butanesulfonamido, p-toluenesulfonamido), an alkylthio group (e.g., ethylthio, octylthio), an arylthio group (e.g., phenylthio, 4-dodecylthio), a heterocyclic thio group (e.g., 2-benzothiazolylthio, 5-tetrazolylthio), a sulfinyl group (e.g., benzenesulfinyl), a sulfonyl group (e.g., methanesulfonyl, octanesulfonyl, p-toluenesulfonyl), a sulfo group, a cyano group or a nitro group.

X may be a hydrogen atom, a halogen atom (e.g., fluorine, chlorine, bromine), a carboxyl group, a group linking at the oxygen atom (e.g., acetoxy, benzoyloxy, phenoxy, 4-cyanophenoxy, tolyloxy, 4-methanesulfonylphenoxy, 4-ethoxycarbonylphenoxy, 2-naphthoxy, ethoxy, 2-cyanoethoxy, 2-benzothiazolyloxy), a group linking at the nitrogen atom (e.g., benzenesulfonamido, heptafluorobutanamido, pentafluorobenzamido, octanesulfonamido, p-cyanophenylureido, 1-piperidinyl, 5,5-dimethyl-2,4-dioxo-3-oxazolidinyl, 1-benzyl-5-ethoxy-3-hydantoinyl, 1-imidazolyl, 1-pyrazolyl, 3-chloro-1-pyrazolyl, 3,5-dimethyl-1,2,4-triazol-1-yl, 5- or 6-bromobenzotriazol-1-yl), or a group linking at the sulfur atom (e.g., phenylthio, 2-butoxy-5-t-octylphenylthio, 4-methanesulfonylphenylthio, 4-dodecyloxyphenylthio, 2-cyanoethylthio, 1-ethoxycarbonyltridecylthio, 2-benzothiazolylthio, 1-phenyl-1,2,3,4-tetrazol-5-thio).

Of the pyrazoloazole magenta couplers of formulae (M-2) to (M-6), especially preferred are those of formulae (M-3) and (M-4).

Specific examples of the pyrazoloazole magenta couplers of formulae (M-2) to (M-6), which are preferably used in the present invention, are mentioned below. However, these are not intended to restrict the scope of the present invention.
PM-1
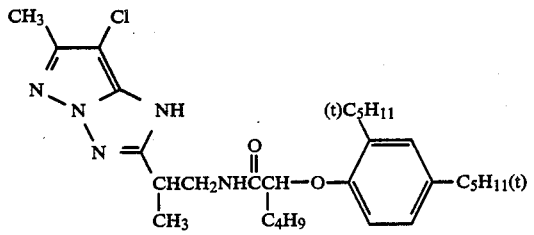
PM-2
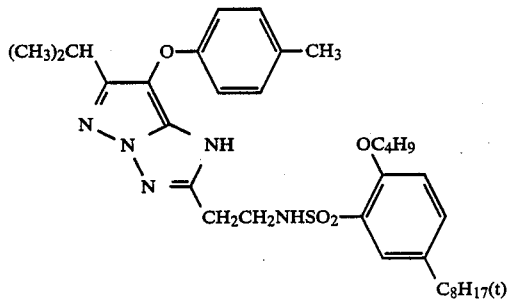
PM-3
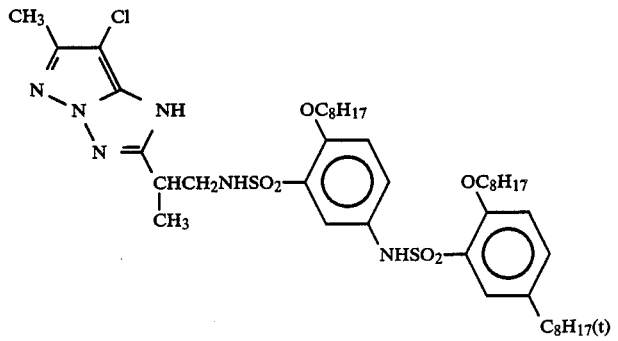
PM-4
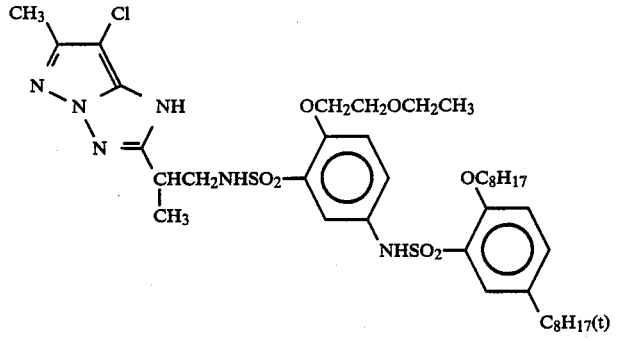
PM-5
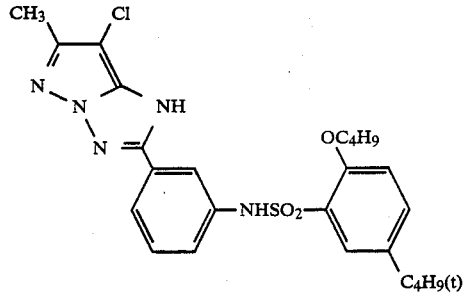

-continued
PM-6
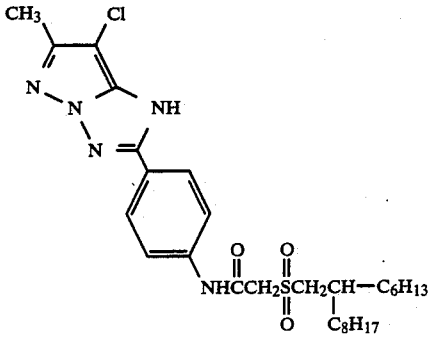
PM-7
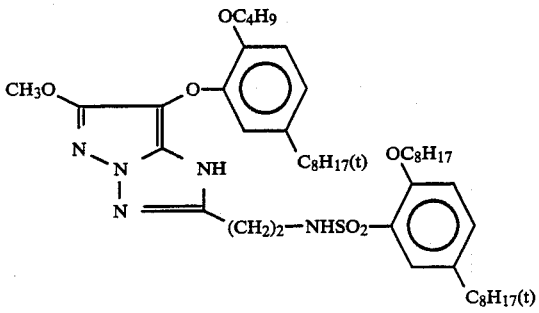
PM-8
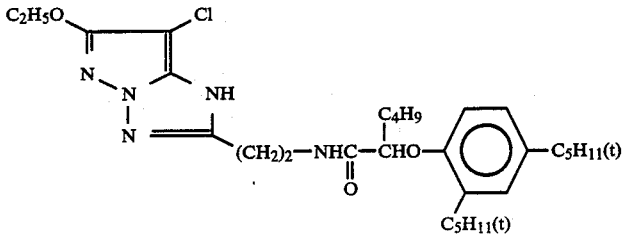
PM-9
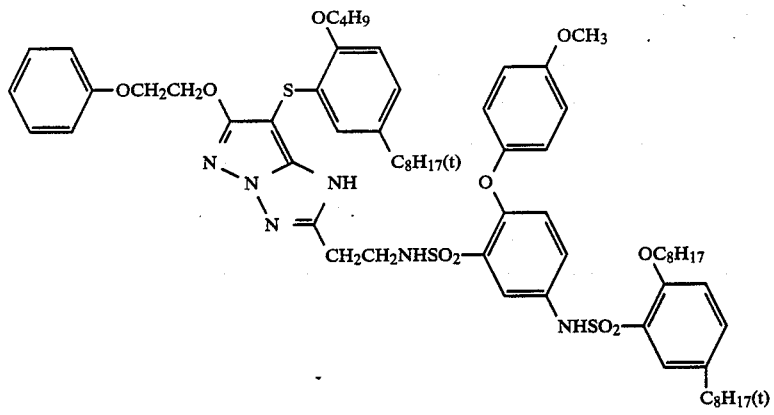
PM-10
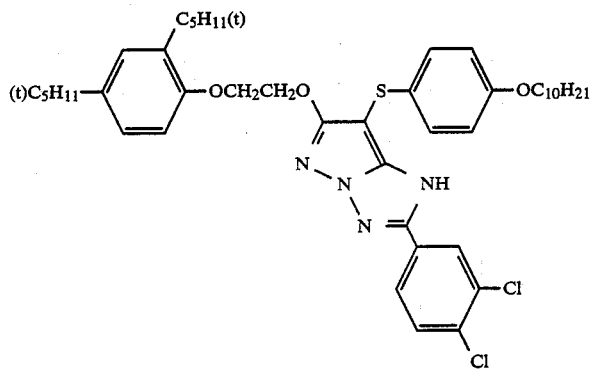

-continued
PM-11
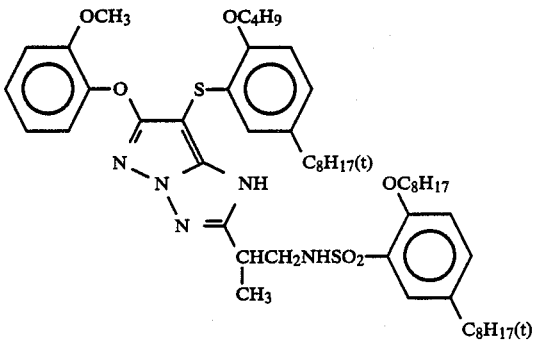
PM-12
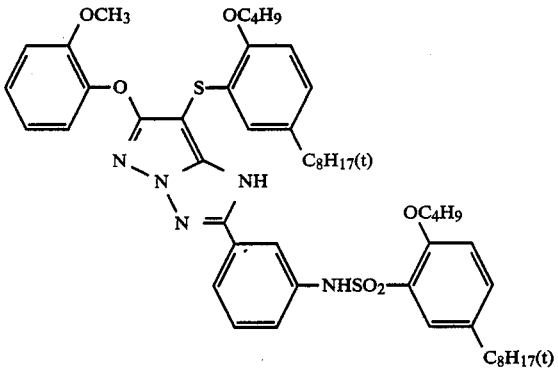
PM-13
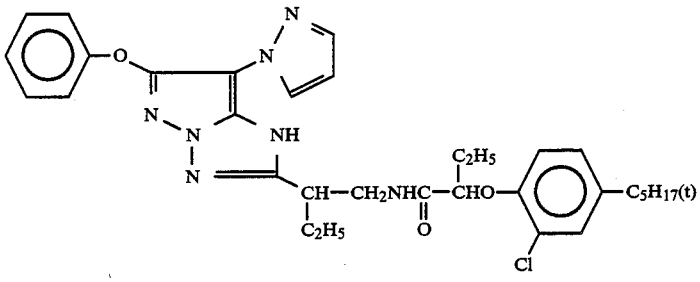
PM-14
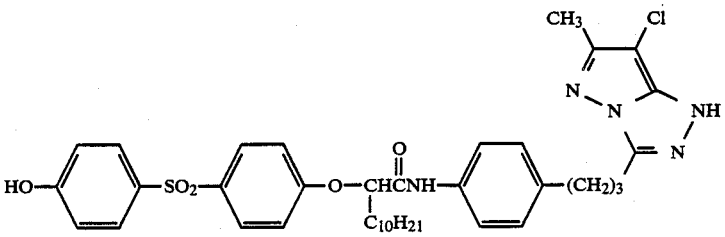
PM-15
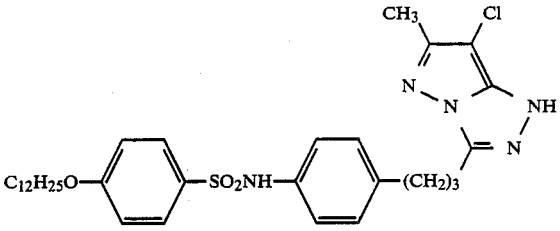

-continued
PM-16
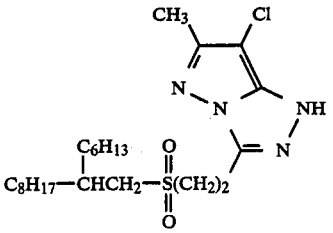
PM-17
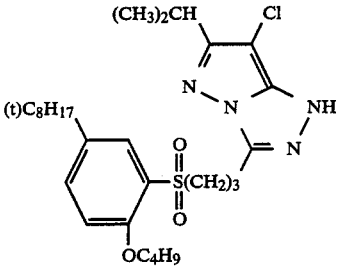
PM-19
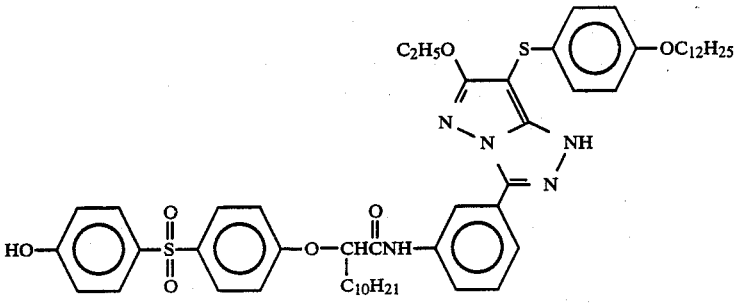
PM-20
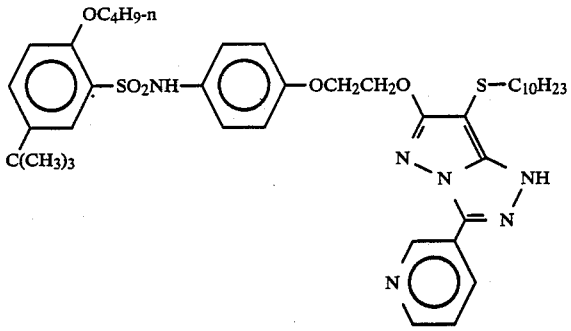
PM-21
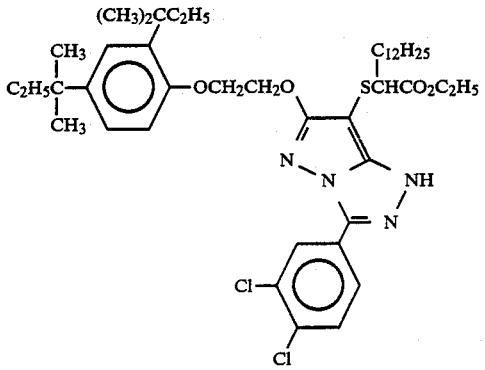

-continued
PM-22
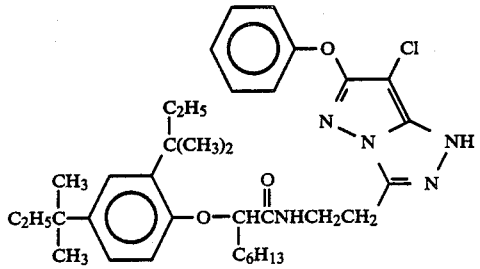
PM-23
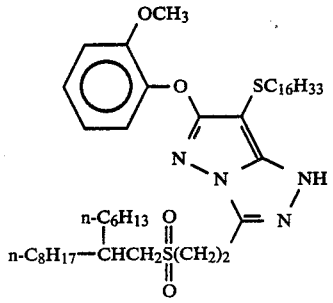
PM-24
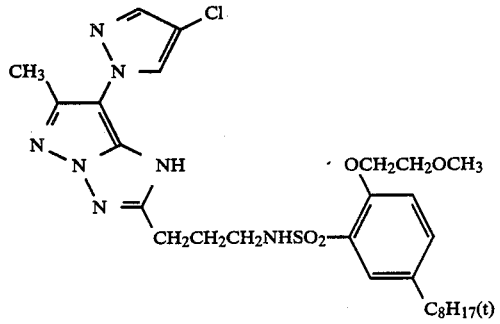
PM-25
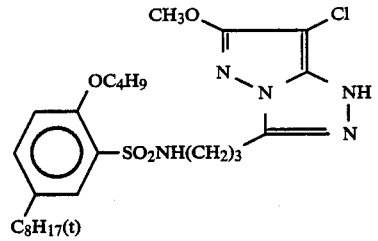
PM-26
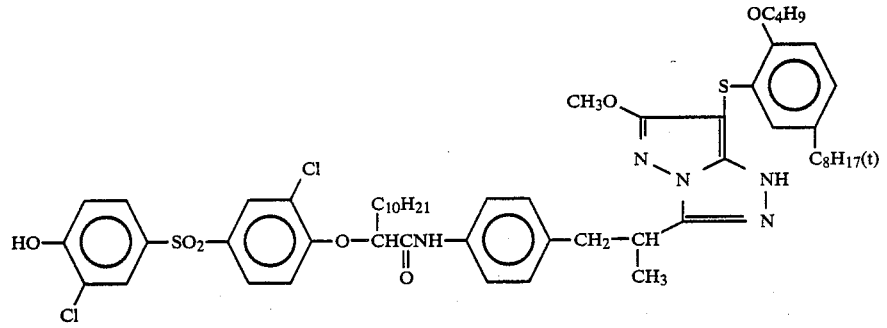

-continued

PM-27

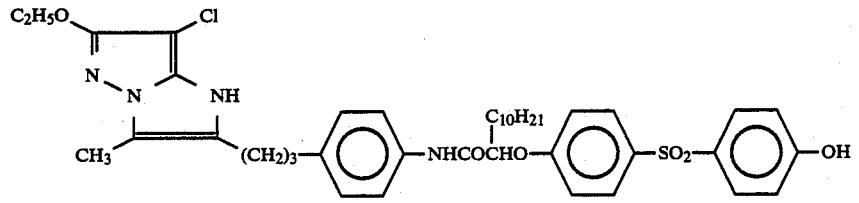

PM-28

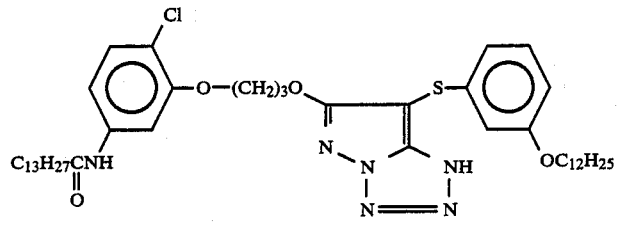

The amount of the aforesaid coupler added to the photographic material is preferably from 0.01 to 20 mmol, more preferably from 0.1 to 5 mmol or so, per $m^2$ of the material.

If desired, 5-pyrazolone type magenta couplers or polymer couplers may be used in combination with the aforesaid pyrazoloazole magenta couplers.

As cyan couplers which may be used in the present invention, phenol couplers and naphthol couplers are mentioned. Specifically, the cyan couplers described in U.S. Pat. Nos. 4,052,212, 4,146,396, 4,228,233, 4,296,200, 2,369,929, 2,801,171, 2,772,162, 2,895,826, 3,772,002, 3, 758, 308, 4,334,011 and 4,327,172, West German Patent Application (OLS) No. 3,329,729, European Pat. No. 121365A, U.S. Pat. Nos. 3,446,622, 4,333,999, 4,451,559 and 4,427,767 and European Pat. No. 161626A are preferred.

Color couplers for correcting the unnecessary absorption of colored dyes may also be used in the present invention, and those described in *Research Disclosure,* Item No. 17643, VII-G, U.S. Pat. No. 4,163,670, JP-B-No. 57-39413, U.S. Pat. Nos. 4,004,929 and 4,138,258 and British Pat. No. 1,146,368 are preferred.

As couplers giving colored dyes having proper diffusibility which may be used in the present invention, those described in U.S. Pat. No. 4,366,237, British Pat. No. 2,125,570, European Pat. No. 96570 and West German Patent Application (OLS) No. 3,234,533 are preferred.

Typical Examples of polymerized dye-forming couplers which may be used in the present invention are described in U.S. Pat. Nos. 3,451,820, 4,080,211 and 4,367,282 and British Pat. No. 2,102,173.

Couplers capable of releasing a photographically useful residue upon coupling are also preferably used in the present invention. As DIR couplers capable of releasing a development inhibitor, those described in the patent publications as referred to in the aforesaid Research Disclosure, Item No. 17643, VII-F as well as those described in JP-A-Nos. 57-151944, 57-154234 and 60-184248 and U.S. Pat. No. 4,248,962 are preferably used in the present invention.

As couplers capable of imagewise releasing a nucleating agent or a development accelerator in development, those described in British Pat. Nos. 2,097,140 and 2,131,188 and JP-A-Nos. 59-157638 and 59-170840 are preferably used in the present invention.

In addition, as other couplers which may be incorporated into the photographic materials to be processed by the method of the present invention, there may be mentioned competing couplers described in U.S. Pat. No. 4,130,427; poly-equivalent couplers described in U.S. Pat. Nos. 4,283,472, 4,338,393 and 4,310,618; DIR redox compounds or DIR coupler-releasing couplers or DIR coupler-releasing couplers or redox compounds described in JP-A-Nos. 60-185950 and 62-24252; couplers releasing dyes which may recolor after release, described in European Pat. No. 173302A; bleaching accelerator-releasing couplers described in Research Disclosure, Item Nos. 11449 and 24241 and JP-A-No. 61-201247; and ligand-releasing couplers described in U.S. Pat. No. 4,553,477.

Specific examples of color couplers which can be used in the present invention are mentioned below, but these are not intended to restrict the scope of the present invention.

C-(1)

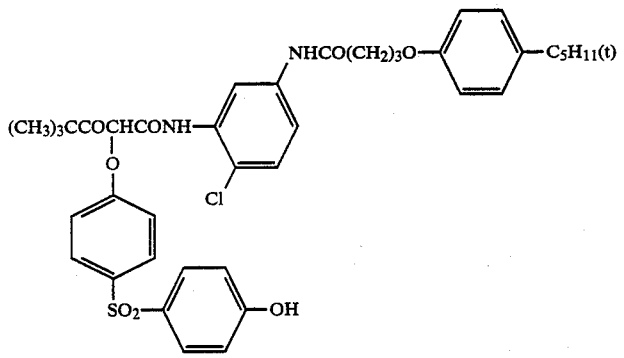

-continued
C-(2)
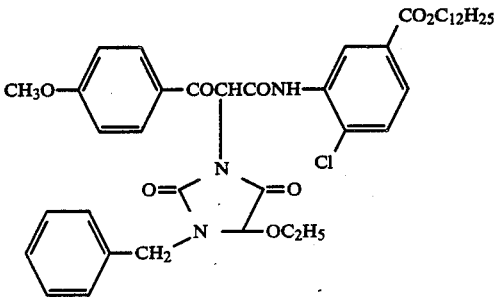
C-(3)
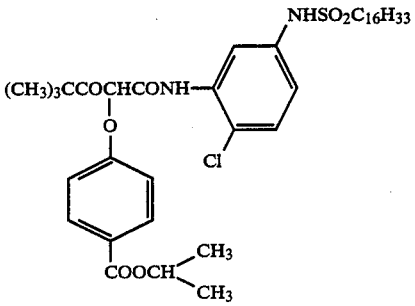
C-(4)
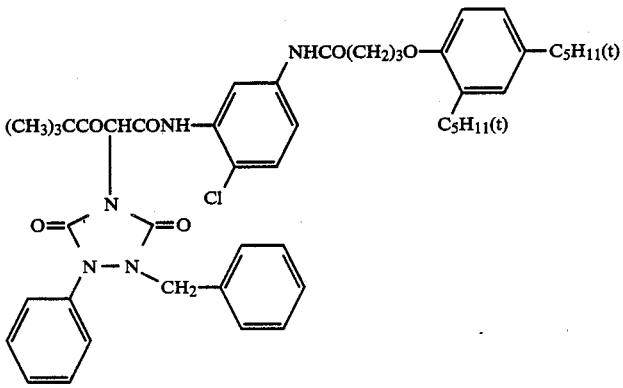
C-(5)
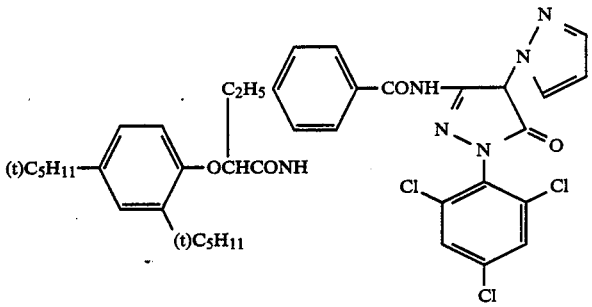
C-(6)
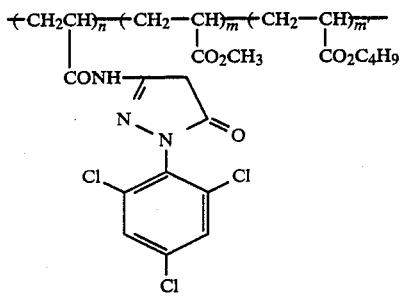
n:m:m′ = 2:1:1
(by weight)

-continued
molecular weight: ca. 40,000
C-(7)
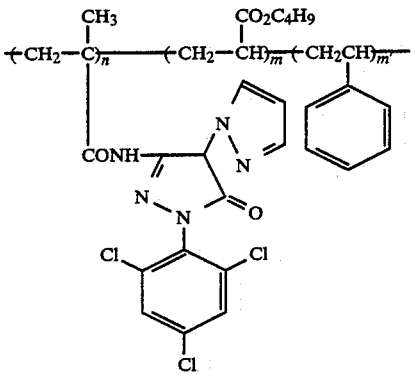
n/m/m' = 50/25/25
(% by weight)
mean molecular weight: ca. 30,000
C-(8)
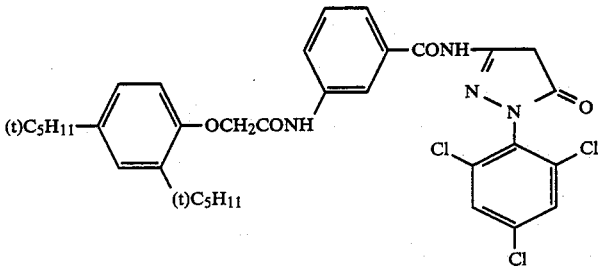
C-(9)
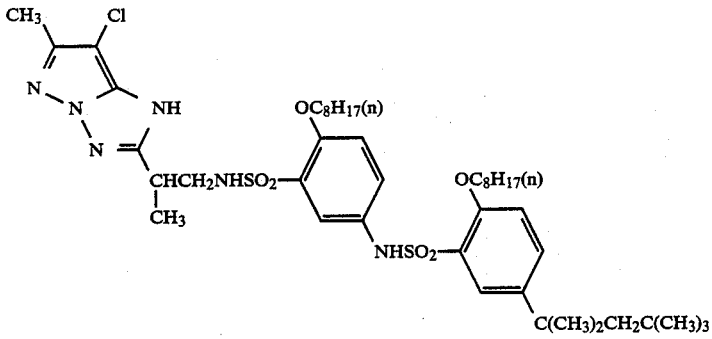
C-(10)
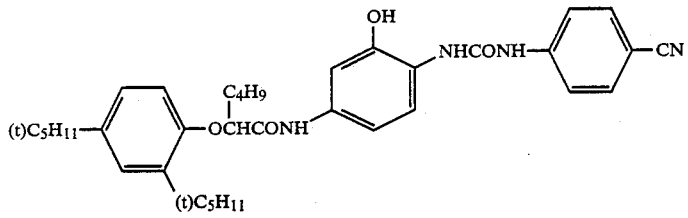

-continued
C-(11)
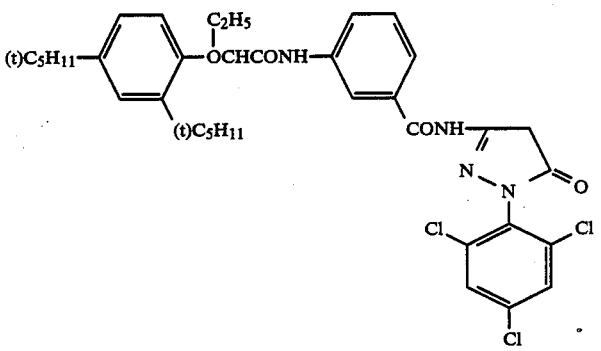
C-(12)
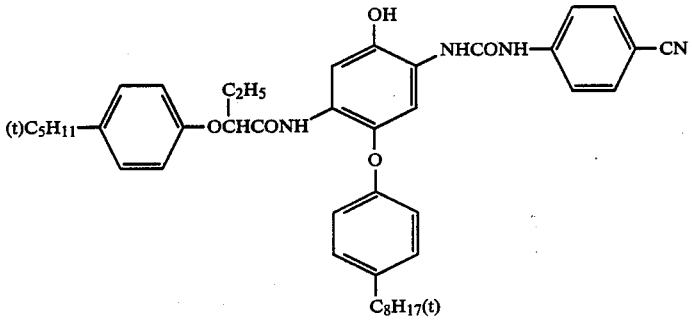
C-(13)
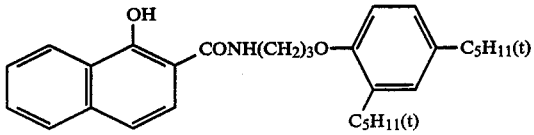
C-(14)
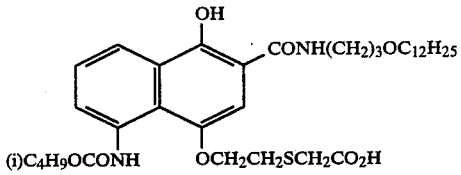
C-(15)
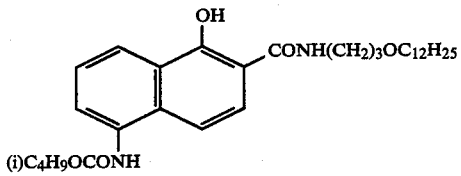
C-(16)
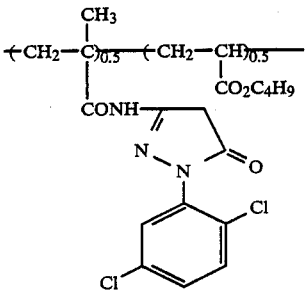
(Numeral ratio is by weight.)

-continued
C-(17)
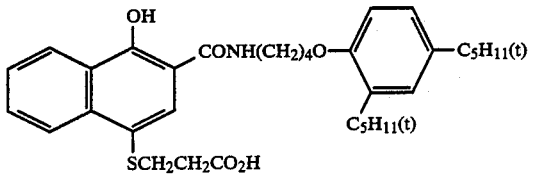
C-(18)
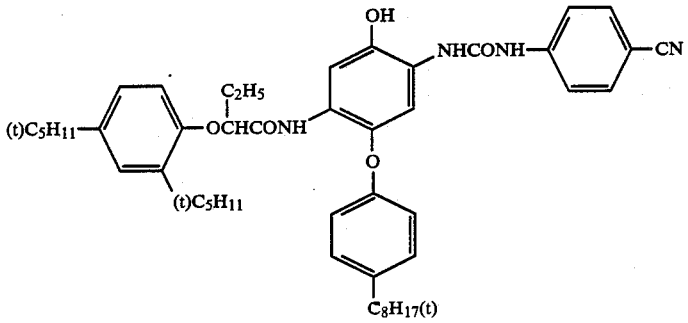
C-(19)
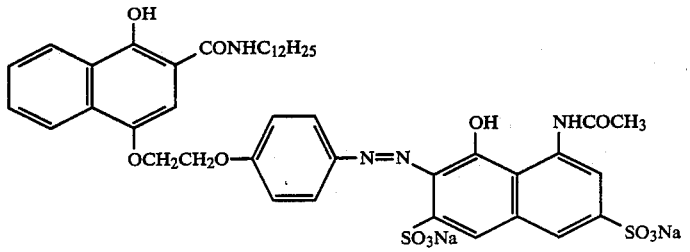
C-(20)
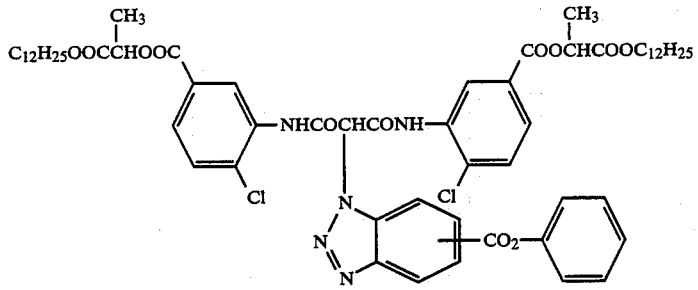
C-(21)
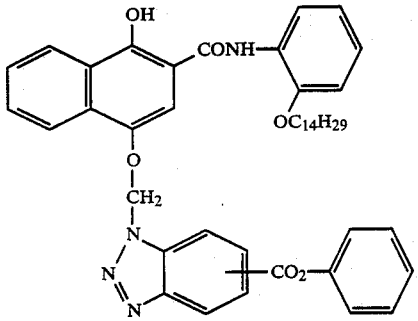

-continued
C-(22)
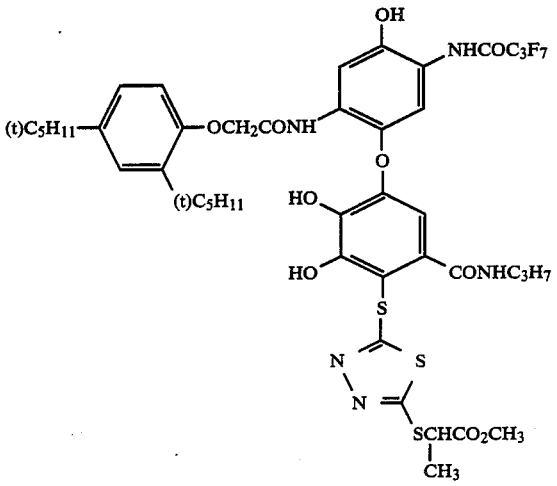
C-(23)
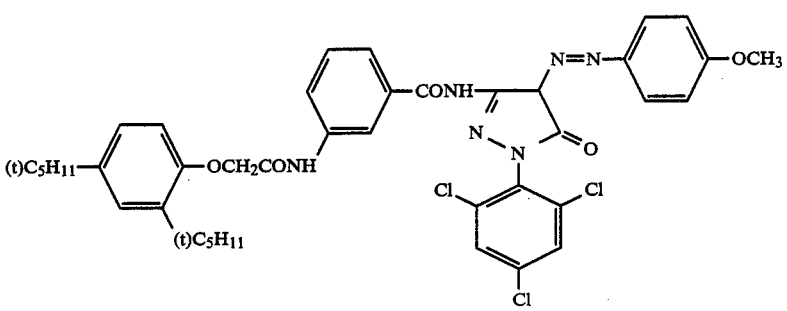
C-(24)
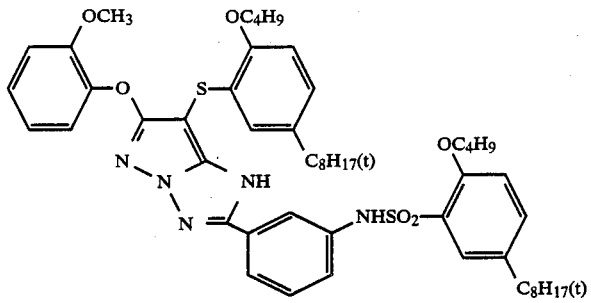
C-(25)
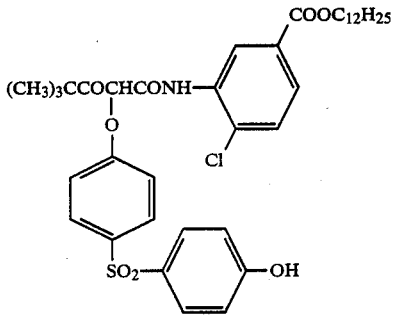

-continued
C-(26)
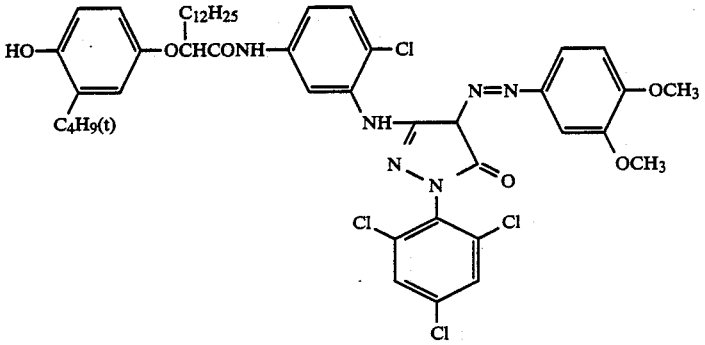
C-(27)
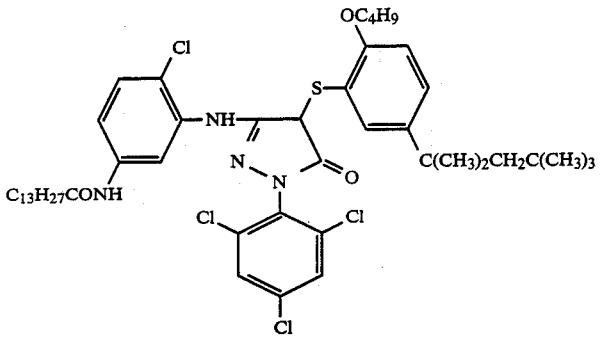
C-(28)
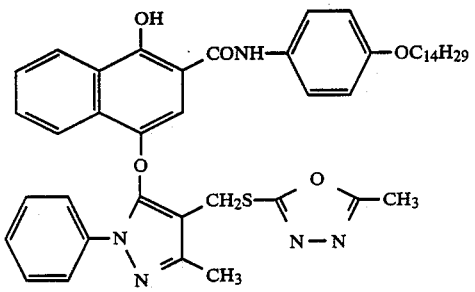
C-(29)
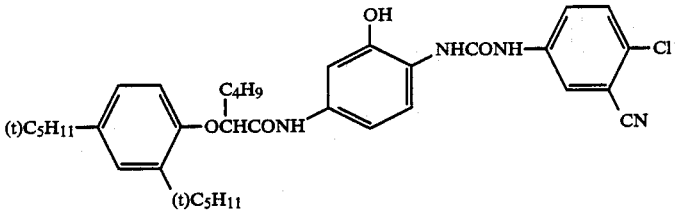
C-(30)
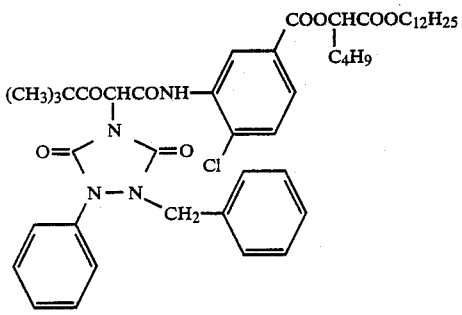

-continued
C-(31)
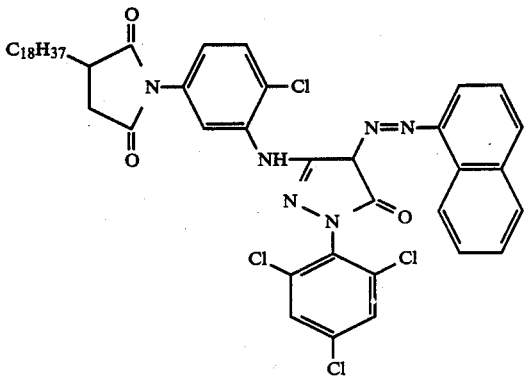
C-(32)
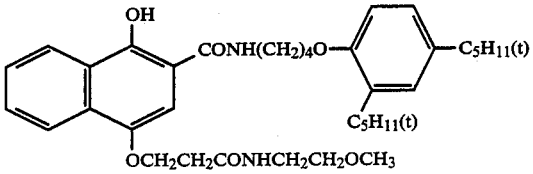
C-(33)
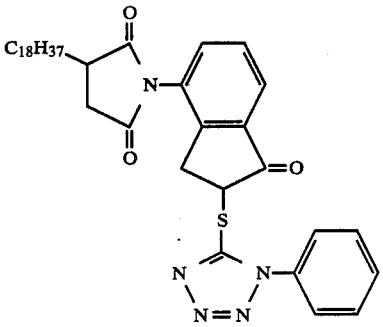
C-(34)
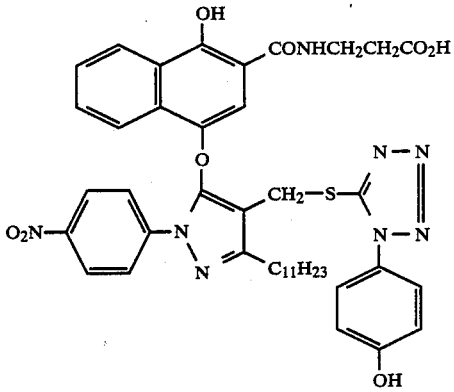
C-(35)
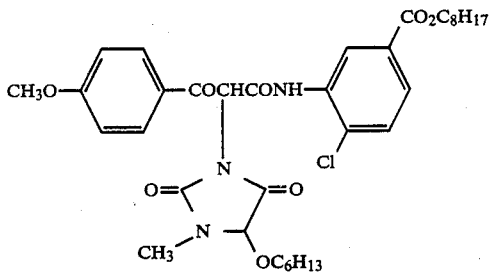

-continued
C-(36)
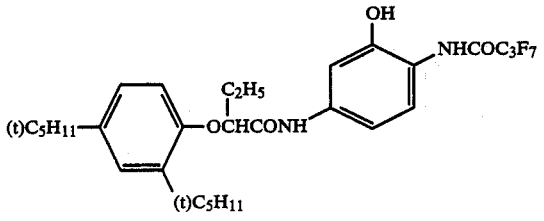
C-(37)
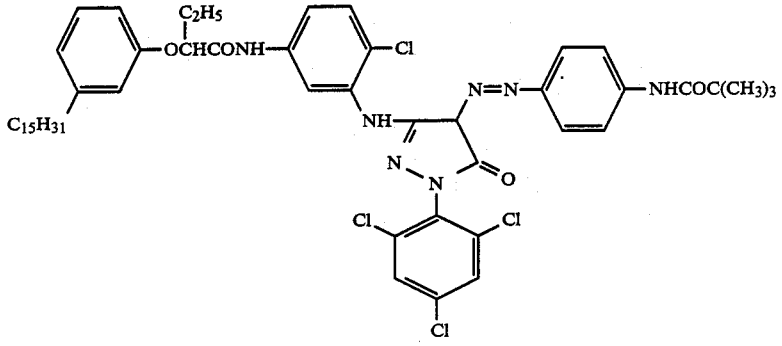
C-(38)
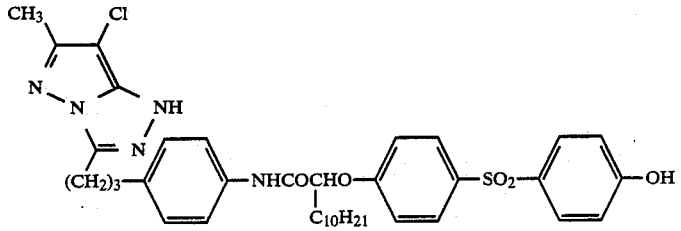
C-(39)
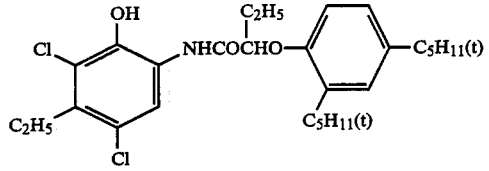
C-(40)
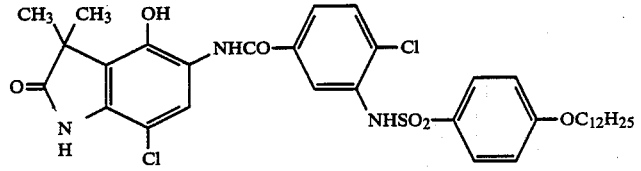
C-(41)
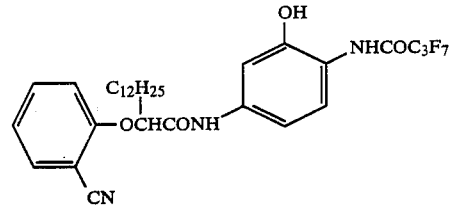

-continued
C-(42)
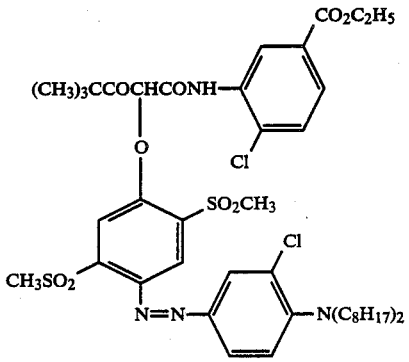
C-(43)
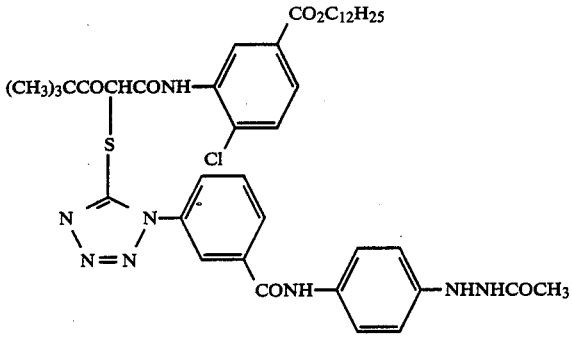
C-(44)
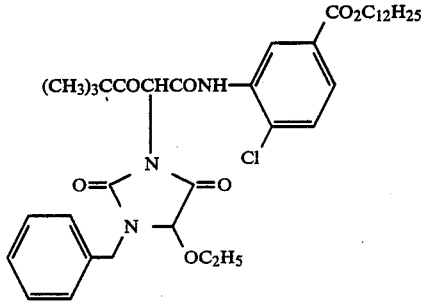
C-(45)
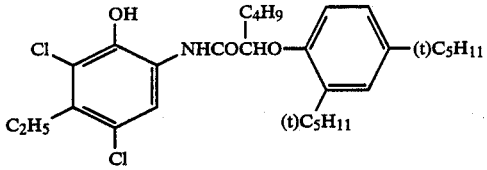
C-(46)
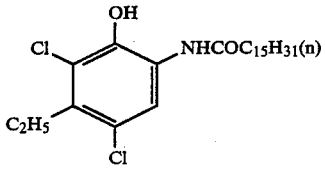
C-(47)
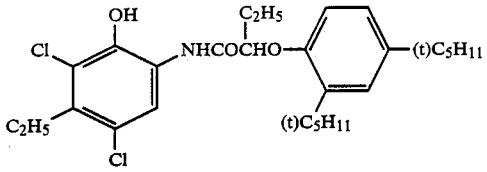

-continued
C-(48)
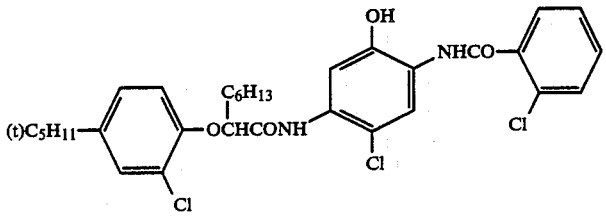
C-(49)
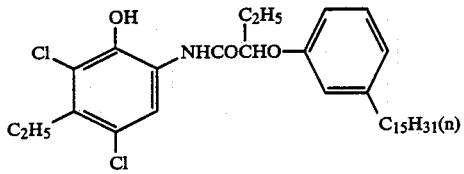
C-(50)
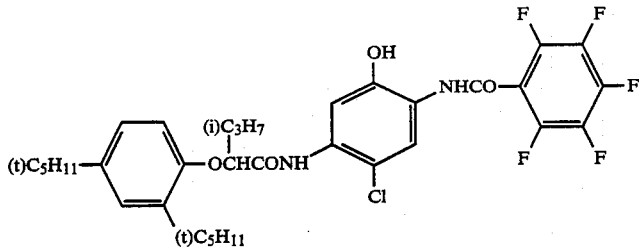
C-(51)
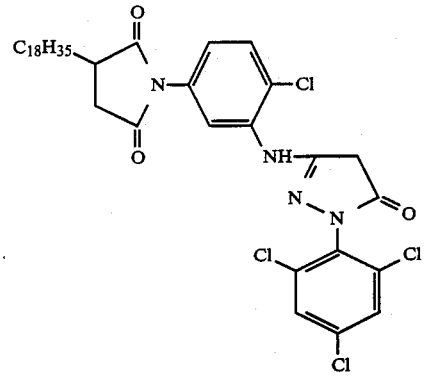
C-(52)
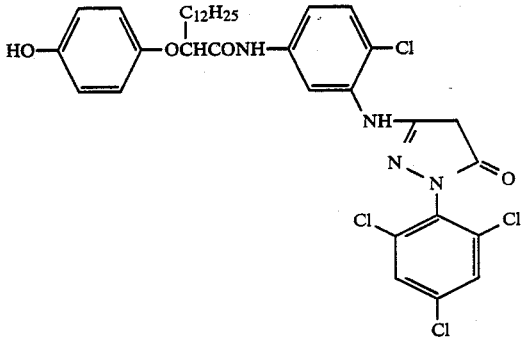

-continued
C-(53)
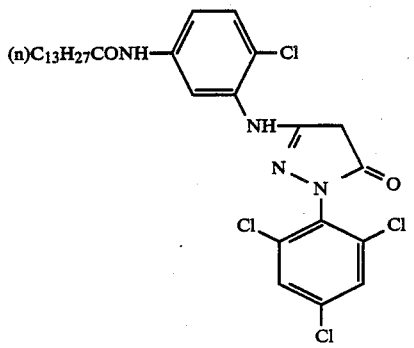
C-(54)
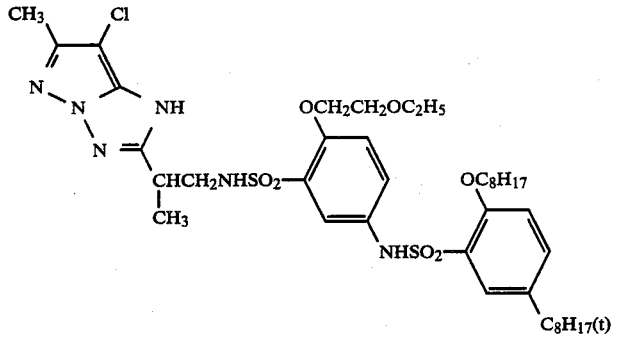
C-(55)
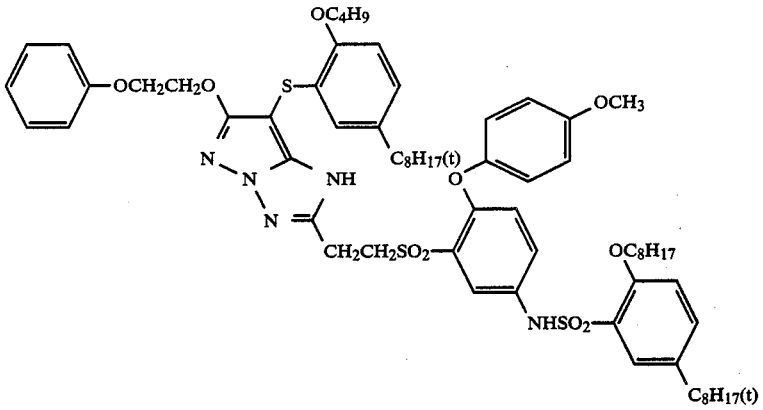
C-(56)
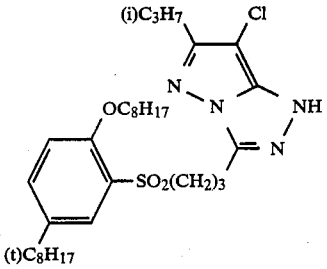

-continued

C-(57)

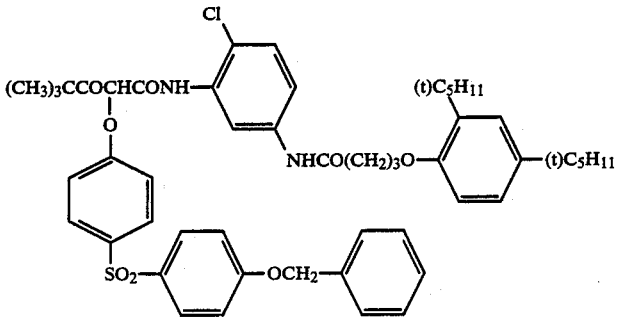

C-(58)

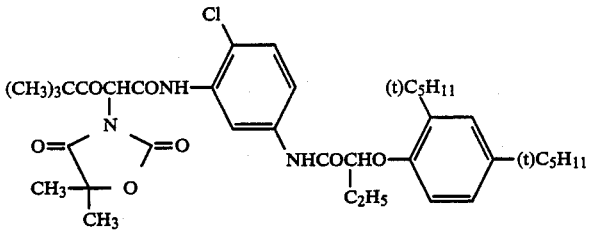

C-(59)

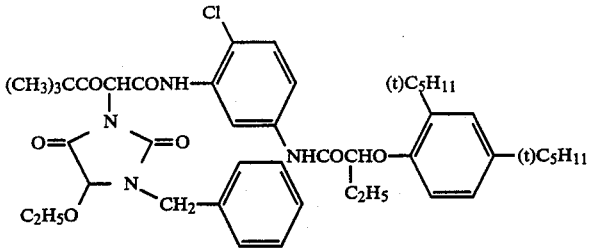

C-(60)

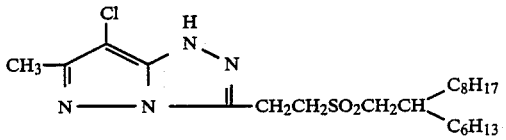

The couplers may be introduced into the photographic materials to be processed by the present invention by known various dispersion methods.

For instance, an oil-in-water dispersion method may be employed for this purpose, and examples of high boiling point solvents to be used in the dispersion method are described in U.S. Pat. No. 2,322,027.

As specific examples of high boiling point organic solvents having a boiling point (at normal pressure) of 175° C. or higher, which can be used in the oil-in-water dispersion method, there may be mentioned phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate, bis(1,1-diethylpropyl)phthalate), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic acid esters (e.g., 2-ethylhexyl benzoate, dodecyl benzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic acid esters (e.g., bis(2-ethylhexyl)sebacate, dioctyl azelate, glycerol tributyrate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene), etc. As auxiliary solvents, organic solvents having a boiling point of about 30° C. or higher, preferably from about 50° C. to about 160° C., can be used. Specific examples of such auxiliary solvents include ethyl acetate, butyl acetate, ethyl propionate, methyl ethyl ketone, cyclohexanone, 2-ethoxyethyl acetate and dimethylformamide.

A latex dispersion method may also be employed for incorporation of couplers into the photographic materials. The effect of this method as well as examples of latexes usable for the method as described in U.S. Pat. No. 4,199,363, West German patent Application (OLS) Nos. 2,541,274 and 2,541,230.

Supports which may suitably be used for formation of the photographic materials to be processed by the method of the present invention are described in, for example, the aforesaid *Research Disclosure,* Item No. 17643, page 28 and ibid., Item No. 18716, from page 647, right-hand column to page 648, left-hand column.

The following Examples are intended to illustrate the present invention in more detail but not to limit it in any way.

EXAMPLE 1

A multilayer color photographic material (Sample A) was prepared by forming the layers having the compositions shown below on a subbing layer-coated cellulose triacetate film support.

The compositions of the layers were as follows. The amount coated was expressed by the amount of Ag ($g/m^2$) for silver halide and colloidal silver. The amount used of coupler, additive and gelatin was expressed by the unit of $g/m^2$. The amount of sensitizing dye as coated was expressed by the molar number per mol of the silver halide in the same layer.

| | |
|---|---|
| First Layer: Antihalation Layer | |
| Black Colloidal Silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low Sensitive Red-Sensitive Emulsion Layer | |
| Silver Iodobromide Emulsion (AgI, 4 mol %; uniform AgI type; sphere-corresponding diameter, 0.5 μm; variation coefficient of sphere-corresponding diameter, 20%; tabular grains; ratio of diameter/thickness, 3.0) | 1.2 as Ag |
| Silver Iodobromide Emulsion (AgI, 3 mol %; uniform AgI type; sphere-corresponding diameter, 0.3 μm; variation coefficient of sphere-corresponding diameter, 15%; spherical grains; ratio of diameter/thickness, 1.0) | 0.6 as Ag |
| Gelatin | 1.0 |
| ExS-1 | $4 \times 10^{-4}$ |
| ExS-2 | $4 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High Sensitive Red-Sensitive Emulsion Layer | |
| Silver Iodobromide Emulsion (AgI, 6 mol %; AgI rich core type grains with core/shell ratio of 1/1; sphere-corresponding diameter, 0.7 μm; variation coefficient of sphere-corresponding diameter, 15%; tabular grains; aspect ratio of diameter/thickness, 5.0) | 0.7 as Ag |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.5 |
| Cpd-1 | 0.1 |
| Solv-1 | 0.05 |
| Sixth Layer: Low Sensitive Green-Sensitive Emulsion Layer | |
| Silver Iodobromide Emulsion (AgI, 4 mol %; AgI rich shell type grains with core/shell ratio of 1/1; sphere-corresponding diameter, 0.5 μm; variation coefficient of sphere-corresponding diameter, 15%; tabular grains; ratio of diameter/thickness, 4.0) | 0.35 as Ag |
| Silver Iodobromide Emulsion (AgI, 3 mol %; uniform AgI type grains; sphere-corresponding diameter, 0.3 μm; variation coefficient of sphere-corresponding diameter, 25%; spherical grains; ratio of thickness/diameter, 1.0) | 0.20 as Ag |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-14 | 0.03 |
| Solv-1 | 0.3 |
| Solv-4 | 0.05 |
| Seventh Layer: High Sensitive Green-Sensitive Emulsion Layer | |
| Silver Iodobromide Emulsion (AgI, 4 mol %; AgI rich core type grains with core/shell ratio of 1/3; sphere-corresponding diameter, 0.7 μm; variation coefficient of sphere-corresponding diameter, 20%; tabular grains; ratio of diameter/thickness, 5.0) | 0.8 as Ag |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-14 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Interlayer Effect-Donor Layer to Red-Sensitive Layer | |
| Silver Iodobromide Emulsion (AgI, 2 mol %; AgI rich core type grains with core/shell ratio of 2/1; sphere-corresponding diameter, 1.0 μm; variation coefficient of sphere-corresponding diameter, 15%; tabular grains; ratio of diameter/thickness, 6.0) | 0.35 as Ag |
| Silver Iodobromide Emulsion (AgI, 2 mol %; AgI rich core type grains with core/shell ratio of 1/1; sphere-corresponding diameter, 0.4 μm; variation coefficient of sphere-corresponding diameter, 20%; tabular grains; ratio of diameter/thickness, 6.0) | 0.20 as Ag |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow Colloidal Silver | 0.05 |
| Gelatin | 0.5 |
| Cpd-2 | 0.13 |
| Solv-1 | 0.13 |
| Cpd-1 | 0.10 |
| Eleventh Layer: Low Sensitive Blue-Sensitive Emulsion Layer | |
| Silver Iodobromide Emulsion (AgI, 4.5 mol %; uniform AgI type grains; sphere-corresponding diameter, 0.7 μm; variation coefficient of sphere-corresponding diameter, 15%; tabular grains; ratio of diameter/thickness, 7.0) | 0.3 as Ag |
| Silver Iodobromide Emulsion (AgI, 3 mol %; uniform AgI type grains; sphere-corresponding diameter, 0.3 μm; | 0.15 as Ag |

-continued

| | |
|---|---|
| variation coefficient of sphere-corresponding diameter, 25%; tabular grains; ratio of diameter/thickness, 7.0) | |
| Gelatin | 0.5 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High Sensitive Blue-Sensitive Emulsion Layer | |
| Silver Iodobromide Emulsion (AgI, 10 mol %; AgI rich core type grains; sphere-corresponding diameter, 1.0 μm; variation coefficient of sphere-corresponding diameter, 25%; multilayer twin plane tabular grains; ratio of diameter/thickness, 2.0) | 0.5 as Ag |
| Gelatin | 0.5 |
| ExS-6 | $1 \times 10^{-4}$ |
| ExY-15 | 0.20 |
| ExY-13 | 0.01 |

-continued

| | |
|---|---|
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine Silver Bromide Grain Emulsion (AgI, 2 mol %; uniform AgI type grains; sphere-corresponding diameter, 0.07 μm) | 0.5 |
| Gelatin | 0.45 |
| Polymethyl Methacrylate Grains (diameter, 1.5 μm) | 0.2 |
| H-1 | 0.4 |
| Cpd-5 | 0.5 |
| Cpd-6 | 0.5 |

The respective layers contained Emulsion Stabilizer Cpd-3 (0.04 g/m$^2$) and Surfactant Cpd-4 (0.02 g/m$^2$) as coating aids, in addition to the above-mentioned components.

The components used above were as follows.

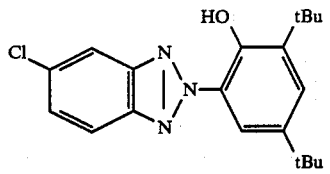

UV-1

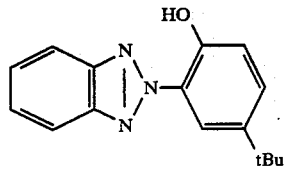

UV-2

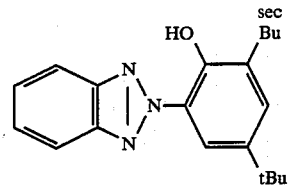

UV-3

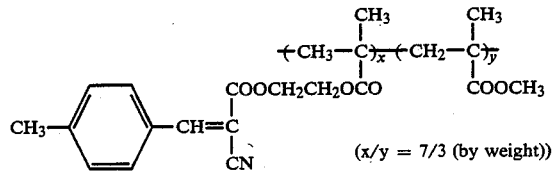

(x/y = 7/3 (by weight))

UV-4

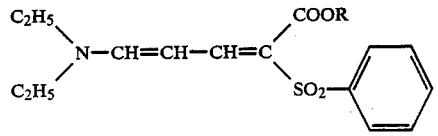

R = $C_8H_{17}$

UV-5

Tricresyl Phosphate — Solv-1

Dibutyl Phthalate — Solv-2

-continued
Solv-3
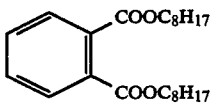
Solv-4
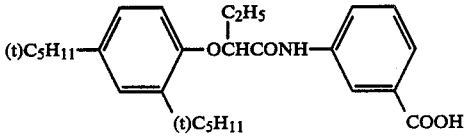
Cpd-1
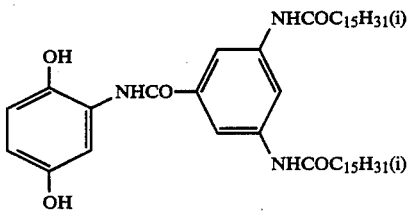
Cpd-2
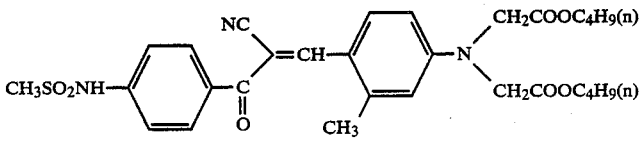
Cpd-3
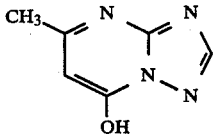
Cpd-4
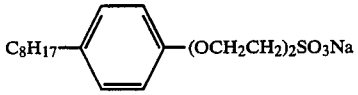
Cpd-5
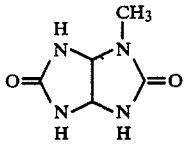
Cpd-6
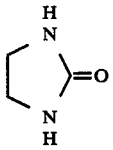
ExC-1
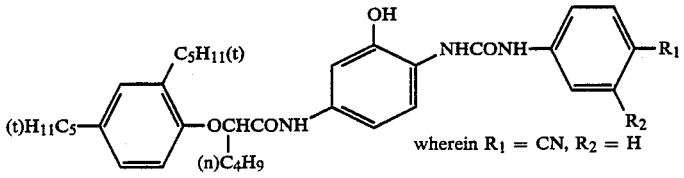
ExC-2
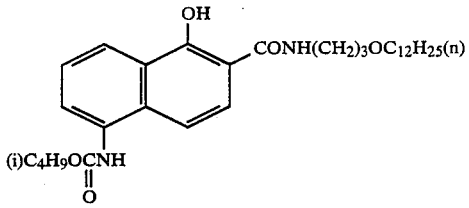

-continued
ExC-3
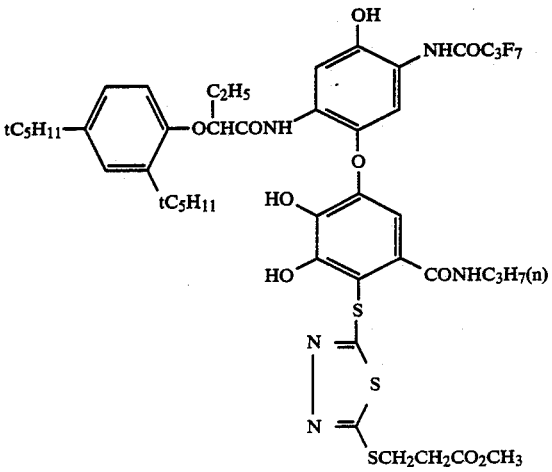
ExC-4
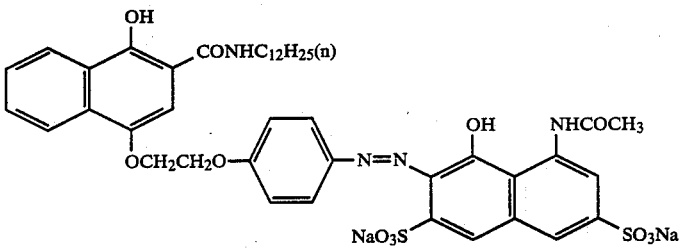
ExC-5
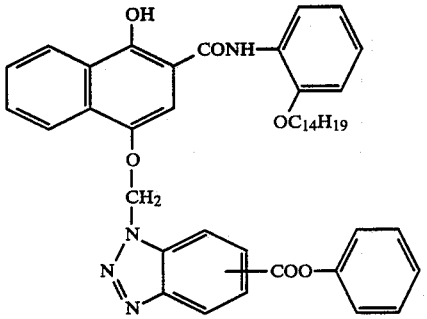
ExC-6
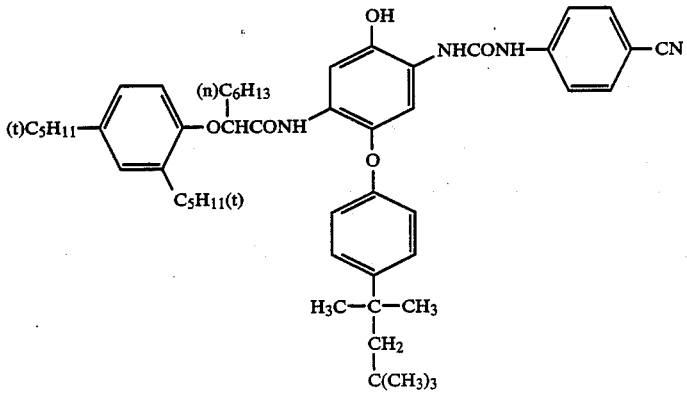
ExC-7
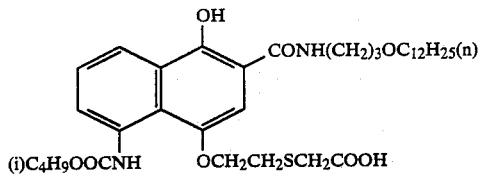

-continued
ExM-8
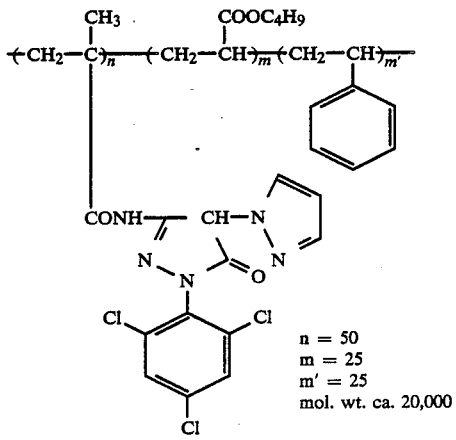
ExM-9
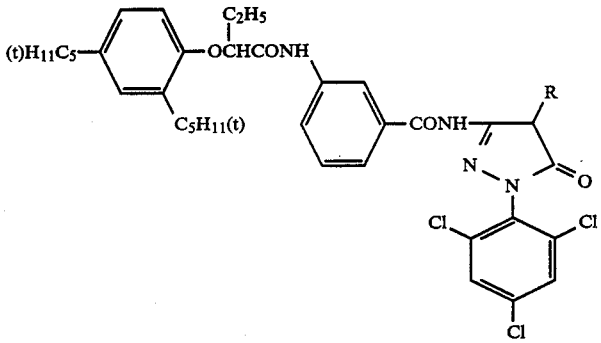
wherein R = 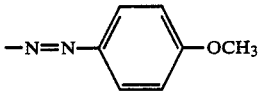
ExM-10
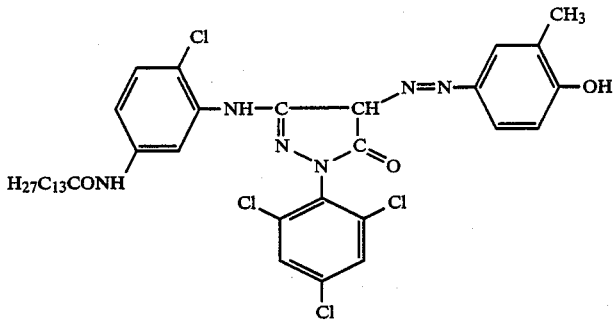
ExM-14
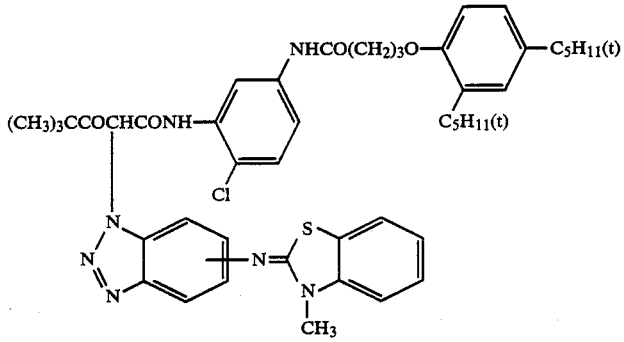

-continued
ExM-12
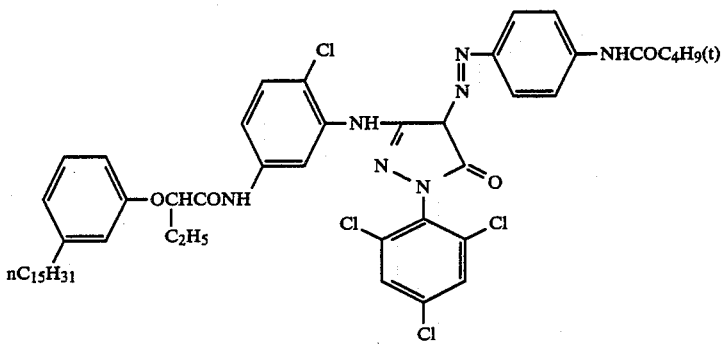
ExY-13
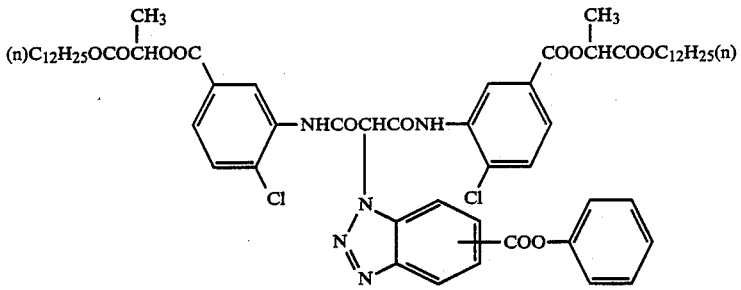
ExY-14
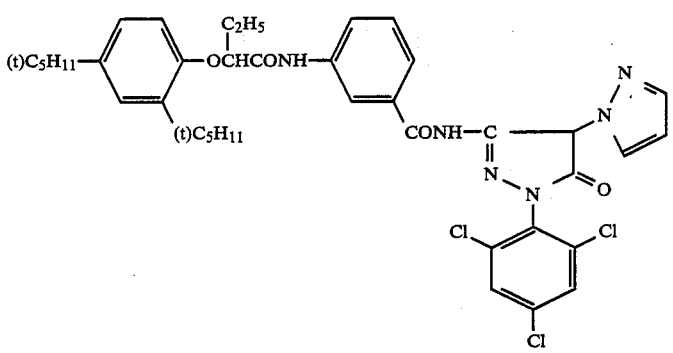
ExY-15
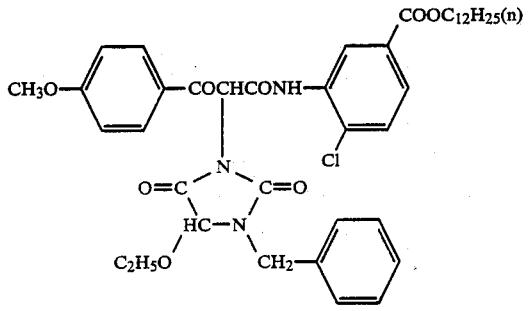

-continued
ExC-16
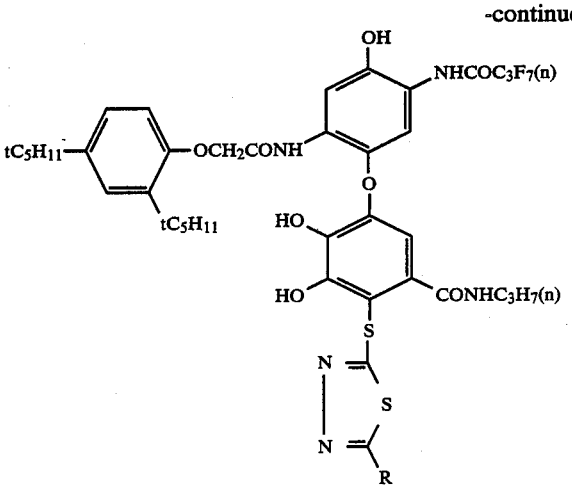
wherein R = $SCH_2CH_2COOCH_3$
ExS-1
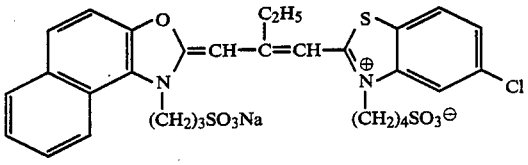
ExS-2
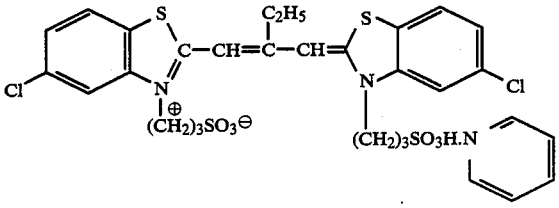
ExS-3
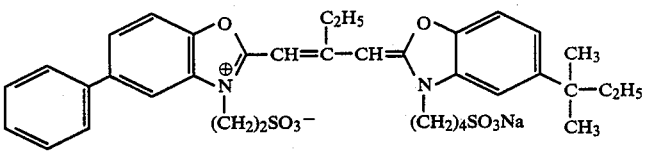
ExS-4
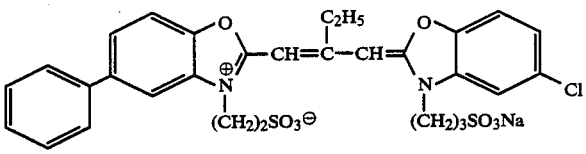
ExS-5
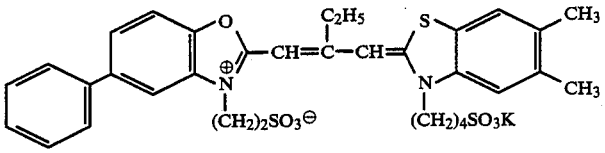
ExS-6
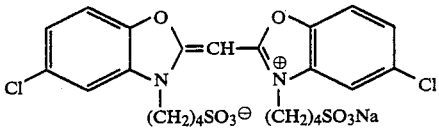
H-1
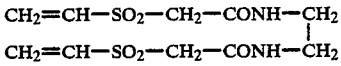

-continued

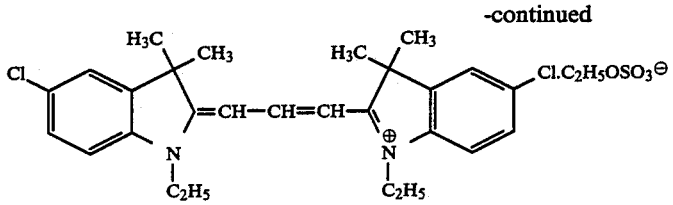

ExF-1

The sample thus prepared was imagewise exposed and then processed by the following continuous procedure (running test) until the amount of the replenisher added became two times the capacity of the color developer tank. In carrying out the process, the composition of the fixing solution was varied as indicated in Table 1 below.

| Step | Processing Time | Temperature (°C.) | Amount of Replenisher (per m of 35 mm wide sample) (ml) |
|---|---|---|---|
| Color Development | 3 min 15 sec | 38 | 38 |
| Bleaching | 1 min | 38 | 4 |
| Fixing | 1 min | 38 | 30 |
| Stabilization (1) | 20 sec | 38 | — |
| Stabilization (2) | 20 sec | 38 | — |
| Stabilization (3) | 20 sec | 38 | 35* |
| Drying | 1 min 15 sec | 50–70 | — |

*Stabilization was carried out by a three-tank countercurrent system from stabilizing bath (3) to stabilizing bath (1).

The compositions of the respective processing solutions were as follows.

| | Tank Solution | Replenisher |
|---|---|---|
| Color Developer: | | |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-[N-Ethyl-N-β-hydroxyethylamino]-2-methylaniline Sulfate | 4.7 g | 5.3 g |
| Water to make | 1.0 l | 1.0 l |
| pH | 10.00 | 10.05 |
| Bleaching Solution: | | |
| Ammonium (Ethylenediaminetetraacetato)Iron(III) Dihydrate | 30.0 g | 60 g |
| (Aminopolycarboxylato)Iron(III) Complex (see Table 1) | 0.17 mol | 0.24 mol |
| Bleaching Accelerator(*) | 1.0 g | 2.0 g |
| Ethylenediaminetetraacetic Acid | 4.0 g | 5.0 g |

-continued

| | Tank Solution | Replenisher |
|---|---|---|
| Ammonium Bromide | 100.0 g | 160.0 g |
| Ammonium Nitrate | 30.0 g | 50.0 g |
| Aqueous Ammonia (27 wt %) | 20.0 ml | 23.0 ml |
| Acetic Acid (98 wt %) | 9.0 ml | 15.0 ml |
| Water to make | 1.0 l | 1.0 l |
| pH | 4.0 | 3.5 |

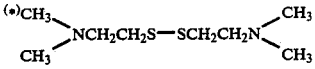

| | | |
|---|---|---|
| Fixing Solution: | | |
| Chelating Agent (see Table 1)* | See Table 1 | |
| Sodium Sulfite | 7.0 g | 8.0 g |
| Sodium Bisulfite | 5.0 g | 5.5 g |
| Aqueous Ammonium Thiosulfate (70 wt %) | 170.0 ml | 200.0 ml |
| Water to make | 1.0 l | 1.0 l |
| pH | 6.7 | 6.6 |

*All are earlier identified in the specification.

| | |
|---|---|
| Stabilizing Solution: | |
| (Tank solution and replenisher were the same.) | |
| Formalin (37%) | 1.2 ml |
| 5-Chloro-2-methyl-4-isothiazolin-3-one | 6.0 mg |
| 2-Methyl-4-isothiazolin-3-one | 3.0 mg |
| Surfactant | 0.4 g |
| $[C_{10}H_{21}-O-(CH_2CH_2O)_{10}-H]$ | |
| Ethylene Glycol | 1.0 g |
| Water to make | 1.0 liter |
| pH | 5.0 to 7.0 |

The above-mentioned sample was exposed with 20 CMS light and then processed with the running equilibrium solutions, and the amount of the remaining silver was determined by the fluorescent x-ray method. The fixing solution was stored at 4° C. until the formation of precipitation therein, and the number of the days before the precipitation was determined.

The degree of stain, if any, of the sample processed was determined by visual observation with the dye.

The results obtained are shown in Table 1 below.

As is obvious from the results in Table 1, the method of the present invention was proved excellent in desilvering effect. In addition, the fixing solution was extremely stable, and stain in the photographic film sample processed was small, in accordance with the present invention.

TABLE 1

| No. | (Aminopolycarboxylato)-Iron (III) Complex | Fixing Solution: Chelating Agent | Fixing Solution: Amount Added (mol/l) | Remarks | Results: Amount of Silver Remaining (μg/cm²) | Results: Time (day) | Results: Stain* |
|---|---|---|---|---|---|---|---|
| 1 | Ammonium (Ethylenediamine-tetraacetato) Iron (III) | (57) | 0.02 | Comparison | 15 | 30 | o |
| 2 | Ammonium (1,3-Diaminopropane-tetraacetato) Iron (III) | — | — | " | 3 | 7 | x |
| 3 | Ammonium (1,3-Diaminopropane-tetraacetato) Iron (III) | Ethylenediamine-tetraacetic Acid | 0.02 | " | 3 | 8 | x |
| 4 | Ammonium (1,3-Diaminopropane-tetraacetato) Iron (III) | Ethylenediamine-tetraacetic Acid | 0.05 | " | 3 | 15 | Δ |

TABLE 1-continued

| No. | (Aminopolycarboxylato)-Iron (III) Complex | Fixing Solution: Chelating Agent | Fixing Solution: Amount Added (mol/l) | Remarks | Results: Amount of Silver Remaining (μg/cm²) | Results: Time (day) | Results: Stain* |
|---|---|---|---|---|---|---|---|
| 5 | Ammonium (1,3-Diaminopropane-tetraacetato) Iron (III) | Ethylenediamine-tetraacetic Acid | 0.10 | " | 3 | 18 | Δ |
| 6 | Ammonium (1,3-Diaminopropane-tetraacetato) Iron (III) | (57) | 0.02 | Invention | 3 | 30 | o |
| 7 | Ammonium (1,3-Diaminopropane-tetraacetato) Iron (III) | (57) | 0.05 | " | 3 | 34 | o |
| 8 | Ammonium (1,3-Diaminopropane-tetraacetato) Iron (III) | (25) | 0.02 | " | 3 | 29 | o |
| 9 | Ammonium (1,3-Diaminopropane-tetraacetato) Iron (III) | (25) | 0.05 | " | 3 | 33 | o |
| 10 | Ammonium (1,3-Diaminopropane-tetraacetato) Iron (III) | (68) | 0.02 | " | 3 | 30 | o |
| 11 | Ammonium (1,3-Diaminopropane-tetraacetato) Iron (III) | (68) | 0.05 | " | 3 | 33 | o |
| 12 | Ammonium (1,4-Diaminobutane-tetraacetato) Iron (III) | (25) | 0.05 | " | 4 | 28 | o |
| 13 | Ammonium (1,4-Diaminobutane-tetraacetato) Iron (III) | (57) | 0.05 | " | 4 | 31 | o |
| 14 | Ammonium (1,4-Diaminobutane-tetraacetato) Iron (III) | (68) | 0.05 | " | 5 | 29 | o |

*o: No stain.
Δ: Stain was negligible.
x: Stain was remarkable.

EXAMPLE 2

A multilayer color photographic material (Sample B) was prepared by forming the layers having the compositions shown below on a subbing layer-coated cellulose triacetate film support.

The compositions of the layers were as follows. The amount coated was expressed by the amount of Ag (g/m²) for silver halide and colloidal silver. The amount of coupler, additive and gelatin as coated was expressed by the unit of g/m². The amount of sensitizing dye as coated was expressed by the molar number per mol of the silver halide in the same layer.

| | |
|---|---|
| **First Layer: Antihalation Layer** | |
| Black Colloidal Silver | 0.2 as Ag |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| **Second Layer: Interlayer** | |
| Fine Silver Bromide Grains (sphere-corresponding diameter, 0.07 μm) | 0.15 as Ag |
| Gelatin | 1.0 |
| Cpd-2 | 0.2 |
| **Third Layer: Fierst Red-Sensitive Emulsion Layer** | |
| Silver Iodobromide Emulsion (AgI, 10.0 mol %; AgI rich core type grains; sphere-corresponding diameter, 0.7 μm; variation coefficient of sphere-corresponding diameter, 14%; tetradecahedral grains) | 0.26 as Ag |
| Silver Iodobromide Emulsion (AgI, 4.0.mol %; AgI rich core type grains; sphere-corresponding diameter, 0.4 μm; variation coefficient of sphere-corresponding diameter, 22%; tetradecahedral grains) | 0.2 as Ag |
| Gelatin | 1.0 |
| ExS-1 | $4.5 \times 10^{-4}$ mol |
| ExS-2 | $1.5 \times 10^{-4}$ mol |
| ExS-3 | $0.4 \times 10^{-4}$ mol |
| ExS-4 | $0.3 \times 10^{-4}$ mol |
| ExC-1 | 0.33 |
| ExC-2 | 0.009 |
| ExC-3 | 0.023 |
| ExC-6 | 0.14 |
| **Fourth Layer: Second Red-Sensitive Emulsion Layer** | |
| Silver Iodobromide Emulsion (AgI, 16 mol %; AgI rich core type grains; sphere-corresponding diameter, 1.0 μm; variation coefficient of sphere-corresponding diameter, 25%; tabular grains; ratio of diameter/thickness, 4.0) | 0.55 as Ag |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| **Fifth Layer: Third Red-Sensitive Emulsion Layer** | |
| Silver Iodobromide Emulsion (AgI, 10.0 mol %; AgI rich core type grains; sphere-corresponding diameter, 1.2 μm; variation coefficient of sphere-corresponding diameter, 28%; tabular grains; ratio of diameter/thickness, 6.0) | 0.9 as Ag |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| **Sixth Layer: Interlayer** | |

-continued

| | |
|---|---|
| Gelatin | 1.0 |
| Cpd-4 | 0.1 |

Seventh Layer: First Green-Sensitive Emulsion Layer

| | |
|---|---|
| Silver Iodobromide Emulsion (AgI, 10.0 mol %; AgI rich core type grains; sphere-corresponding diameter, 0.7 μm; variation coefficient of sphere-corresponding diameter, 14%; tetradecahedral grains) | 0.2 as Ag |
| Silver Iodobromide Emulsion (AgI, 4.0 mol %; AgI rich core type grains; sphere-corresponding diameter, 0.4 μm; variation coefficient of sphere-corresponding diameter, 22%; tetradecahedral grains) | 0.1 as Ag |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |

Eight Layer: Second Green-Sensitive Emulsion Layer

| | |
|---|---|
| Silver Iodobromide Emulsion (AgI, 10 mol %; AgI rich core type grains; sphere-corresponding diameter, 1.0 μm; variation coefficient of sphere-corresponding diameter, 25%; tabular grains; ratio of diameter/thickness, 3.0) | 0.4 as Ag |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |

Ninth Layer: Interlayer

| | |
|---|---|
| Gelatin | 0.5 |

Tenth Layer: Third Green-Sensitive Emulsion Layer

| | |
|---|---|
| Silver Iodobromide Emulsion (AgI, 10.0 mol %; AgI rich core type grains; sphere-corresponding diameter, 1.2 μm; variation coefficient of sphere-corresponding diameter, 28%; tabular grains, ratio of diameter/thickness, 6.0) | 1.0 as Ag |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |

Eleventh Layer: Yellow Filter Layer

| | |
|---|---|
| Cpd-3 | 0.05 |
| Gelatin | 0.5 |
| Solv-1 | 0.1 |

Twelfth Layer: Interlayer

| | |
|---|---|
| Gelatin | 0.5 |
| Cpd-2 | 0.1 |

Thirteenth Layer: First Blue-Sensitive Emulsion Layer

| | |
|---|---|
| Silver Iodobromide Emulsion (AgI, 10 mol %; AgI rich core type grains; sphere-corresponding diameter, 0.7 μm; variation coefficient of sphere-corresponding diameter, 14%; tetradecahedral grains) | 0.1 as Ag |
| Silver Iodobromide Emulsion (AgI, 4.0 mol %; AgI rich core type grains; sphere-corresponding diameter, 0.4 μm; variation coefficient of sphere-corresponding diameter, 22%; tetradecahedral grains) | 0.05 as Ag |
| Gelatin | 1.0 |
| ExS-8 | $3 \times 10^{-4}$ |
| ExY-1 | 0.53 |
| ExY-2 | 0.02 |
| Solv-2 | 0.15 |

Fourteenth Layer: Second Blue-Sensitive Emulsion Layer

| | |
|---|---|
| Silver Iodobromide Emulsion (AgI, 10 mol %; AgI rich core type grains; sphere-corresponding diameter, 0.7 μm; variation coefficient of sphere-corresponding diameter, 14%; tetradecahedral grains) | 0.19 as Ag |
| Silver Iodobromide Emulsion (AgI, 4.0 mol %; AgI rich core type grains; sphere-corresponding diameter, 0.4 μm; variation coefficient of sphere-corresponding diameter, 22%; tetradecahedral grains | 0.05 as Ag |
| Gelatin | 1.0 |
| ExS-8 | $3 \times 10^{-4}$ |
| ExY-1 | 0.53 |
| ExY-2 | 0.02 |
| Solv-2 | 0.15 |

Fourteenth Layer: Second Blue-Sensitive Emulsion Layer

| | |
|---|---|
| Silver Iodobromide Emulsion (AgI, 19.0 mol %; AgI rich core type grains; sphere-corresponding diameter, 1.0 μm; variation coefficient of sphere-corresponding diameter, 16%; tetradecahedral grains) | 0.19 as Ag |
| Gelatin | 0.3 |
| ExS-8 | $2 \times 10^{-4}$ |
| ExY-1 | 0.22 |
| Solv-1 | 0.07 |

Fifteenth Layer: Interlayer

| | |
|---|---|
| Fine Silver Iodobromide Grains (AgI, 2 mol %; uniform type grains; sphere-corresponding diameter, 0.13 μm) | 0.2 as Ag |
| Gelatin | 0.36 |

Sixteenth Layer: Third Blue-Sensitive Emulsion Layer

| | |
|---|---|
| Silver Iodobromide Emulsion (AgI, 14.0 mol %; AgI rich core type grains; sphere-corresponding diameter, 1.5 μm; variation coeeficient of sphere-corresponding diameter, 28%; tabular grains; ratio of diameter/thickness, 5.0) | 1.0 as Ag |
| Gelatin | 0.5 |
| ExS-8 | $1.5 \times 10^{-4}$ |
| ExY-1 | 0.2 |
| Solv-1 | 0.07 |

Seventh Layer: First Protective Layer

-continued
| | |
|---|---|
| Gelatin | 1.8 |
| UV-1 | 0.1 |
| UV-2 | 0.2 |
| Solv-1 | 0.01 |
| Solv-2 | 0.01 |
| Eighteenth Layer: Second Protective Layer | |
| Fine Silver Bromide Grains (sphere-corresponding diameter, 0.07 μm) | 0.18 as Ag |
| Gelatin | 0.7 |
| Polymethyl Methacrylate Grains (diameter, 1.5 μm) | 0.2 |
| W-1 | 0.02 |
| H-1 | 0.4 |
| Cpd-5 | 1.0 |
The compounds used above were as follows.
UV-1
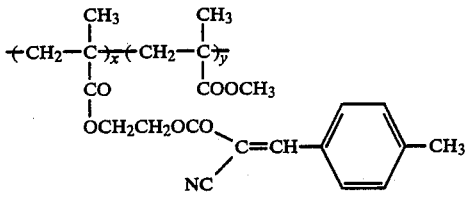
x/y = 7/3 (by weight)
UV-2
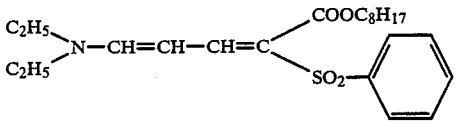
ExM-3
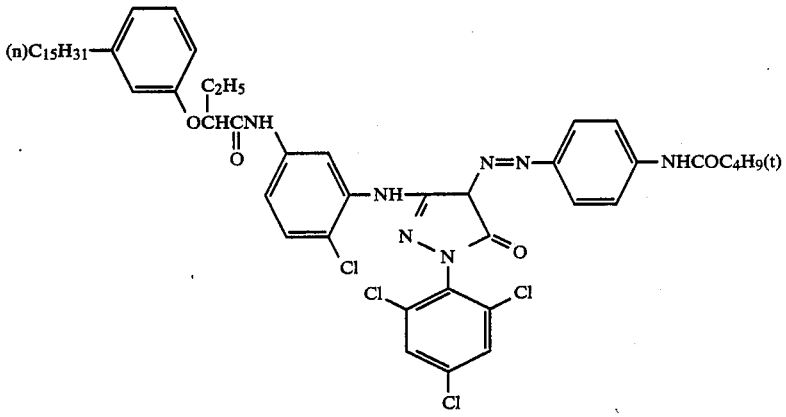
ExC-1
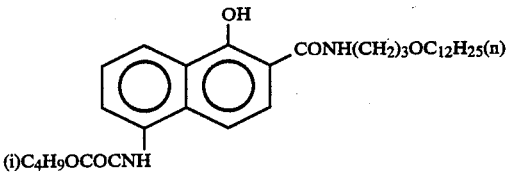
ExC-2
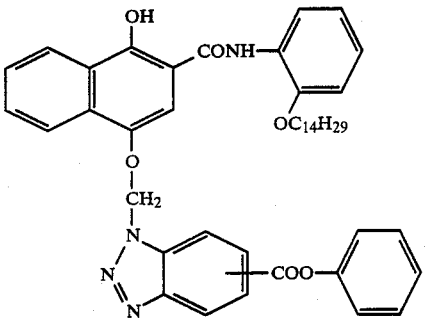

-continued
ExC-3
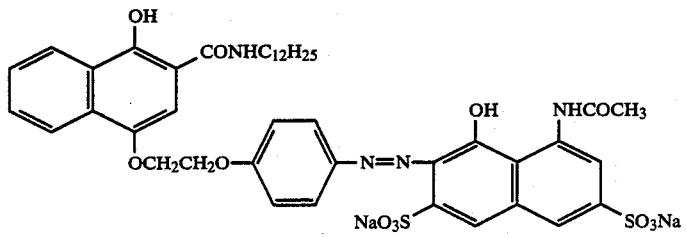
ExC-6
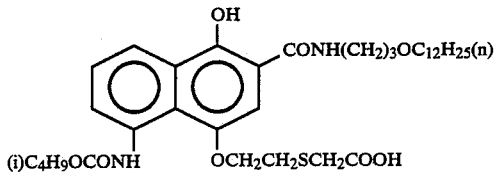
ExC-4
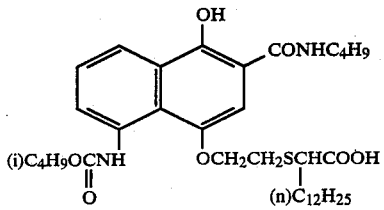
ExC-5
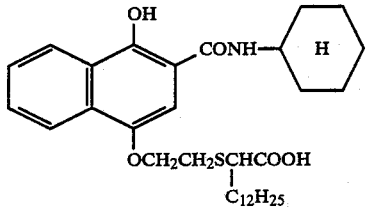
ExM-1
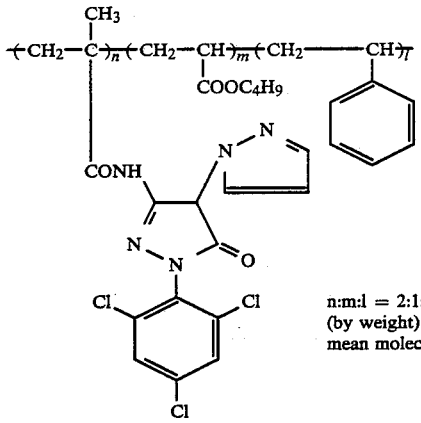
n:m:l = 2:1:1
(by weight)
mean molecular weight 40,000
ExM-2
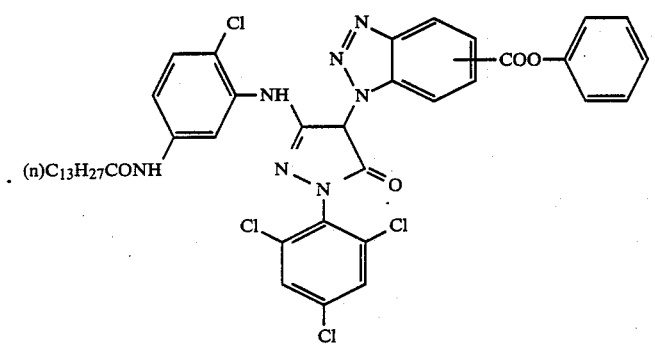

-continued
ExM-4
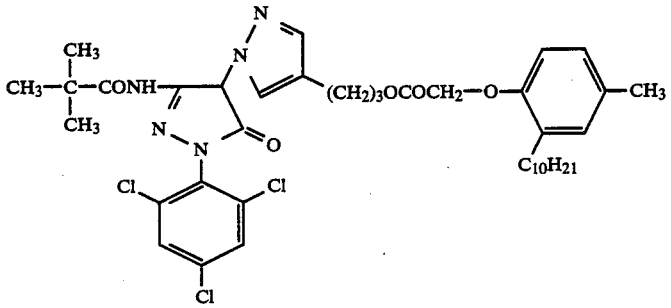
ExM-5
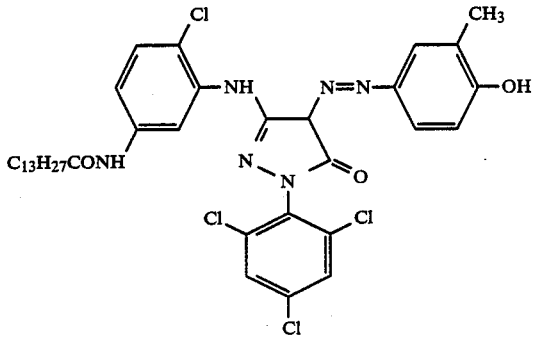
ExY-1
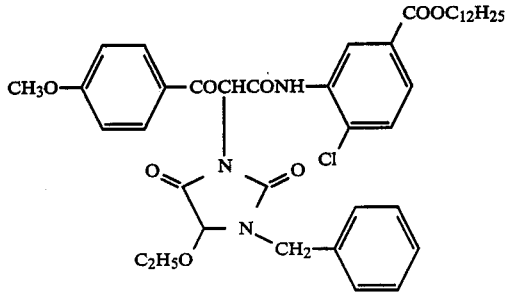
ExY-2
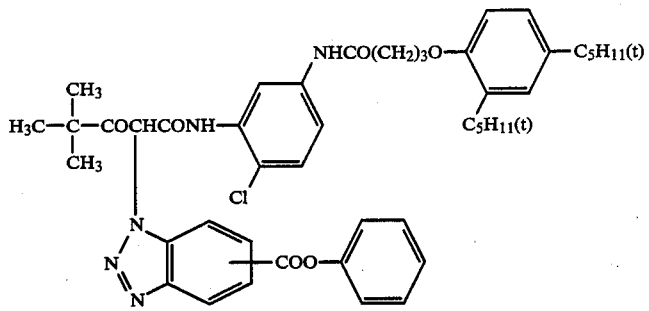
ExS-1
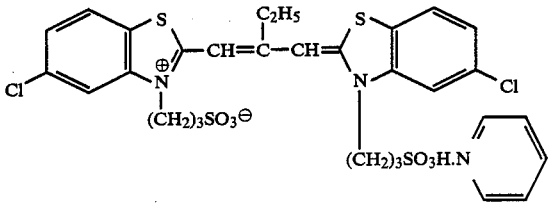
ExS-2
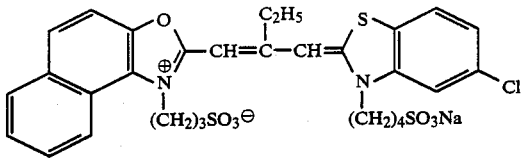

-continued
ExS-3
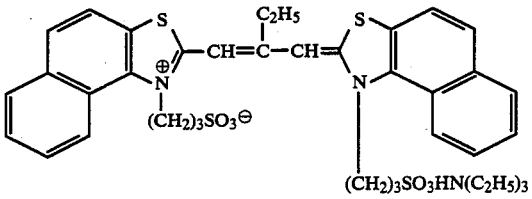
ExS-4
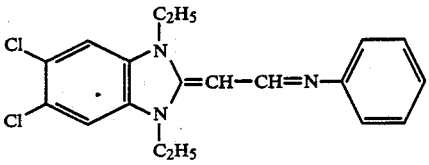
ExS-5
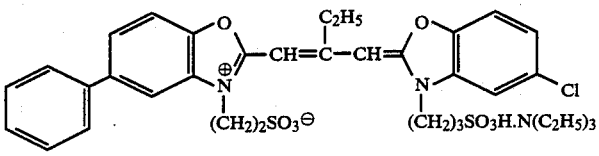
ExS-6
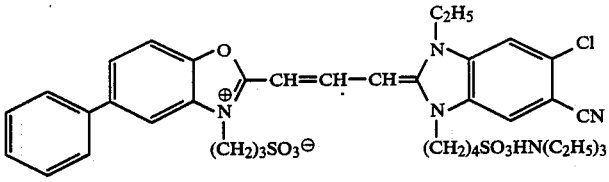
ExS-8
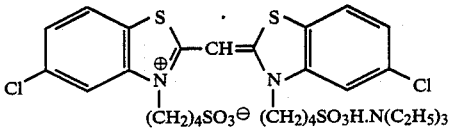
ExS-7
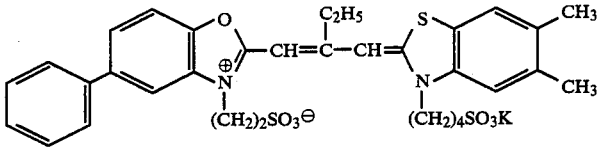
Solv-1
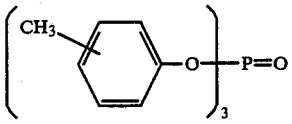
Solv-2
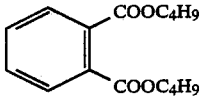
Solv-3
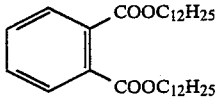
Solv-4
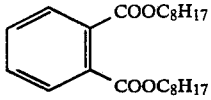

-continued

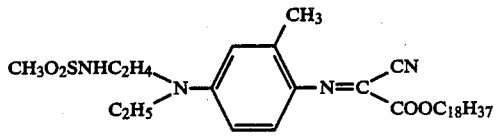

Cpd-1

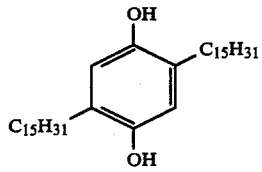

Cpd-2

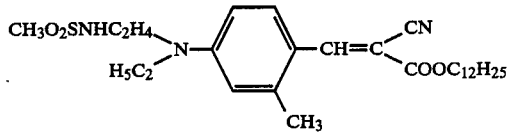

Cpd-3

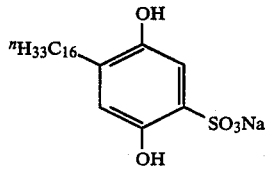

Cpd-4

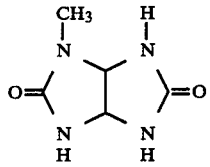

Cpd-5

$C_8F_{17}SO_2NHCH_2CH_2CH_2OCH_2CH_2N^{\oplus}(CH_3)_3$

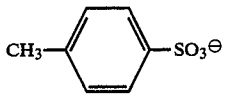

W-1

$CH_2{=}CHSO_2CH_2CONH{-}CH_2$
$CH_2{-}CHSO_2CH_2CONH{-}CH_2$

H-1

The sample thus prepared (Sample B) was processed in the same manner as No. 7 in Example 1, and it was proved to have the same excellent photographic property.

EXAMPLE 3

A multilayer color photographic material (Sample C) was prepared by forming the layers having the compositions shown below on a subbing layer-coated cellulose triacetate film support.

The compositions of the layers were as follows. The amount coated was expressed by the amount of Ag ($g/m^2$) for silver halide and colloidal silver. The amount of coupler, additive and gelatin as coated was expressed by the unit of $g/m^2$. The amount of sensitizing dye as coated was expressed by the molar number per mol of the silver halide in the same layer.

| | |
|---|---|
| **First Layer: Antihalation Layer** | |
| Black Colloidal Silver | 0.18 as Ag |
| Gelation | 0.40 |
| **Second Layer: Interlayer** | |
| 2,5-Di-t-pentadecylhydroquinone | 0.18 |

-continued

| | |
|---|---|
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| **Third Layer: First Red-Sensitive Emulsion Layer** | |
| Monodispersed Silver Iodobromide Emulsion (AgI, 6 mol %; mean grain size, 0.6 μm; variation coefficient of grain size, 15%) | 0.55 as Ag |
| Sensitizing Dye I | $6.9 \times 10^{-5}$ |
| Sensitizing Dye II | $1.8 \times 10^{-5}$ |
| Sensitizing Dye III | 3.1 33 $10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| **Fourth Layer: Second Red-Sensitive Emulsion Layer** | |
| Tabular Silver Iodobromide Emulsion (AgI, 10 mol %; mean grain size, 0.7 μm; | 1.0 as Ag |

-continued

| | |
|---|---|
| mean aspect ratio, 5.5; mean thickness, 0.2 μm) | |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Fifth Layer: Third Red-Sensitive Emulsion Layer | |
| Silver Iodobromide Emulsion (AgI, 16 mol %; mean grain size, 1.1 μm) | 1.60 as Ag |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Sixth Layer: Interlayer | |
| EX-5 | 0.040 |
| HBS-1 | 0.020 |
| EX-12 | 0.004 |
| Gelatin | 0.80 |
| Seventh Layer: First Green-Sensitive Emulsion Layer | |
| Tabular Silver Iodobromide Emulsion (AgI, 6 mol %; mean grain size, 0.6 μm; mean aspect ratio, 6.0; mean thickness, 0.15 μm) | 0.40 as Ag |
| Sensitizing Dye V | $3.0 \times 10^{-5}$ |
| Sensitizing Dye Vi | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Eighth Layer: Second Green-Sensitive Emulsion Layer | |
| Monopdispersed Silver Iodobromide Emulsion (AgI, 9 mol %; mean grain size, 0.7 μm; variation coefficient of grain size, 18%) | 0.80 as Ag |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Ninth Layer: Third Green-Sensitive Emulsion Layer | |
| Silver Iodobromide Emulsion (AgI, 12 mol %; mean grain size, 1.0 μm) | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 1.74 |
| Tenth Layer: Yellow Filter Layer | |
| Yellow Colloidal Silver | 0.05 as Ag |
| EX-5 | 0.08 |
| HBS-3 | 0.03 |
| Gelatin | 0.95 |
| Eleventh Layer: First Blue-Sensitive Emulsion Layer | |
| Tabular Silver Iodobromide Emulsion (AgI, 6 mol %; mean grain size, 0.6 μm; mean aspect ratio, 5.7; mean thickness, 0.15 μm) | 0.24 as Ag |
| Sensitizing Dye III | $3.5 \times 10^{-4}$ |
| EX-9 | 0.85 |
| EX-8 | 0.12 |
| HBS-1 | 0.28 |
| Gelatin | 1.28 |
| Twelfth Layer: Second Blue-Sensitive Emulsion Layer | |
| Monodispersed Silver Iodobromide Emulsion (AgI, 10 mol %; mean grain size, 0.8 μm; variation coefficient of grain size, 16%) | 0.45 as Ag |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-Sensitive Emulsion Layer | |
| Silver Iodobromide Emulsion (AgI, 14 mol %; mean grain size, 1.3 μm) | 0.77 as Ag |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver Iodobromide Emulsion (AgI, 1 mol %; mean grain size, 0.07 μm) | 0.5 as Ag |
| U-4 | 0.11 |
| U-5 | 0.17 |
| HBS-1 | 0.90 |
| Gelatin | 1.00 |
| Fifteenth Layer: Second Protective Layer | |
| Polymethyl Acrylate Grains (diameter, about 1.5 μm) | 0.54 |
| S-1 | 0.15 |
| S-2 | 0.05 |
| Gelatin | 0.72 |

The respective layers contained Gelatin Hardening Agent H-1 and a surfactant in addition to the above-mentioned components.

The compounds used were as follows.

| | |
|---|---|
| U-1: | Same as UV-1 in Example 1 |
| U-2: | Same as UV-2 in Example 1 |
| U-3: | Same as UV-3 in Example 1 |
| U-4: | Same as UV-4 in Example 1 |
| U-5: | Same as UV-5 in Example 1 |
| EX-1: | Same as ExC-9 in Example 1 |
| EX-2: | Same as ExC-2 in Example 1 |
| EX-3: | Same as ExC-4 in Example 1 |
| EX-4: | Same as ExC-7 in Example 1 |
| EX-5: | Same as Cpd-1 in Example 1 |
| EX-6: | Same as ExC-8 in Example 1, provided that this had a mean molecular weight of 30,000 |
| EX-7: | Same as ExM-12 in Example 1 |
| EX-8: | Same as ExY-13 in Example 1 |
| EX-9: | Same as ExY-15 in Example 1 |
| EX-10: | Same as ExC-16 in Example 1, provided that R = $SCH(CH_3)COOCH_3$ |
| EX-11: | Same as ExC-9 in Example 1, provided that R = H |
| EX-12: | 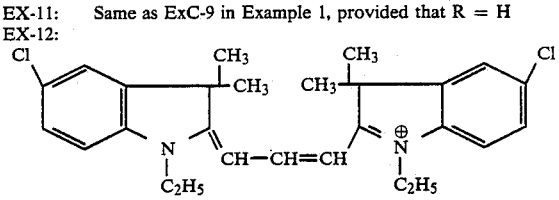 |

S-1: Same as Cpd-5 in Example 1

S-2: Same as Cpd-6 in Example 1
HBS-1: Tricresyl Phosphate
HBS-2: Dibutyl Phthalate
HBS-3: Bis(2-ethylhexyl) Phthalate
HBS-4: Same as Solv-4 in Example 1
H-1: Same as H-1 in Example 1
Sensitizing Dyes:
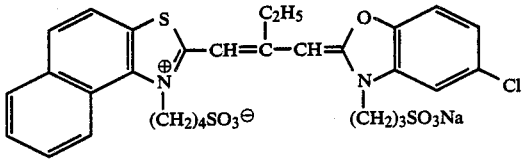
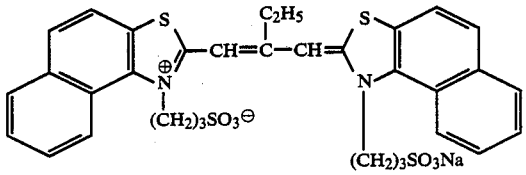
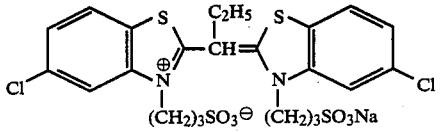
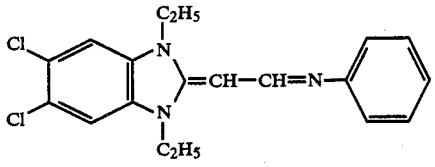
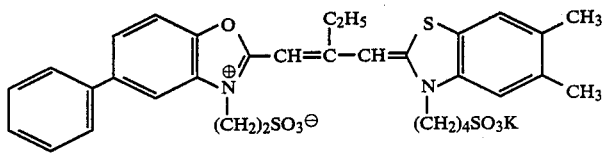
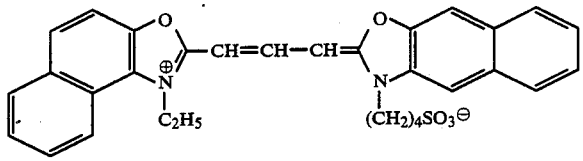
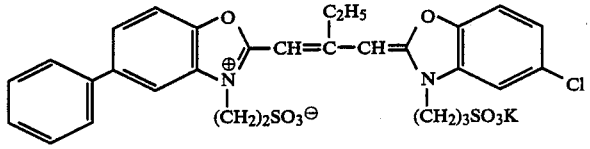
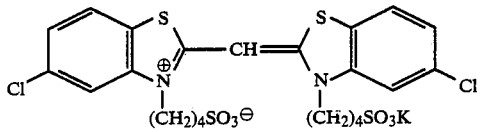
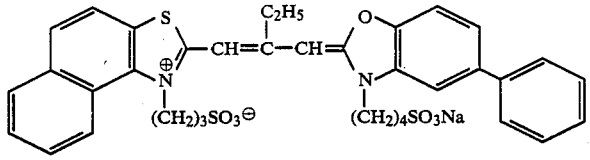

The thus prepared Sample C was subjected to the running test comprising the following processing steps in accordance with the same manner as that in Example 1.

Processing Procedure:

Processing Procedure:

| Step | Processing Time | Temperature (°C.) | Amount of Replenisher (per m of 35 mm wide sample) (ml) |
|---|---|---|---|
| Color Development | 2 min 30 sec | 40 | 40 |
| Bleaching | 30 sec | 38 | 20 |
| Bleach-Fixing | 1 min | 38 | 40 |
| Rinsing in Water | 1 min | 38 | 30 |
| Stabilization | 30 sec | 38 | 30 |
| Drying | 1 min | 60 | |

The processing solutions used in the abovementioned steps were as follows.

Color Developer: Same as that used in Example 1.

| | Tank Solution | Replenisher |
|---|---|---|
| Bleaching Solution: | | |
| Ammonium (Ethylenediaminetetraacetato) Iron (III) Dihydrate | 30.0 g | 45 g |
| (Aminopolycarboxylato) Iron (III) Complex | 0.22 mol | 0.30 mol |
| Bleaching Accelerator (same as used in Example 1) | 1.5 g | 3.0 g |
| Disodium Ethylenediaminetetraacetate | 10.0 g | 10.0 g |
| Ammonium Bromide | 100.0 g | 160.0 g |
| Ammonium Nitrate | 10.0 g | 10.0 g |
| Aqueous Ammonia (27 wt %) | 15.0 ml | 10.0 ml |
| Water to make | 1.0 l | 1.0 l |
| pH | 5.0 | 4.5 |
| Bleach-Fixing Solution: | | |
| Ammonium (Ethylenediaminetetraacetato) Iron (III) Dihydrate | 50.0 g | 70.0 g |
| Chelating Agent (see Table 2) | | |
| Sodium Sulfite | 12.0 g | 17.0 g |

-continued

| | Tank Solution | Replenisher |
|---|---|---|
| Aqueous Ammonium Thiosulfate Solution (70% w/v) | 240.0 ml | 300.0 ml |
| Aqueous Ammonia (27 wt %) | 6.0 ml | 4.0 ml |
| Water to make | 1.0 l | 1.0 l |
| pH | 7.2 | 7.0 |

Rinsing Water:

City water was passed through a mixed bed column filled with an H-type strong acidic cation exchange resin (Amberlite IR-120B, produced by Rohm & Haas Co.) and an OH-type anion exchange resin (Amberlite IR-400, produced by Rohm & Haas Co.) so that the calcium and magnesium concentration was lowered to 3 mg/liter or less, and 20 mg/liter of sodium dichloroisocyanurate and 0.15 g/liter of sodium sulfate were added thereto. The resulting solution had a pH of from 6.5 to 7.5.

III

| Stabilizing Solution: | |
|---|---|
| Formalin (37 wt %) | 2.0 ml |
| Polyoxyethylene-p-monononylphenyl Ether (mean polymerization degree, 10) | 0.3 g |
| Disodium Ethylenediaminetetraacetate | 0.05 g |
| Water to make | 1.0 liter |
| pH | 5.0 to 8.0 |

Sample C was exposed with 20 CMS light through a wedge and then processed by the abovementioned running procedure. The amount of silver remaining in the processed sample having a maximum density was determined. The bleaching solution was stored at 40° C. until the formation of precipitates therein, and the number of the days before the precipitation was determined.

The sample processed was stored under 60° C. and 70% RH for 1 week, and the increase of the minimum magenta density (ΔDGmin are determined with a Macbeth densitometer. VI The results obtained are shown in Table 2 below.

TABLE 2

| No. | (Aminopolycarboxylato)-Iron (III) Complex | Fixing Solution: Chelating Agent | Fixing Solution: Amount* Added (mol/l) | Remarks | Results: Amount of Silver Remaining (μg/cm²) | Results: Time (day) | Results: ΔDG min |
|---|---|---|---|---|---|---|---|
| 1 | Ammonium (Ethylenediaminetetraacetato) Iron (III) | (57) | 0.02 | Comparison | 28 | 25 | +0.13 |
| 2 | Ammonium (1,3-Diaminopropanetetraacetato) Iron (III) | — | — | " | 5 | 4 | +0.11 |
| 3 | Ammonium (1,3-Diaminopropanetetraacetato) Iron (III) | Ethylenediaminetetraacetic Acid | 0.02 | " | 5 | 5 | +0.10 |
| 4 | Ammonium (1,3-Diaminopropanetetraacetato) Iron (III) | Ethylenediaminetetraacetic Acid | 0.05 | " | 5 | 10 | +0.08 |
| 5 | Ammonium (1,3-Diaminopropanetetraacetato) Iron (III) | Ethylenediaminetetraacetic Acid | 0.10 | " | 6 | 12 | +0.08 |
| 6 | Ammonium (1,3-Diaminopropanetetraacetato) Iron (III) | (57) | 0.02 | Invention | 5 | 30 | +0.04 |
| 7 | Ammonium (1,3-Diaminopropanetetraacetato) Iron (III) | (57) | 0.05 | " | 5 | 35 | +0.03 |
| 8 | Ammonium (1,3-Diaminopropanetetraacetato) Iron (III) | (25) | 0.02 | " | 5 | 27 | +0.05 |
| 9 | Ammonium (1,3-Diaminopropanetetraacetato) Iron (III) | (25) | 0.05 | " | 5 | 31 | +0.03 |

TABLE 2-continued

| No. | (Aminopolycarboxylato)-Iron (III) Complex | Fixing Solution: Chelating Agent | Fixing Solution: Amount* Added (mol/l) | Remarks | Results: Amount of Silver Remaining ($\mu g/cm^2$) | Results: Time (day) | Results: ΔDG min |
|---|---|---|---|---|---|---|---|
| | (68) | 0.02 | " | 5 | 29 | +0.05 | |
| Ammonium (1,3-Diaminopropane-tetraacetato) Iron (III) | | | | | | | |
| 11 | Ammonium (1,3-Diaminopropane-tetraacetato) Iron (III) | (68) | 0.05 | " | 5 | 33 | +0.03 |
| 12 | Ammonium (1,4-Diaminobutane-tetraacetato) Iron (III) | (25) | 0.05 | " | 7 | 30 | +0.05 |
| 13 | Ammonium (1,4-Diaminobutane-tetraacetato) Iron (III) | (57) | 0.05 | " | 7 | 33 | +0.03 |
| 14 | Ammonium (1-4-Diaminobutane-tetraacetato) Iron (III) | (68) | 0.05 | " | 7 | 29 | +0.05 |

*Added to the Tank Solution. An amount of 1.1 times that amount was added to the Replenisher.

As is obvious from the results in Table 2, the desilvering effect was extremely excellent and the stability of the bleach-fixing solution was noticeably improved in accordance with the present invention. Further, the formation of magenta stain in the processed sample was found to be noticeably prevented by the present invention.

EXAMPLE 4

A multilayer color photographic material (Sample D) was prepared by forming the layers having the compositions shown below on a subbing layer-coated cellulose triacetate film support.

The compositions of the layers were as follows. The amount coated was expressed by the amount of Ag ($g/m^2$) for silver halide and colloidal silver. The amount of coupler, additive and gelatin as coated was expressed by the unit of $g/m^2$. The amount of sensitizing dye as coated was expressed by the molar number per mol of the silver halide in the same layer.

| | |
|---|---|
| First Layer: Antihalation Layer | |
| Black Colloidal Silver | 0.2 |
| Gelatin | 1.0 |
| Ultraviolet Absorber UV-1 | 0.05 |
| Ultraviolet Absorber UV-2 | 0.1 |
| Ultraviolet Absorber UV-3 | 0.1 |
| Dispersing Oil OIL-1 | 0.02 |
| Second Layer: Interlayer | |
| Fine Silver Bromide Grains (mean grain size, 0.07 μm) | 0.15 |
| Gelatin | 1.0 |
| Third Layer: First Red-Sensitive Emulsion Layer | |
| Emulsion A* | 1.42 |
| Gelatin | 0.9 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| Fourth Layer: Interlayer | |
| Gelatin | 0.8 |
| Cp-b | 0.10 |
| HBS-1 | 0.05 |
| Fifth Layer: Second Red-Sensitive Emulsion Layer | |
| Emulsion A* (same as defined before, | 1.38 |

-continued

| | |
|---|---|
| except AgI 7 mol %) | |
| Gelatin | 1.0 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| Sixth Layer: Third Red-Sensitive Emulsion Layer | |
| Emulsion E** | 2.08 |
| Gelatin | 1.5 |
| Cp-a | 0.060 |
| Cp-c | 0.024 |
| Cp-d | 0.038 |
| D-1 | 0.006 |
| HBS-1 | 0.12 |
| Seventh Layer: Interlayer | |
| Gelatin | 1.0 |
| Cp-a | 0.05 |
| HBS-2 | 0.05 |
| Eighth Layer: First Green-Sensitive Emulsion Layer | |
| Monodispersed Silver Iodobromide Emulsion (AgI, 3 mol %; mean grain size, 0.4 μm; variation coefficient, 19%) | 0.64 |
| Monodispersed Silver Iodobromide Emulsion (AgI, 6 mol %; mean grain size, 0.7 μm; variation coefficient, 18%) | 1.12 |
| Gelatin | 1.0 |
| Sensitizing Dye D | $1 \times 10^{-4}$ |
| Sensitizing Dye E | $4 \times 10^{-4}$ |
| Sensitizing Dye F | $1 \times 10^{-4}$ |
| Cp-h | 0.20 |
| Cp-f | 0.61 |
| Cp-g | 0.084 |
| Cp-k | 0.035 |
| Cp-l | 0.036 |
| D-3 | 0.041 |
| D-4 | 0.018 |
| HBS-1 | 0.25 |
| HBS-2 | 0.45 |
| Ninth Layer Second Green-Sensitive Emulsion Layer | |
| Monodispersed Silver Iodobromide Emulsion (AgI, 7 mol %; mean grain size, 1.0 μm; variation coefficient, 18%) | 2.07 |
| Gelatin | 1.5 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Cp-f | 0.007 |
| Cp-h | 0.012 |
| Cp-g | 0.009 |
| HBS-2 | 0.088 |

-continued

| | |
|---|---|
| Tenth Layer: Interlayer | |
| Yellow Colloidal Silver | 0.06 |
| Gelatin | 1.2 |
| Cp-a | 0.3 |
| HBS-1 | 0.3 |
| Eleventh Layer: First Blue-Sensitive Emulsion Layer | |
| Monodispersed Silver Iodobromide Emulsion (AgI, 6 mol %; mean grain size, 0.4 μm; variation coefficient, 20% | 0.31 |
| Monodispersed Silver Iodobromide Emulsion (AgI, 5 mol %; mean grain size, 0.9 μm; variation coefficient, 17%) | 0.38 |
| Gelatin | 2.0 |
| Sensitizing Dye G | $1 \times 10^{-4}$ |
| Sensitizing Dye H | $1 \times 10^{-4}$ |
| Cp-i | 0.63 |
| Cp-j | 0.57 |
| D-1 | 0.020 |
| D-4 | 0.015 |
| HBS-1 | 0.05 |
| Twelfth Layer: Second Blue-Sensitive Emulsion Layer | |
| Monodispersed Silver Iodobromide Emulsion (AgI, 8 mol %; mean grain size, 1.3 μm; variation coefficient, 18%) | 0.77 |
| Gelatin | 0.5 |
| Sensitizing Dye G | $5 \times 10^{-4}$ |
| Sensitizing Dye H | $5 \times 10^{-4}$ |
| Cp-i | 0.10 |
| Cp-j | 0.10 |

-continued

| | |
|---|---|
| D-4 | 0.005 |
| HBS-2 | 0.10 |
| Thirteenth Layer: Interlayer | |
| Gelatin | 0.5 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| Fourteenth Layer: Protective Layer | |
| Monodispersed Silver Iodobromide Emulsion (AgI, 4 mol %; mean grain size, 0.05 μm; variation coefficient, 10%) | 0.1 |
| Gelatin | 1.5 |
| Polymethyl Methacrylate Grains (mean grain size, 1.5 μm) | 0.1 |
| S-1 | 0.2 |
| S-2 | 0.2 |

*Monodispersed Silver Iodobromide Emulsion (AgI 6 mol %, mean grain size 0.4 μm, variation coefficient 15%)

**Monodispersed Silver Iodobromide Emulsion (AgI 7 mol %, mean grain size 1.1 μm, variation coefficient 16%)

In addition, Surfactant K-1 and Gelatin Hardening Agent H-1 were added to the respective layers.

The compounds used in formation of the aforesaid layers were as follows.

Sensitizing Dyes:

A

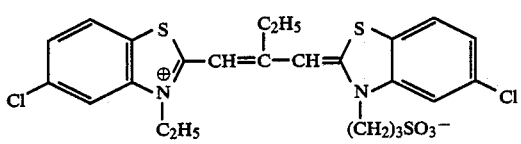

B

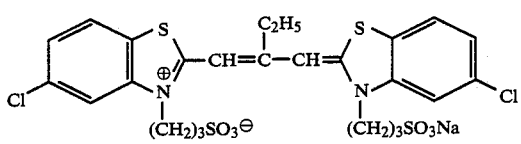

C

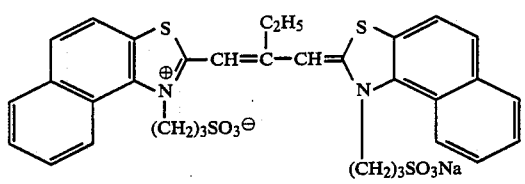

D

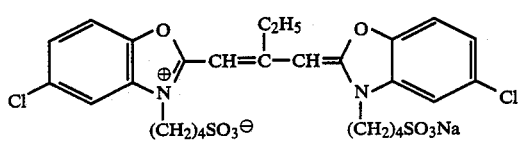

E

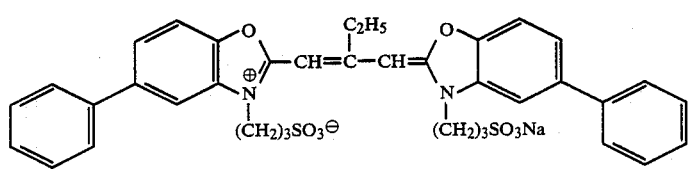

F

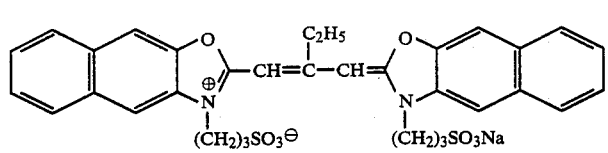

-continued
G
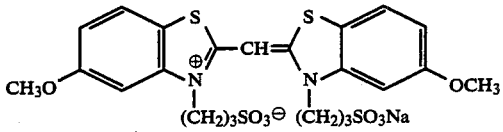
H
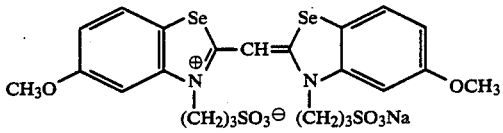
Compounds.
D-1
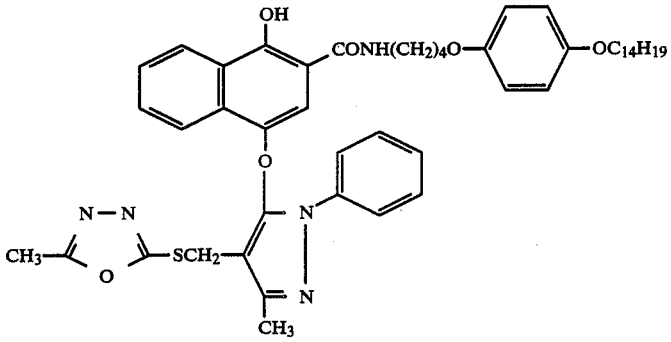
D-2
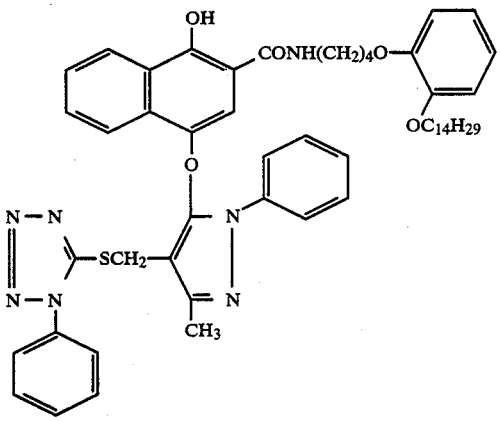
D-3
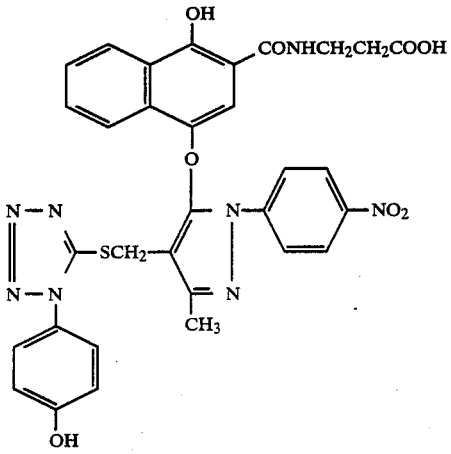

-continued
D-4
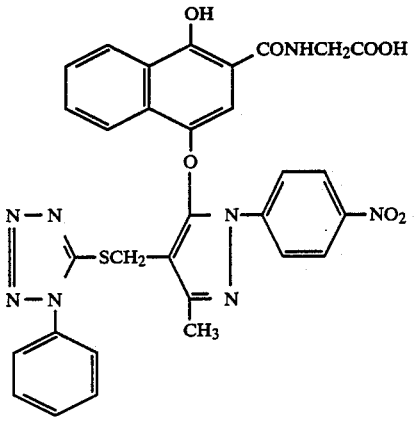
D-5
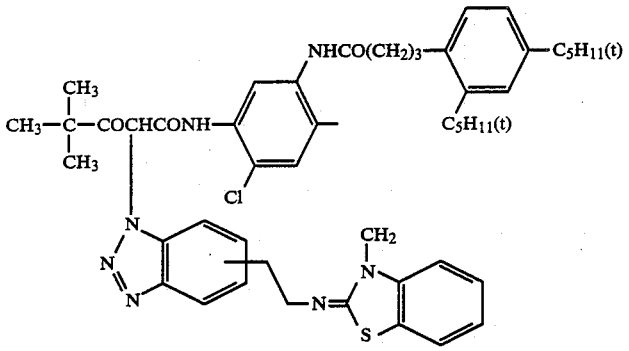
OIL-1
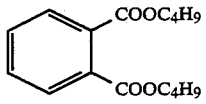
Cp-a
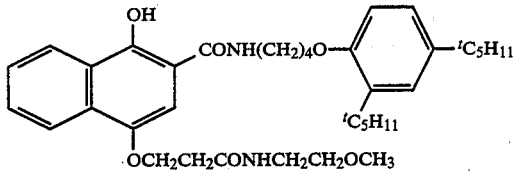
Cp-b
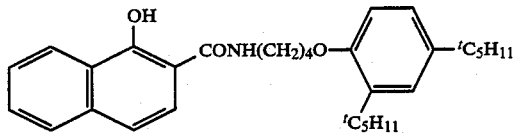
Cp-c
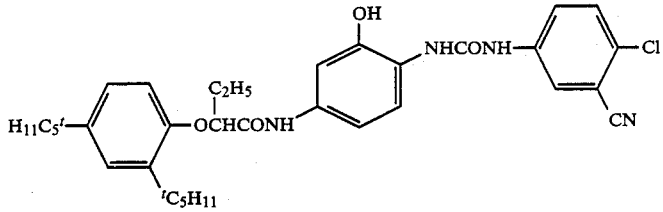

-continued
Cp-d
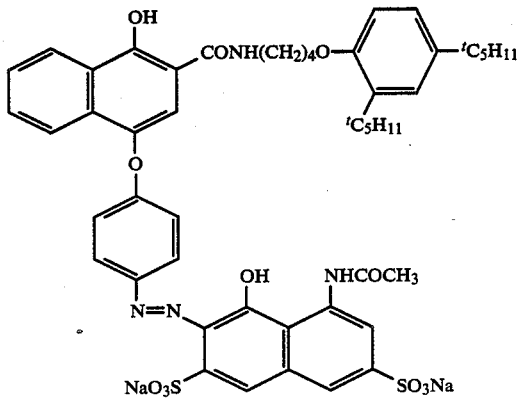
Cp-e
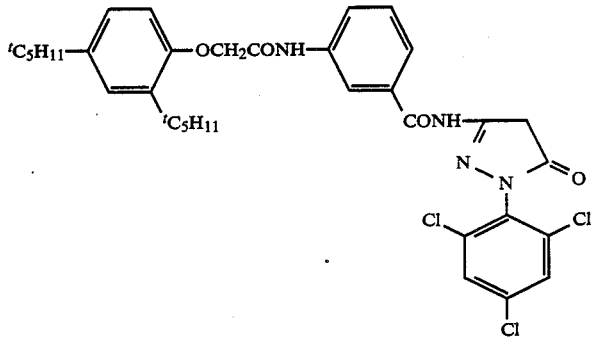
Cp-f
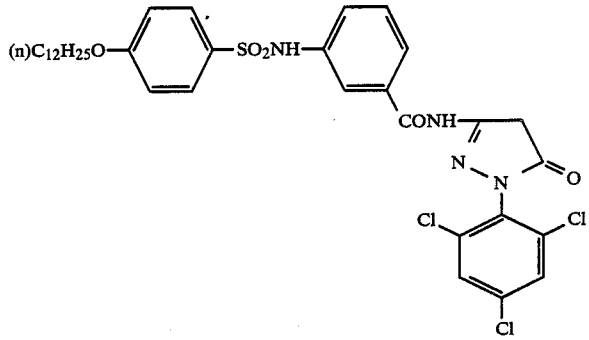
Cp-g
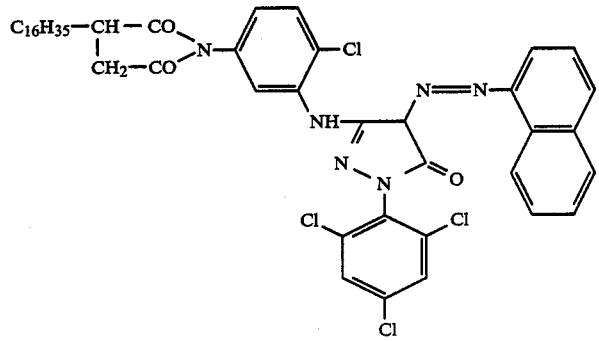
Cp-h
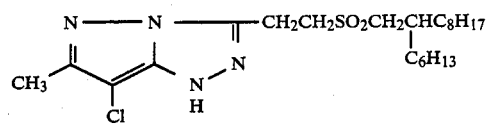

-continued
Cp-i
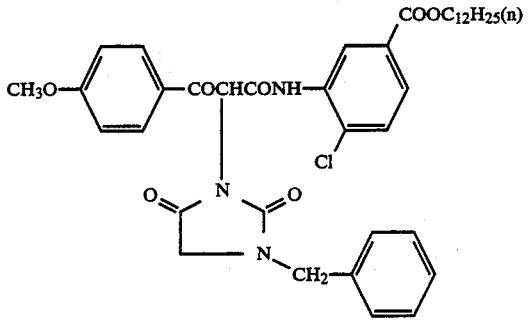
Cp-j
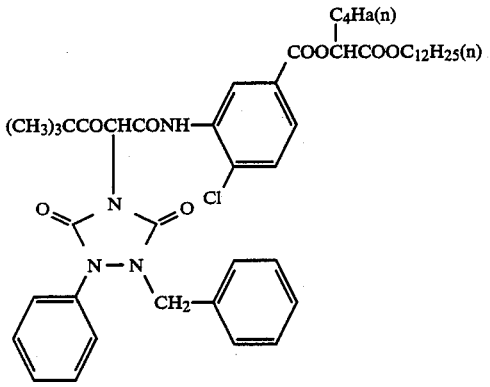
Cp-k
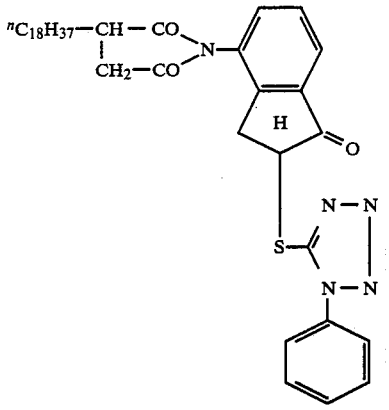
Cp-l
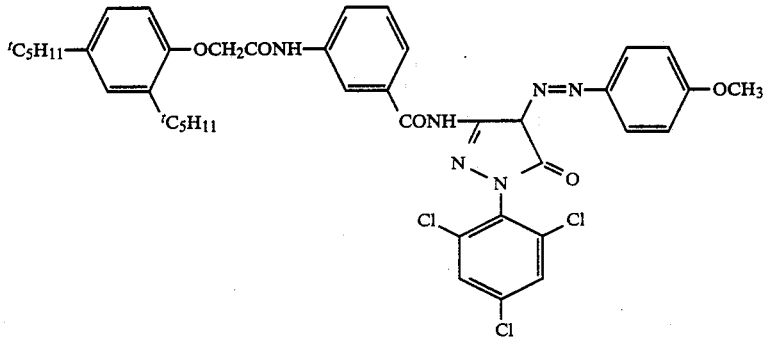

-continued
Cp-m
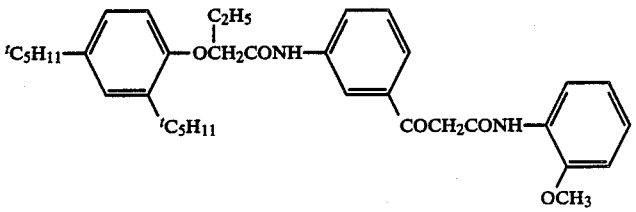
HBS-1
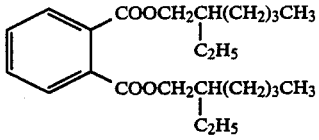
HBS-2
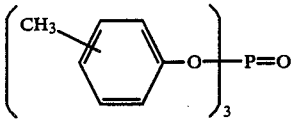
K-1
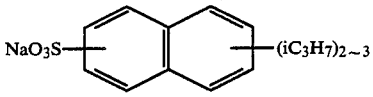
S-1
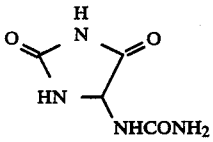
S-2
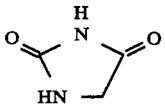
UV-1
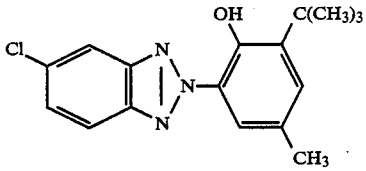
UV-2
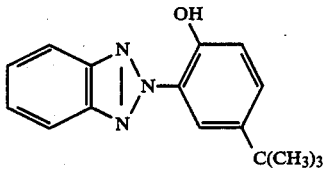
UV-3
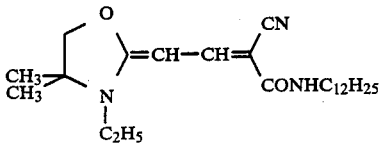
Cpd A
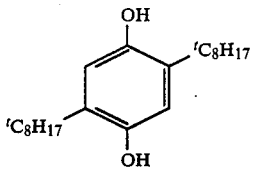

-continued

H-1

$$CH_2{=}CH{-}SO_2{-}CH_2$$
$$\quad\quad\quad\quad\quad\quad |$$
$$CH_2{=}CH{-}SO_2{-}CH_2$$

The thus prepared sample D was subjected to the running test comprising the following processing steps, in accordance with the same manner as that in Example 1.

| | Processing Procedure: | | |
|---|---|---|---|
| Step | Processing Time | Temperature (°C.) | Amount of Replenisher (per m of 35 mm wide sample) (ml) |
| Color Development | 3 min 15 sec | 38 | 38 |
| Bleaching | 45 sec | 38 | 5 |
| Fixing | 1 min 15 sec | 38 | 30 |
| Stabilization (1) | 20 sec | 38 | — |
| Stabilization (2) | 20 sec | 38 | — |
| Stabilization (3) | 20 sec | 38 | 35* |
| Drying | 1 min 15 sec | 50 to 70 | — |

*Stabilization was carried out by a three-tank countercurrent system from stabilizing bath (3) to stabilizing bath (1). The bleaching bath was equipped with a jet stream type stirring system (as described in JP-A-62-183640), whereby the bleaching solution was jetted out to the surface of the photographic material sample being processed.

The processing solutions used in the steps were as follows.

| | Tank Solution | Replenisher |
|---|---|---|
| Color Developer: | | |
| 1-Hydroxyethylidene-1,1-diphosphonic Acid (60 wt %) | 3.0 g | 3.0 g |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-[N-Ethyl-N-β-hydroxyethylamino]-2-methylaniline Sulfate | 4.7 g | 5.3 g |
| Water to make | 1.0 l | 1.0 l |
| pH | 10.00 | 10.05 |
| Bleaching Solution: | | |
| Ammonium (Ethylenediaminetetraacetato)Iron(III) Dihydrate | 20.0 g | 30 g |

-continued

| | Tank Solution | Replenisher |
|---|---|---|
| (Aminopolycarboxylato)Iron(III) Complex (see Table 3) | 0.20 mol | 0.25 mol |
| Bleaching Accelerator* | 1.0 g | 2.0 g |
| Ethylenediaminetetraacetic Acid | 4.0 g | 5.0 g |
| Ammonium Bromide | 100.0 g | 160.0 g |
| Ammonium Nitrate | 30.0 g | 50.0 g |
| Aqueous Ammonia (27 wt %) | 20.0 ml | 23.0 ml |
| Acetic Acid (98 wt %) | 11.0 ml | 19.0 ml |
| Water to make | 1.0 l | 1.0 l |
| pH | 5.0 | 4.5 |

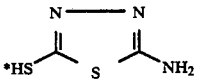

| | | |
|---|---|---|
| Fixing Solution: | | |
| Chelating Agent (see Table 3) | See Table 3 | |
| Ammonium Alum | 5.0 g | 5.0 g |
| Ammonium Sulfite | 10.0 g | 15.0 g |
| p-Toluenesulfinic Acid | 10.0 g | 15.0 g |
| Aqueous Ammonium Thiosulfate Solution (70% w/v) | 200.0 ml | 230.0 ml |
| Water to make | 1.0 liter | 1.0 liter |
| pH | 7.0 | 6.8 |
| Stabilizing Solution: | | |
| Tank solution and replenisher were the same. | | |
| Formalin (37 wt %) | 1.2 ml | |
| 5-Chloro-2-methyl-4-isothiazolin-3-one | 6.0 mg | |
| 2-Methyl-4-isothiazolin-3-one | 3.0 mg | |
| Surfactant | 0.4 g | |
| $[C_{10}H_{21}{-}O{-}(CH_2CH_2O)_{10}{-}H]$ | | |
| Ethylene Glycol | 1.0 g | |
| Water to make | 1.0 liter | |
| pH | 5.0 to 7.0 | |

The above-mentioned sample was exposed with 20 CMS light and then processed with the running equilibrated solutions, and the amount of the silver remaining was determined by the fluorescent X-ray method. The fixing solution and the stabilizing solution (1) were stored at 40° C. until formation of precipitates therein, and the number of the days before the precipitation was determined for the respective solution.

The results obtained were shown in Table 3 below.

TABLE 3

| | | Fixing Solution | | | Results | | |
|---|---|---|---|---|---|---|---|
| No. | (Aminopolycarboxylato)-Iron (III) Complex | Chelating Agent | Amount* Added (mol/l) | Remarks | Amount of Ag Remaining (μg/cm²) | Fixing Solution (day) | Stabilizing Solution (1) (day) |
| 1 | Ammonium (Ethylenediamine-tetraacetato) Iron (III) | (57) | 0.02 | Comparison | 20 | 45 | 31 |
| 2 | Ammonium (1,3-Diaminopropane-tetraacetato) Iron (III) | — | — | " | 3 | 13 | 3 |
| 3 | " | Ethylenediamine-tetraacetic Acid | 0.02 | " | 3 | 15 | 4 |
| 4 | " | " | 0.05 | " | 3 | 20 | 10 |
| 5 | " | " | 0.10 | " | 3 | 21 | 10 |
| 6 | " | (3) | 0.03 | Invention | 4 | 41 | 28 |
| 7 | " | (5) | " | " | 4 | 40 | 29 |
| 8 | " | (12) | " | " | 4 | 41 | 30 |
| 9 | " | (16) | " | " | 4 | 42 | 30 |
| 10 | " | (25) | " | " | 3 | 45 | 33 |
| 11 | " | (30) | " | " | 3 | 41 | 31 |
| 12 | " | (50) | " | " | 3 | 43 | 31 |
| 13 | " | (57) | " | " | 3 | 48 | 35 |

TABLE 3-continued

| No. | (Aminopolycarboxylato)-Iron (III) Complex | Fixing Solution: Chelating Agent | Fixing Solution: Amount* Added (mol/l) | Remarks | Results: Amount of Ag Remaining ($\mu g/cm^2$) | Results: Fixing Solution (day) | Results: Stabilizing Solution (1) (day) |
|---|---|---|---|---|---|---|---|
| 14 | " | (68) | " | " | 3 | 46 | 35 |

*Amount added to the Tank Solution. An amount of 1.1 times that amount was added to the replenisher.

As is obvious from the results in Table 3 above, the desilvering speed was extremely high and the stability of both the fixing solution and the stabilizing solution was extremely improved in accordance with the present invention.

EXAMPLE 5

Sample D was prepared in Example 4 was processed in accordance with Test No. 13 of Example 4, except that the bleaching accelerator was varied to the following (a), (b), (c), (d), (e) or (f). The same excellent results was attained in all the cases tested.

(a)

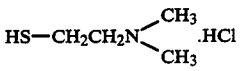

(b)

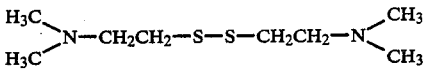

(c)

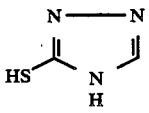

(d)

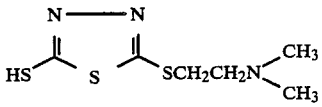

(e)

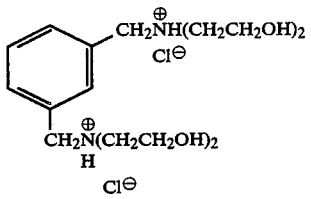

(f)

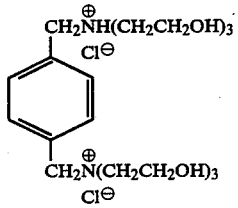

EXAMPLE 6

Sample D prepared in Example 4 was imagewise exposed and then processed by the following continuous procedure (running test) until the amount of the replenisher added became two times of the capacity of the color developer tank. In carrying out the process, the compositions of the bleaching solution and the fixing solution were varied as indicated in Table 4 below.

For processing, an automatic developing machine prepared by modifying Fuji Color Negative Processor EP500 was used.

In the process, the belt conveyance system described in JP-A-No. 60-191257 was employed, and the jet stream-stirring system described in JP-A-No. 62-183460 was applied to the respective processing baths.

Processing Procedure:

| Step | Processing Time | Temperature (°C.) | Amount of Replenisher (per m of 35 mm wide sample) (ml) |
|---|---|---|---|
| Color Development | 1 min 15 sec | 38 | 38 |
| Bleaching | 1 min | 38 | 4 |
| Fixing | 1 min 15 sec | 38 | 30 |
| Stabilization (1) | 20 sec | 38 | — |
| Stabilization (2) | 20 sec | 38 | — |
| Stabilization (3) | 20 sec | 38 | 35* |
| Drying | 1 min | 50 to 70 | — |

*Stabilization was carried out by a three-tank countercurrent system for the stabilizing bath (3) to the stabilizing bath (1).

The compositions of the processing solutions used were as follows.

| | Tank Solution | Replenisher |
|---|---|---|
| Color Developer: | | |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-[N-Ethyl-N-β-hydroxyethylamino-]-2-methylaniline Sulfate | 4.7 g | 5.3 g |
| Water to make | 1.0 l | 1.0 l |
| pH | 10.00 | 10.05 |
| Bleaching Solution: | | |
| Ammonium (Ethylenediaminetetraacetato)Iron(III) Dihydrate (EDTA.FeNH4) | See Table 4 | |
| Ammonium (1,3-Diaminopropanetetraacetato)Iron(III) (1,3-DPTA.FeNH4) | See Table 4 | |
| Bleaching Accelerator* | 4.0 g | 5.0 g |
| Ammonium Bromide | 100.0 g | 160.0 g |
| Ammonium Nitrate | 30.0 g | 50.0 g |
| Ethylenediaminetetraacetic Acid | 5.0 g | 5.0 g |
| Aqueous Ammonia (27 wt %) | 20.0 ml | 23.0 ml |
| Acetic Acid (98 wt %) | 9.0 ml | 15.0 ml |
| Water to make | 1.0 l | 1.0 l |
| pH | 4.5 | 4.0 |

*

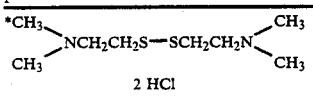

The sum of the amounts of EDTA.FeNH4 and 1,3-DPTA.FeNH4 added was 0.2 mol (in the tank solution) and 0.3 mol (in the replenisher).

Fixing Solution:

-continued

The following solutions (A) to (F) were used.

| | Tank Solution | Replenisher |
|---|---|---|
| 1-Hydroxyethylidene-1,1-diphosphonic Acid (60 wt %) | 5.0 g | 6.0 g |
| Sodium Sulfite | (see Table below) | |
| Ammonium Sulfite | (see Table below) | |
| Aqueous Ammonium Thiosulfate | 170.0 ml | 200.0 ml |

immediately after processing. Then the sample processed was allowed to stand at 60° C. for 20 days, and the minimum magenta density in the sample thus stored was again determined. From the two data thus determined, the increment of the magenta minimum density (ΔDGmin) (stain after storage) was obtained. After completion of the running test, the bleaching solution had a pH value of from 4.1 to 4.2 in the tested cases.

The results are shown in Table 4.

TABLE 4

| Bleaching Solution No. | EDTA.FeNH4/ 1,3-DPTA.FeNH4 | Fixer A (ammonium 82.5%) Amount of Ag (μg/cm²) | ΔDG min After Processing | ΔDG min After Storage | Fixer B (86.9%) Amount of Ag (μg/cm²) | ΔDG min After Processing | ΔDG min After Storage | Fixer C (88.6%) Amount of Ag (μg/cm²) | ΔDG min After Processing | ΔDG min After Storage |
|---|---|---|---|---|---|---|---|---|---|---|
| 1 | 10 | 36 | 0.61 | +0.16 | 35 | 0.61 | +0.16 | 35 | 0.61 | +0.16 |
| 2 | 4 | 22 | 0.62 | +0.14 | 22 | 0.62 | +0.14 | 21 | 0.62 | +0.14 |
| 3 | 3 | 10 | 0.63 | +0.11 | 10 | 0.63 | +0.11 | 9 | 0.63 | +0.11 |
| 4 | 1.5 | 7 | 0.65 | +0.07 | 7 | 0.65 | +0.07 | 7 | 0.65 | +0.07 |
| 5 | 1 | 5 | 0.65 | +0.06 | 5 | 0.65 | +0.06 | 5 | 0.65 | +0.06 |
| 6 | 0.5 | 5 | 0.66 | +0.07 | 5 | 0.66 | +0.07 | 5 | 0.66 | +0.07 |
| 7 | 0 | 5 | 0.67 | +0.08 | 5 | 0.67 | +0.08 | 5 | 0.67 | +0.08 |

| Bleaching Solution No. | Fixer D (91.3%) Amount of Ag (μg/cm²) | ΔDG min After Processing | ΔDG min After Storage | Fixer E (95.6%) Amount of Ag (μg/cm²) | ΔDG min After Processing | ΔDG min After Storage | Fixer F (100.0%) Amount of Ag (μg/cm²) | ΔDG min After Processing | ΔDG min After Storage |
|---|---|---|---|---|---|---|---|---|---|
| 1 | 35 | 0.61 | +0.15 | 35 | 0.61 | +0.15 | 34 | 0.61 | +0.14 |
| 2 | 20 | 0.62 | +0.13 | 20 | 0.62 | +0.13 | 20 | 0.62 | +0.13 |
| 3 | 6 | 0.63 | +0.06 | 4 | 0.63 | +0.04 | 3 | 0.63 | +0.04 |
| 4 | 3 | 0.64 | +0.04 | 2 | 0.64 | +0.02 | 2 | 0.64 | +0.02 |
| 5 | 3 | 0.64 | +0.03 | 2 | 0.64 | +0.02 | 2 | 0.64 | +0.02 |
| 6 | 3 | 0.65 | +0.03 | 2 | 0.65 | +0.02 | 2 | 0.65 | +0.02 |
| 7 | 3 | 0.66 | +0.06 | 2 | 0.66 | +0.03 | 2 | 0.66 | +0.03 |

Solution (70% w/v)

| | Tank Solution | | | Replenisher | | |
|---|---|---|---|---|---|---|
| Water to make | | | | 1.0 l | | 1.0 l |
| pH | | | | 6.7 | | 6.6 |
| Fixer | Sodium Sulfite (mol/l) | Ammonium Sulfite (mol/l) | $NH_4^+$* (%) | Sodium Sulfite (mol/l) | Ammonium Sulfite (mol/l) | $NH_4^+$* (%) |
| A | 0.17 | — | 82.5 | 0.20 | — | 82.5 |
| B | 0.128 | 0.0425 | 86.9 | 0.15 | 0.05 | 86.9 |
| C | 0.111 | 0.0595 | 88.6 | 0.13 | 0.07 | 88.6 |
| D | 0.085 | 0.085 | 91.3 | 0.10 | 0.10 | 91.3 |
| E | 0.0425 | 0.1275 | 95.6 | 0.05 | 0.15 | 85.6 |
| F | — | 0.17 | 100.0 | — | 0.20 | 100.0 |

*mol % of the sum of the alkali metal ion and ammonium ion

Stabilizing Solution:

Tank solution and replenisher were the same.

| | |
|---|---|
| Formalin (37 wt %) | 1.2 ml |
| 5-Chloro-2-methyl-4-isothiazolin-3-one | 6.0 mg |
| 2-Methyl-4-isothiazolin-3-one | 3.0 mg |
| Surfactant | 0.4 g |
| $[C_{10}H_{21}—O—(CH_2CH_2O)_{10}—H]$ | |
| Ethylene Glycol | 1.0 g |
| Water to make | 1.0 liter |
| pH | 5.0 to 7.0 |

Sample D prepared in Example 4 was exposed with 10 CMS light through an optical wedge and then processed with the running-equilibrated processing solutions each having the composition mentioned above.

The amount of silver remaining in the maximum density area of the sample processed was determined by fluorescent X-ray method.

On the other hand, the minimum magenta density (DGmin) (bleaching fog) in the sample was determined, The results in Table 4 above indicate the following matters. When the ratio of (EDTA·FeNH4)/(1,3-DPTA·FeNH4) became smaller, the amount of the silver remaining in the photographic material sample processed became smaller. In particular, the amount of the silver remaining was advantageously small when the fixing solution of the present invention was used (Fixers D, E and F). In addition, formation of magenta stain was noticeably reduced in the samples processed by the method of the present invention. Especially, the effect was remarkable when the bleaching solution No. 4, 5 or 6 was used.

Next, the same experiment was repeated, using bleaching solution No. 5 or 7 and Fixer G, H, I, J, K or L. Fixers G, H, I, J, K and L were the same as Fixers A, B, C, D, E and F, respectively, except that the former did not contain 1-hydroxyethylidene-1,1-diphosphonic acid (60 wt %).

The results obtained are shown in Table 5 below. Comparing the results in Table 4 and those in Table 5, it is noted that incorporation of 1-hydroxyethylidene-1,1-diphosphonic acid (as a chelating agent) into the fixing solution is effective for suppressing the increase of the density in the nonexposed area after storage (ΔDGmin), especially in the case of using a fixing solution containing 90% or more ammonium ion. (Fixers D, E and F were compared with Fixers J, K and L.) However, the effect was small in the case of using a fixing solution containing ammonium in an amount less than 90%. (Fixer A, B and C were compared with Fixers G, H and I.)

TABLE 5

| | Fixer G (ammonium 82.5%) ΔDG min | Fixer H (86.9%) ΔDG min | Fixer I (88.6%) ΔDG min |
|---|---|---|---|

TABLE 5-continued

| Bleaching Solution No. | EDTA.FeNH4/ 1,3-DPTA.FeNH4 | Amount of Ag (μg/cm²) | After Processing | After Storage | Amount of Ag (μg/cm²) | After Processing | After Storage | Amount of Ag (μg/cm²) | After Processing | After Storage |
|---|---|---|---|---|---|---|---|---|---|---|
| 5 | 1 | 5 | 0.65 | +0.07 | 5 | 0.65 | +0.07 | 5 | 0.65 | +0.07 |
| 7 | 0 | 5 | 0.67 | +0.09 | 5 | 0.67 | +0.09 | 5 | 0.67 | +0.09 |

| Bleaching Solution No. | Fixer J (91.3%) Amount of Ag (μg/cm²) | ΔDG min After Processing | ΔDG min After Storage | Fixer K (95.6%) Amount of Ag (μg/cm²) | ΔDG min After Processing | ΔDG min After Storage | Fixer L (100.0%) Amount of Ag (μg/cm²) | ΔDG min After Processing | ΔDG min After Storage |
|---|---|---|---|---|---|---|---|---|---|
| 5 | 3 | 0.64 | +0.06 | 2 | 0.64 | +0.05 | 2 | 0.64 | +0.05 |
| 7 | 3 | 0.66 | +0.08 | 2 | 0.66 | +0.06 | 2 | 0.66 | +0.06 |

EXAMPLE 7

Process No. 5 in Example 6 was repeated by running procedure, where the bleaching solution was varied to (IA)-(5, (IA)-(13), (IA)-(16), (IA)-(19), (IIA)-(11) and (VA)-(1). The amount of the silver remaining in the sample processed as well as the value ΔDGmin were determined in the same manner as in Example 6. The same good result was confirmed in the samples processed by the method of the present invention using Fixer D, E or F.

seventh to ninth layers was replaced by the following magenta couplers.

Sample C-1: PM- 3

Sample C-2: PM- 9

Sample C-3: PM-10

Next, each of Samples C, C-1, C-2 and C-3 was processed with the running-equilibrated solutions (prepared in Example 6), and the amount of the silver remaining in the samples processed and the magenta stain (ΔDGmin) in the samples stored (stain after storage) were determined.

The results obtained are shown in Table 6 below.

TABLE 6

| Test No. | Running Equilibrated Solutions: Bleaching Solution No. | Fixer | Remarks | Sample C: Amount of Ag Remaining (μg/cm²) | ΔDG min | Sample C-1: Amount of Ag Remaining (μg/cm²) | ΔDG min | Sample C-2: Amount of Ag Remaining (μg/cm²) | ΔDG min | Sample C-3: Amount of Ag Remaining (μg/cm²) | ΔDG min |
|---|---|---|---|---|---|---|---|---|---|---|---|
| 1 | 2 | F | Comparison | 18 | +0.14 | 20 | +0.15 | 21 | +0.16 | 22 | +0.16 |
| 2 | 5 | C | Comparison | 6 | +0.08 | 6 | +0.08 | 6 | +0.09 | 6 | +0.09 |
| 3 | 5 | E | Invention | 3 | +0.05 | 1 | +0.02 | 1 | +0.02 | 1 | +0.02 |
| 4 | 5 | F | " | 3 | +0.05 | 1 | +0.02 | 1 | +0.02 | 1 | +0.02 |

EXAMPLE 8

Process No. 6 in Example 6 was repeated, where the ammonium (ethylenediaminetetraacetato)iron(III) was replaced by an equimolar amount of ammonium (diethylenetriaminepentaacetato)iron(III). The same good result was confirmed in the samples processed by the method of the present invention using Fixer D, E or F.

EXAMPLE 9

Process No. 4 in Example 6 was repeated, where the ammonium (ethylenediaminetetraacetato)iron(III) was replaced by an equimolar amount of ammonium (1,2-cyclohexanediaminetetraacetato)iron(III). The same good result was confirmed in the samples processed by the method of the present invention using Fixer D, E or F.

EXAMPLE 10

Process No. 4 in Example 6 was repeated, where the ammonium (ethylenediaminetetraacetato)-iron(III) was replaced by an equimolar amount of ammonium (1,2-propylenediaminetetraacetato)iron(III). The same good result was confirmed in the samples processed by the method of the present invention using Fixer D, E or F.

EXAMPLE 11

Samples C-1, C-2 and C-3 were prepared by the same method for the preparation of Sample C in Example 3, except that the magenta coupler (EX-6) used in the As is obvious from the results in Table 6 above, the amount of the silver remaining in the samples processed was small and the formation of magenta stain in the samples stored was reduced in accordance with the method of the present invention (Test Nos. 3 and 4). In particular, the effect was remarkable in Samples C-1, C-2 and C-3 containing the preferred magenta coupler.

While the invention has been described in detail and with reference to specific embodiments thereof, it will be apparent to one skilled in the art that various changes and modifications can be made therein without departing from the spirit and scope thereof.

What is claimed is:

1. A method of processing a silver halide color photographic material in which the material is, after color-development, processed in a bath having bleaching ability and then in a bath fixing ability, wherein the bath having bleaching ability has a pH of from 5.0 to 3, wherein a bleaching agent in the bath having bleaching ability is at least one iron (III) complex of an aminopolycarboxyl acid of the following general formula (I) and wherein the bath having fixing ability contains at least one organic phosphonic acid:

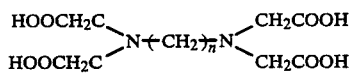

(I)

wherein n represents 3, 4 or 5.

2. The method as in claim 1, wherein n is 3 in formula (I).

3. The method as in claim 2, wherein the bleaching agent in the bath having bleaching ability comprises at least one iron(III) complex of a compound selected from the following group (A) and a (1,3-diaminopropanetetraacetato)iron(III) complex in a molar proportion of the former to the latter of 3 or less: Group (A):

A-1: Ethylenediaminetetraacetic Acid

A-2: Diethylenetriaminepentaacetic Acid

A-3: 1,2-Cyclohexanediaminetetraacetic Acid

A-4: 1,2-Propylenediaminetetraacetic Acid

4. The method as in any one of claims 1 to 3, wherein ammonium ion in the bath having fixing ability accounts for 90 mol % or more of the sum of alkali metal ions and ammonium ion in the bath having fixing ability.

5. The method as in any one of claims 1 to 3, wherein the bath having fixing ability contains from 50 g to 500 g of a thiosulfate per liter of the bath.

6. The method as in any one of claims 1 to 3, wherein the bath having fixing ability contains from 100 g to 300 g of a thiosulfate per liter of the bath.

7. The method as in any one of claims 1 to 3, wherein the pH of the bath having bleaching ability is from 4.5 to 3.5.

8. The method as in any one of claims 1 to 3, wherein the amount of the phosphonic acid in the bath having fixing ability is from 0.005 to 0.5 mol per liter of the bath.

9. The method as in any one of claims 1 to 3, wherein the amount of the phosphonic acid is from 0.05 to 0.1 mol per liter of the bath.

10. The method as in any one of claims 1 to 3, wherein the bath having fixing ability contains sulfite ion and bisulfite ion in a total amount of from 0.01 to 0.4 mol per liter of the bath.

11. The method as in any one of claims 1 to 3, wherein the bath having fixing ability contains sulfite ion and bisulfite ion in a total amount of from 0.05 to 0.3 mol per liter of the bath.

12. The method as in any one of claims 1 to 3, wherein the bath having bleaching ability contains a bleaching accelerator.

13. The method as in claim 12, wherein the bleaching accelerator is a compound selected from the group consisting of the compounds represented by formula (IA) to (VIA):

$$R^{1A}—S—M^{1A} \qquad \text{(IA)}$$

where $M^{1A}$ represents a hydrogen atom, an alkali metal atom or an ammonium group; and $R^{1A}$ represents an alkyl group, an alkylene group, an aryl group or a heterocyclic group;

$$R^{1A}—S—S—R^{6A} \qquad \text{(IIA)}$$

where has the same meaning as that in formula (IA); and $R^{6A}$ has the same meaning as $R^{1A}$ and the former may be same as or different from the latter;

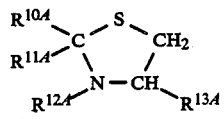

(IIIA)

where $R^{10A}$ and $R^{11A}$ may be same or different and each represents a hydrogen atom, an optionally substituted alkyl group, an optionally substituted phenyl group or an optionally substituted heterocyclic group;

$R^{12A}$ represents a hydrogen atom or an optionally substituted lower alkyl group; and $R^{13A}$ represents a hydrogen atom, an alkyl group or a carboxyl group;

$$X^{1A}—(CH_2)_{kB}—S—C(=NR^{14A})(NR^{15A}R^{16A}) \qquad \text{(IVA)}$$

where $R^{14A}$, $R^{15A}$ and $R^{16A}$ A may be same or different and each represents a hydrogen atom or a lower alkyl group;

$k_B$ represents an integer of from 1 to 5;

$X^{1A}$ represents an optionally substituted amino group, a sulfo group, a hydroxyl group, a carboxyl group or a hydrogen atom; and $R^{14A}$, $R^{15A}$ and $R^{16A}$ may be bonded to each other to form a ring;

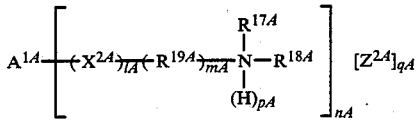

(VA)

where $A^{1A}$ represents an nA-valent aliphatic linking group, aromatic linking group or heterocyclic linking group, provided that when nA is 1, $A^{1A}$ represents an aliphatic group, aromatic group or heterocyclic group;

$X^{2A}$ represents —O—, —S—, or

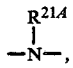

in which $R^{21A}$ represents a lower alkyl group;

$R^{17A}$ and $R^{18A}$ each represents a substituted or unsubstituted a lower alkyl group; $R^{19}A$ represents a lower alkylene group having from 1 to 5 carbon atoms;

$Z^{2A}$ represents an anion;

$R^{17A}$ and $R^{18A}$ may be bonded to each other via carbon and/or a hetero atom(s) to form a 5-membered or 6-membered hetero ring; $R^{17A}$ or $R^{18A}$ and A may be bonded to each other via carbon and/or a hetero atom(s) to form a 5-membered or 6-membered hetero ring; $R^{17A}$ or $R^{18A}$ and $R^{19A}$ may be bonded to each other via carbon and/or hetero atom(s) to form a 5-membered or 6-membered hetero ring; and lA represents 0 or 1; mA represents 0 or 1; nA represents 1, 2 or 3; pA represents 0 or 1; and qA represents 0, 1, 2 or 3; and

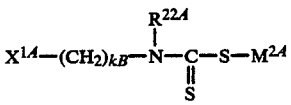

(VIA)

where $X^{1A}$ and $K_B$ have the same meanings as defined in the formula (IVA):

$M^{2A}$ represents a hydrogen atom, an alkali metal atom, an ammonium group or

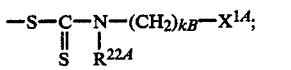

and $R^{22A}$ represents a hydrogen atom or a lower alkyl group.

14. The method as in anyone of claims 1 to 3, wherein the organic phosphonic acid in the bath having fixing ability is a compound selected from the group consisting of the compounds represented by formulas (II) to (X):

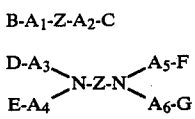

(II)

(III)

where $A_1$ to $A_6$ each represent a substituted or unsubstituted alkelene group;

Z represents an alkylene group, a cyclohexylene group, a phenylene group, —R—O—R—, —RORORO—,

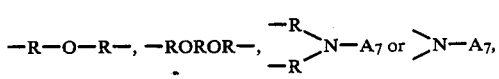

where R represents an alkylene group; and $A_7$ represents a hydrogen atom, a hydrocarbon group, a lower aliphatic carboxylic acid group or a lower alcohol residue; B, C, D, E, F and G each represents —OH, —COOM, —$PO(OM)_2$, where M represents a hydrogen atom, an alkali metal atom or an ammonium group, and at least one of B, C, D, E, F and G is —$PO(OM)_2$;

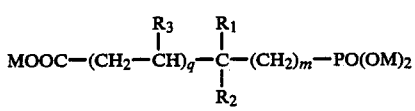

(IV)

where $R_1$ represents —COOM or —$PO(OM)_2$; $R_2$ represents a hydrogen atom, an alkyl group having from 1 to 4 carbon atoms, —$(CH_2)_n$, —COOM or a phenyl group;

$R_3$ represents a hydrogen atom or —COOM;

M represents a hydrogen atom, an alkali metal atom or an ammonium group;

m represents 0 or 1;

n' represents an integer of from 1 to 4;

q represents 0 or 1;

provided that when m is O, $R_1$ is —$PO(OM)_2$.

$R_4N[CH_2PO(OM)_2]_2$ (V)

where $R_4$ represents a lower alkyl group, an aryl group, an aralkyl group or a nitrogen-containing 6-membered heterocyclic group, which may be substituted by one or more substituents selected from the group consisting of —OH, —$OR_5$, where $R_5$ is an alkyl group having from 1 to 4 carbon atoms, —$PO(OH)_2$, —$CH_2(OM)_2$, —$N[CH_2PO(OM)_2]_2$, —COOM and —$N(CH_2COOM)_2$;

M represents a hydrogen atom, an alkali metal or an ammonium group;

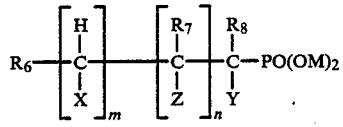

(VI)

where $R_6$ and $R_7$ each represent a hydrogen atom, a lower alkyl group, —COOH or —$NJ_2$, where J is —H, —OH, a lower alkyl group or —$C_2H_4OH$;

$R_8$ represents a hydrogen atom, a lower alkyl group, —OH or —$NL_2$, where L is —H, —OH, —$CH_3$, —$C_2H_5$, —C or —$PO(OM)_2$; X, Y and Z each represent —OH, —COOM, —$PO(OM)_2$ or —H; M represents a hydrogen atom, an alkali metal atom or an ammonium group;

n represents 0 or an integer of 1 or more; m represents 0 or 1;

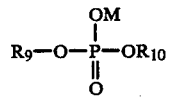

(VII)

where $R_9$ and $R_{10}$ each represent a hydrogen atom, an alkali metal atom, an ammonium group or a substituted or unsubstituted alkyl, alkenyl or cyclic alkyl group having from 1 to 12 carbon atoms;

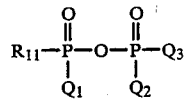

(VIII)

where $R_{11}$ represents an alkyl group having from 1 to 12 carbon atoms, an alkoxy group having from 1 to 12 carbon atoms, a monoalkylamino group having from 1 to 12 carbon atoms, a dialkylamino group having from 2 to 12 carbon atoms, an amino group, an aryloxy group having from 1 to 24 carbon atom, an arylamino group having from 6 to 24 carbon atoms or an amyloxy group;

$Q_1$ to $Q_3$ each represent —OH; an alkoxy, aralkyloxy or aryloxy group having from 1 to 24 carbon atoms; —OM, where M is a cation hydrogen atom, an alkali metal atom, or an ammonium group; an amino group; a morpholino group; a cyclic amino group; an alkylamino group; a dialkylamino group; an arylamino group or an alkyloxy group;

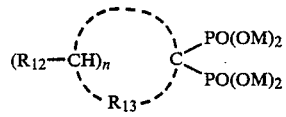

(IX)

where $R_{12}$ and $R_{13}$ each represent a hydrogen atom, a lower alkyl group or an imino group, which may optionally be substituted by a lower alkyl group and/or $-CH_2CH_2COONa$;

M represents a hydrogen atom, an alkali metal or an ammonium group;

n represents an integer of from 2 to 16; and

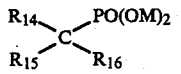

(X)

where $R_{14}$ to $R_{16}$ each are a hydrogen atom or an alkyl group, which may have substituent(s) selected from the group consisting of —OH, $-OC_{n''}H_{2n''+1}$ where n'' is 1 to 4, $-PO(OM)_2$, $-CH_2PO_3M$, $-N(R)_2$, where R is an alkyl group, and $-N[CH_2PO(OM)_2]_2$;

M represents a hydrogen atom, an alkali metal atom or an ammonium group.

15. The method as in anyone of claims 1 to 3, wherein the photographic material contains a coupler of the formula (M-I):

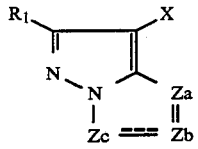

(M-1)

where $R_1$ represents a hydrogen atom or a substitutent; X represents a hydrogen atom or a group capable of being released by a coupling reaction with the oxidation product of an aromatic primary amine developing agent;

Za, Zb and Zc each represents a substituted methine group, =N— or —NH—, and one the of Za-Ab bond and the Zb-Zc bond is a double bond and the other is a single bond;

when the Zb-Zc bond is a carbon-carbon double bond, this may be a part of an aromatic ring;

$R_1$ or X may form a dimer or a higher polymer; and when Za, Ab or Zc represents a substituted methine group, a dimer or a higher polymer may be formed.

16. The method as in claim 15, wherein the coupler is selected from compounds of formulae (M-2), (M-3), (M-4), (M-5) and (M-6):

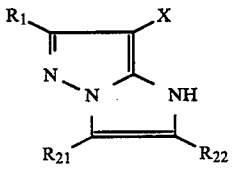

(M-2)

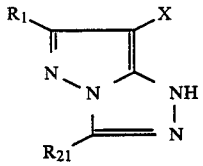

(M-3)

-continued

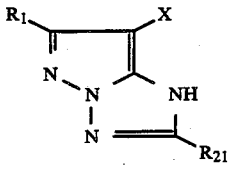

(M-4)

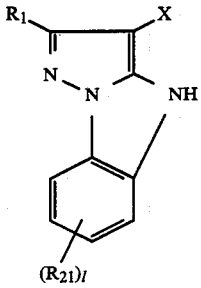

(M-5)

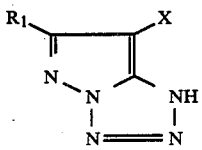

(M-6)

where $R_1$ and X have the same meanings as those defined in the formula (M-1):

$R_{21}$ and $R_{22}$ have the same meanings as $R_1$ defined in the formula (M-1): and l represents an integer of from 1 to 4.

17. The method as in claim 16, in which $R_1$, $R_{21}$ and $R_{22}$ in the formulae (M-2) to (M-6) each represent a hydrogen atom, a halogen atom, an alkyl group, an aryl group, a heterocyclic group, a hydroxyl group, an alkoxy group, an aryloxy group, a heterocyclic-oxy group, an acyloxy group, an alkoxycarbonyloxy group, an aryloxycarbonyloxy group, a carbamoyloxy group, a sulfamoyloxy group, a sulfonyloxy group, a carboxyl group, an acyl group, an alkoxycarbonyl group, an aryloxycarbonyl group, a carbamoyl group, an amino group, a anilino group, a heterocyclic-amino group, amido group, an urethane group, an ureido group, a sulfonamido group, an alkylthio group, an arylthio group, a heterocyclic-thio group, a sulfinyl group, a sulfonyl group, a sulfo group, a cyano group or a nitro group;

X in the formulae represents a hydrogen atom, a halogen atom, a carboxyl group, an oxygen-linking group, a nitrogen-linking group or a sulfur-linking group.

18. The method as in any one of claims 1 to 3, wherein the silver halide color photographic material comprises a photographic emulsion layer containing silver iodobromide, silver iodochloride or silver iodochlorobromide containing silver iodide in an amount of about 30 mol % or less.

19. The method as in any one of claims 1 to 3, wherein the silver halide color photographic material comprises a photographic emulsion layer containing silver iodobromide containing silver iodide in an amount of from about 1 mol % to about 25 mol %.

20. The method as in claim 4, wherein the ammonium ion in the bath having fixing ability accounts for 95 to 100 mol % of the sum of alkali metal ions and ammonium ion in the bath having fixing ability.

* * * * *